US008010026B2

(12) United States Patent
Kobayashi et al.

(10) Patent No.: US 8,010,026 B2
(45) Date of Patent: Aug. 30, 2011

(54) IMAGE FORMING SYSTEM AND METHOD OF DETECTING COLOR MISREGISTRATION

(75) Inventors: Kazuhiko Kobayashi, Tokyo (JP); Yasuhisa Ehara, Kanagawa (JP); Joh Ebara, Kanagawa (JP); Toshiyuki Uchida, Kanagawa (JP); Noriaki Funamoto, Tokyo (JP); Keisuke Sugiyama, Kanagawa (JP)

(73) Assignee: Ricoh Company Limited, Tokyo (JP)

( * ) Notice: Subject to any disclaimer, the term of this patent is extended or adjusted under 35 U.S.C. 154(b) by 735 days.

(21) Appl. No.: 11/867,426

(22) Filed: Oct. 4, 2007

(65) Prior Publication Data

US 2008/0240754 A1 Oct. 2, 2008

(30) Foreign Application Priority Data

Oct. 4, 2006 (JP) ..... 2006-272810
Apr. 10, 2007 (JP) ..... 2007-102965

(51) Int. Cl.
*G03G 15/01* (2006.01)

(52) U.S. Cl. ..... 399/301

(58) Field of Classification Search ..... 399/301
See application file for complete search history.

(56) References Cited

U.S. PATENT DOCUMENTS

| | | | | |
|---|---|---|---|---|
| 5,875,380 | A * | 2/1999 | Iwata et al. | 399/301 |
| 6,725,005 | B2 * | 4/2004 | Ueda et al. | 399/167 |
| 6,920,303 | B2 | 7/2005 | Yamanaka et al. | |
| 7,110,700 | B2 | 9/2006 | Andoh et al. | |
| 7,130,551 | B2 | 10/2006 | Kobayashi | |
| 7,251,444 | B2 | 7/2007 | Matsuda et al. | |
| 2004/0033090 | A1 * | 2/2004 | Yamanaka et al. | 399/301 |
| 2004/0109708 | A1 * | 6/2004 | Kobayashi et al. | 399/301 |
| 2005/0249524 | A1 * | 11/2005 | Matsuda et al. | 399/167 |
| 2006/0056868 | A1 | 3/2006 | Ebara et al. | |
| 2006/0165442 | A1 | 7/2006 | Kobayashi et al. | |
| 2006/0182471 | A1 | 8/2006 | Okamura et al. | |
| 2007/0097465 | A1 | 5/2007 | Kobayashi et al. | |
| 2007/0140736 | A1 | 6/2007 | Ehara et al. | |
| 2007/0196132 | A1 | 8/2007 | Kobayashi et al. | |

FOREIGN PATENT DOCUMENTS

| | | |
|---|---|---|
| JP | 10-142895 | 5/1998 |
| JP | 11-194561 | 7/1999 |
| JP | 11-311885 | 11/1999 |
| JP | 2004-12549 | 1/2004 |
| JP | 2006-11253 | 1/2006 |
| JP | 2006-235560 | 9/2006 |

* cited by examiner

*Primary Examiner* — David M Gray
*Assistant Examiner* — Barnabas T Fekete
(74) *Attorney, Agent, or Firm* — Oblon, Spivak, McClelland, Maier & Neustadt, L.L.P.

(57) ABSTRACT

An image forming system, in which a method of detecting a misregistration of a color image is performed, includes multiple image carriers, an optical writing unit, a transfer member extended by a drive roller and at least one driven roller, a rotation detector, a roller driving unit, a belt controller, an image detector configured to detect the images formed on the surface of the transfer member and obtain detection data, and a controller configured to calculate an amount of misregistration and correct relative misregistration of a scanning line between the image carriers based on a result of the calculation. In the image forming system, a distance from a transfer position to a detection position is an integer multiple of a travel distance of the transfer member during one revolution of the at least one driven roller.

16 Claims, 35 Drawing Sheets

Tk: CYCLE OF ECCENTRICITY OF DRIVE ROLLER

IMAGE FORMING SYSTEM AND METHOD OF DETECTING COLOR MISREGISTRATION

CROSS-REFERENCE TO RELATED APPLICATIONS

The present patent application claims priority under 35 U.S.C. §119 from Japanese Patent Application No. 2006-272810, filed on Oct. 4, 2006 in the Japan Patent Office, and No. 2007-102965, filed on Apr. 10, 2007 in the Japan Patent Office, the contents and disclosures of which are hereby incorporated by reference herein in their entirety.

BACKGROUND OF THE INVENTION

1. Field of the Invention

Exemplary embodiments of the present invention generally relate to an image forming system and a method of detecting a color misregistration, and more particularly, to an image forming system that can detect color misregistrations of images formed on a transfer member, and a method of detecting the misregistrations performed in the above-described image forming system.

2. Discussion of the Related Art

A tandem-type configuration is widely used in related-art image forming apparatuses for producing color images. In such a related-art image forming apparatus employing a tandem-type configuration, single toner images of different colors formed on respective surfaces of multiple image carriers are sequentially overlaid to form a full color image. Such a related-art image forming apparatus includes an optical writing unit emitting a light beam according to image data and forming a latent image on each surface of the image carriers. The optical writing unit generally includes a polygon mirror for scanning and deflecting a light beam generated by a light source and multiple optical elements such as lenses and mirrors for detecting the light beam from the polygon mirror to form a latent image on a surface of an image carrier.

The above-described configuration of the optical writing unit is susceptible to deviation in positions and angles between the optical elements according to the following changes in the optical elements. That is, respective image forming surfaces of the optical elements may be curved, a housing of the optical writing unit may be distorted, various components forming the optical writing unit may be deformed by generation of heat by rotation of the polygon mirror, the image carriers may be deformed when mounted, and so forth.

When the above-described changes in positions and angles between the optical elements occur, a position of the scanning line of a light beam with respect to an image carrier may vary. In addition, curves and inclinations may be caused in the scanning line of the light beam on the surface of the image carrier. As a result, relative deviations in scanning position of the scanning line between the image carriers, the curves and inclinations of the scanning lines, and so forth may appear as color image misregistrations.

Therefore, related-art color image forming apparatuses employ optical sensors serving as image detection units to detect an amount of relative misregistration of the scanning line between adjacent image carriers, so that the color image misregistration can be properly corrected. After images are formed on a surface of a transfer member such as a transfer belt, the optical sensors detect the positions of the images. According to the detection results, the scanning position of the scanning line between the image carriers, the curves and inclinations of the scanning lines, and so forth are adjusted.

A speed of the transfer belt may vary due to eccentricity of a drive roller for driving the transfer belt, slight slippage of the drive roller and the transfer belt, shocks or impacts given to a recording medium when fed and/or discharged, a change of load by applying various biases such as a transfer bias, and so forth. Accordingly, the detection results of the optical sensors include elements of misregistration due to variations in speed of the transfer belt, which prevents the optical sensors from detecting accurately relative misregistrations of the scanning lines. Therefore, the scanning position of the scanning lines, the curves and inclinations of the scanning lines, and so forth cannot be accurately adjusted.

In a related-art color image forming apparatus, a distance from a transfer position of a photoconductor drum to an optical sensor serving as an image detection unit is set as an integer multiple of a travel distance of the transfer belt during one revolution of the drive roller. By so doing, a factor of the color image misregistration caused by variations in speed of the transfer member due to eccentricity of the drive roller at the transfer position can be removed when the optical sensors detect the images. As a result, even when the speed of the transfer belt varies due to eccentricity of the drive roller, the optical sensor can detect an amount of relative misregistration of the scanning line after the factor of the color image misregistration caused by the speed variation of the transfer member due to eccentricity of the drive roller is accounted for. Accordingly, the scanning position of the scanning line between the image carriers, the curves and inclinations of the scanning lines, and so forth can be adjusted accurately.

However, the above-described operation cannot remove other factors that are also causes of color image misregistration, such as a slight slippage of the drive roller and the transfer belt, shocks or impacts given to a recording medium when fed and/or discharged, a change of load by applying various biases such as a transfer bias, and so forth. These are the factors of the speed variations other than the speed variation of the transfer belt, one cycle of which is determined to be one revolution of the drive roller. Accordingly, even with the detection results obtained by the optical sensors, the scanning position of the scanning line between the image carriers and the curves and inclinations of the scanning lines are not effectively adjusted accurately.

A different related-art color image forming apparatus uses an encoder serving as a rotation detection unit. The encoder is mounted on a driven roller supportably extending a transfer belt to detect a rotation condition of the driven roller and control the speed of the transfer belt based on the detection results. This controls the speed variation of the transfer belt, such as the eccentricity of the drive roller, the slight slippage of the drive roller and the transfer belt, the shocks or impacts given to a recording medium when fed and/or discharged, the change of load by applying various biases such as a transfer bias, and so forth. As a result, from the detection results the amount of the relative misregistration of the scanning line of images formed on the transfer belt can be detected.

However, when the driven roller equipped with the encoder (hereinafter also referred to as an "encoder roller") has eccentricity, feedback control is performed to the factor of speed variation caused by the eccentricity of the encoder roller, and therefore, the transfer belt may be affected by a speed variation due to eccentricity of the encoder roller. As a result, the image detection unit detects factors including the factor of misregistration of color images caused by the speed variation of the transfer belt due to eccentricity of the encoder roller.

Accordingly, it is difficult to use the detection results of the images to detect the amount of relative misregistration of the scanning line accurately.

SUMMARY OF THE INVENTION

Exemplary aspects of the present invention have been made in view of the above-described circumstances.

Exemplary aspects of the present invention provide an image forming system that can effectively adjust a misregistration of a color image.

Other exemplary aspects of the present invention provide an image forming method that can be performed in the above-described image forming apparatus to effectively adjust a misregistration of a color image.

In one exemplary embodiment, an image forming system includes multiple image carriers, an optical writing unit configured to optically write images on respective surfaces of the multiple image carriers, a transfer member in a form of a closed loop extended by a drive roller and at least one driven roller and configured to receive the images formed on the multiple image carriers on one of a surface thereof and a recording medium carried thereby, a rotation detector configured to detect a rotation condition of the at least one driven roller, a roller driving unit configured to drive the drive roller, a belt controller configured to transmit a detection results obtained by the rotation detector to the roller driving unit, an image detector configured to detect the images formed on the surface of the transfer member at given intervals along a travel direction of the transfer member and obtain detection data, and a controller configured to calculate an amount of misregistration with respect to a reference interval of the images based on the detection data obtained by the image detector and correct relative misregistration of a scanning line between adjacent image carriers based on a result of the calculation. In the image forming system, a distance from a first transfer position of each of the multiple image carriers to a detection position of the image detector is an integer multiple of a travel distance of the transfer member during one revolution of the at least one driven roller.

The travel distance of the transfer member during one revolution of the at least one driven roller may be determined based on an outer diameter of the at least one driven roller, a thickness of the transfer member, and an angle of the transfer member to the at least one driven roller.

The images arranged at the given intervals on the transfer member along the travel direction of the transfer member may include a first image and a second image diagonally formed with respect to the first image.

The images arranged at the given intervals on the transfer member along the travel direction of the transfer member may be formed as a mark set, and multiple mark sets are formed on the surface of the transfer member.

The multiple mark sets may be formed at different positions on the surface of the transfer member in a direction perpendicular to a surface travel direction of the transfer member.

The controller may adjust at least one of a misregistration in a main scanning direction, a magnification in the main scanning direction, a positional deviation in a sub-scanning direction, a magnification in a sub-scanning direction, an inclination, and a curve based on the detection data obtained by the image detector.

The image detector may be positioned opposite a first surface of the transfer member and facing a second surface of the transfer member, where the second surface contacts the image carrier.

The image detector may be separated from the first transfer position of an image carrier disposed at an extreme downstream side in the travel direction of the transfer member, by the transfer distance of the transfer member during one revolution of the at least one driven roller.

When the transfer member sequentially receives the images as an overlaid image on the surface thereof at the first transfer position and transfers the overlaid image onto the recording medium at a second transfer position, the image detector may be disposed upstream from the second transfer position in the travel direction of the transfer member.

When the transfer member sequentially receives the images as an overlaid image on the surface thereof at the first transfer position and transfers the overlaid image onto the recording medium at a second position, the image detector may be disposed downstream from the second transfer position in the travel direction of the transfer member.

Further, in one exemplary embodiment, a method of detecting a misregistration of a color image includes obtaining a rotation condition of a driven roller extending a transfer member therearound, transmitting an obtained value of an output power of a rotation detector to a belt controller, comparing the obtained value of the output power of the rotation detector and a target value, feeding back a result of a comparison of the obtained value and the target value to a roller driving unit, arranging images at given intervals on the transfer member along a travel direction of the transfer member, detecting the images formed on the transfer member by an image detector, and calculating an amount of misregistration with respect to a reference interval of the images based on a result of the detecting. When the above-described method is performed, a distance from a first transfer position of at least one image carrier to a detection position of the image detector is an integer multiple of a travel distance of the transfer member during one revolution of the driven roller.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
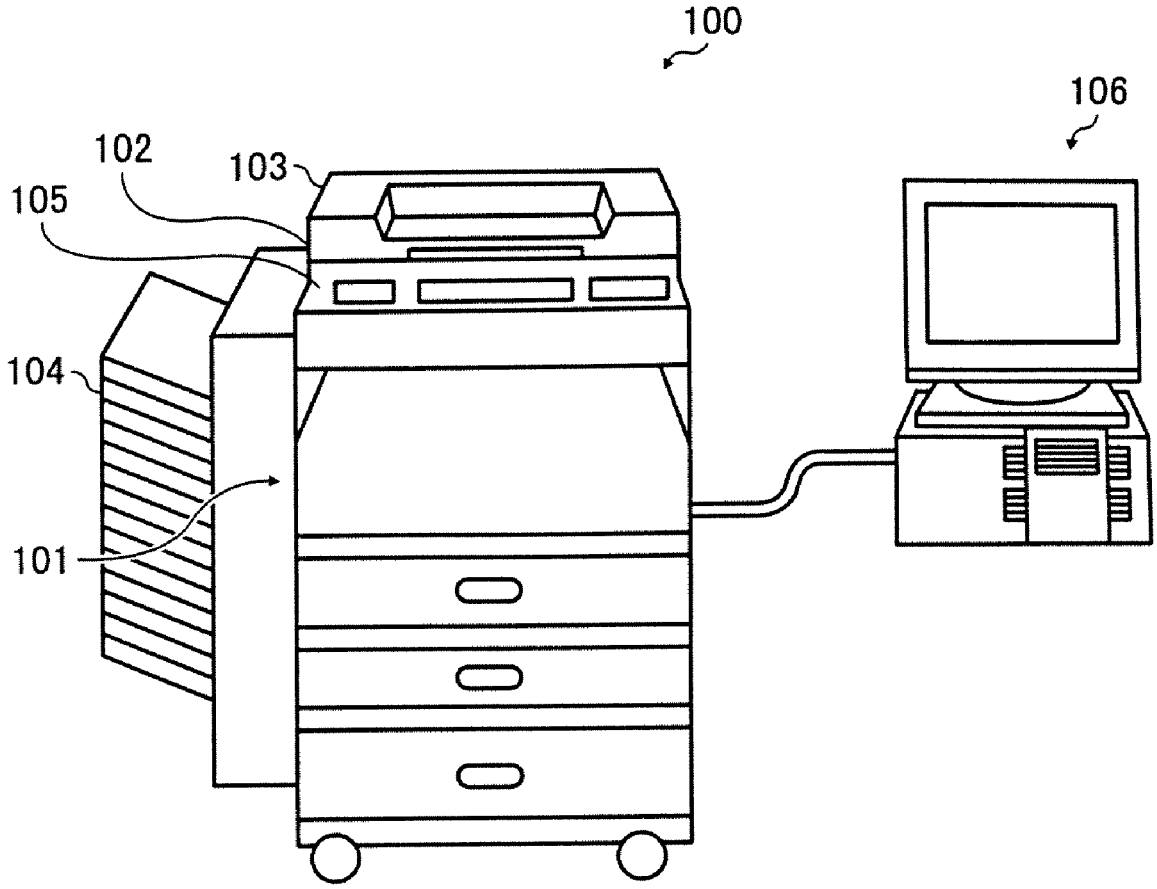
FIG. 1 is an external view for explaining an image forming system according to at least one exemplary embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

Referring now to the drawings, wherein like reference numerals designate identical or corresponding parts throughout the several views, preferred embodiments of the present invention are described.

Referring to FIGS. 1 through 4A, 4B, and 4C, schematic views and configurations of an image forming system 100 according to an exemplary embodiment of the present invention is described.

FIG. 1 shows an external view of the image forming system 100 according to an exemplary embodiment of the present invention.

Figure 2:
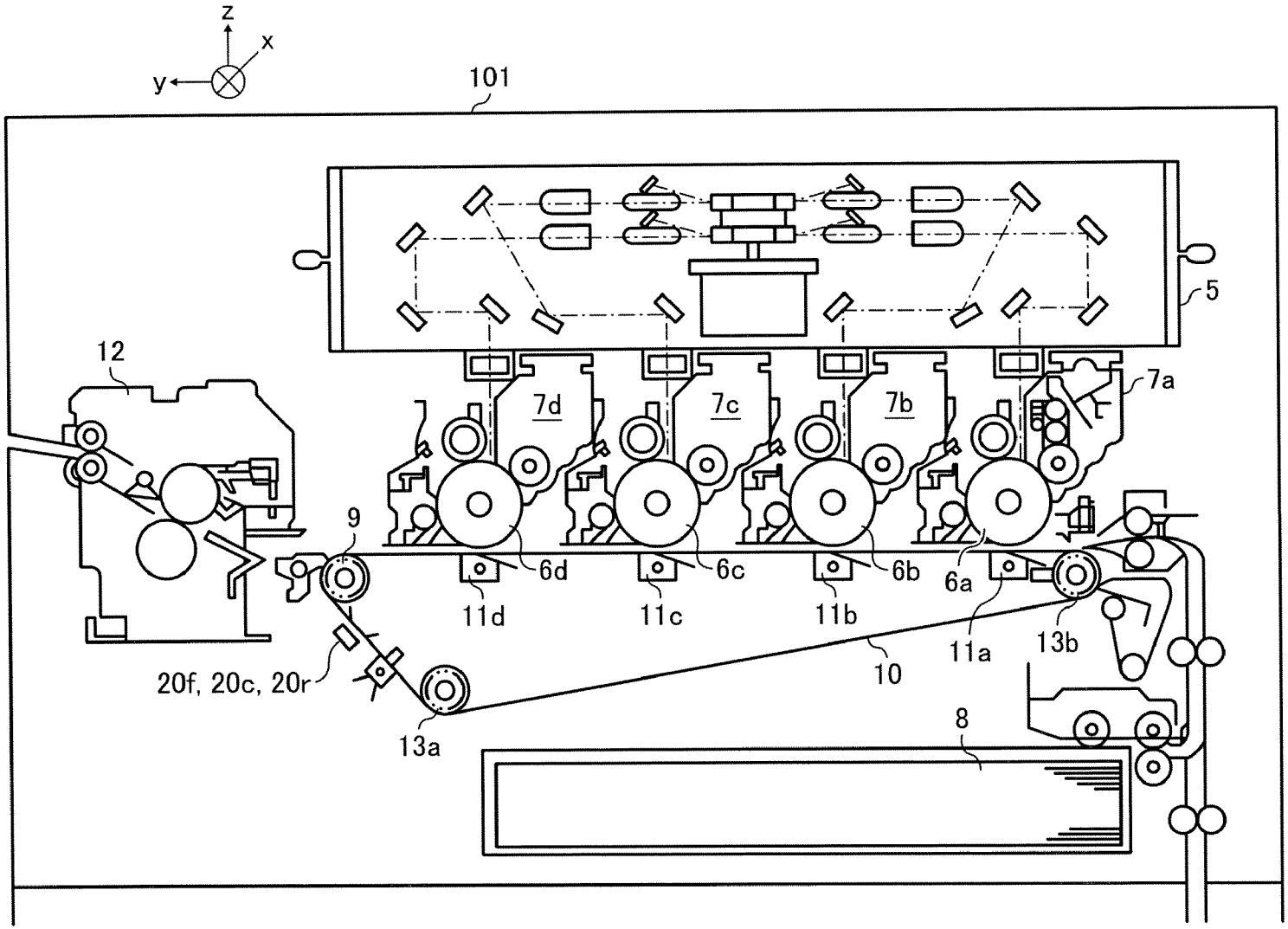
FIG. 2 is a schematic configuration of a printer of the image forming system of FIG. 1, according to at least one exemplary embodiment of the present invention.

FIG. 2 is a schematic configuration of an internal mechanism of a printer 101 of the image forming system 100 of FIG. 1.

Figure 3:
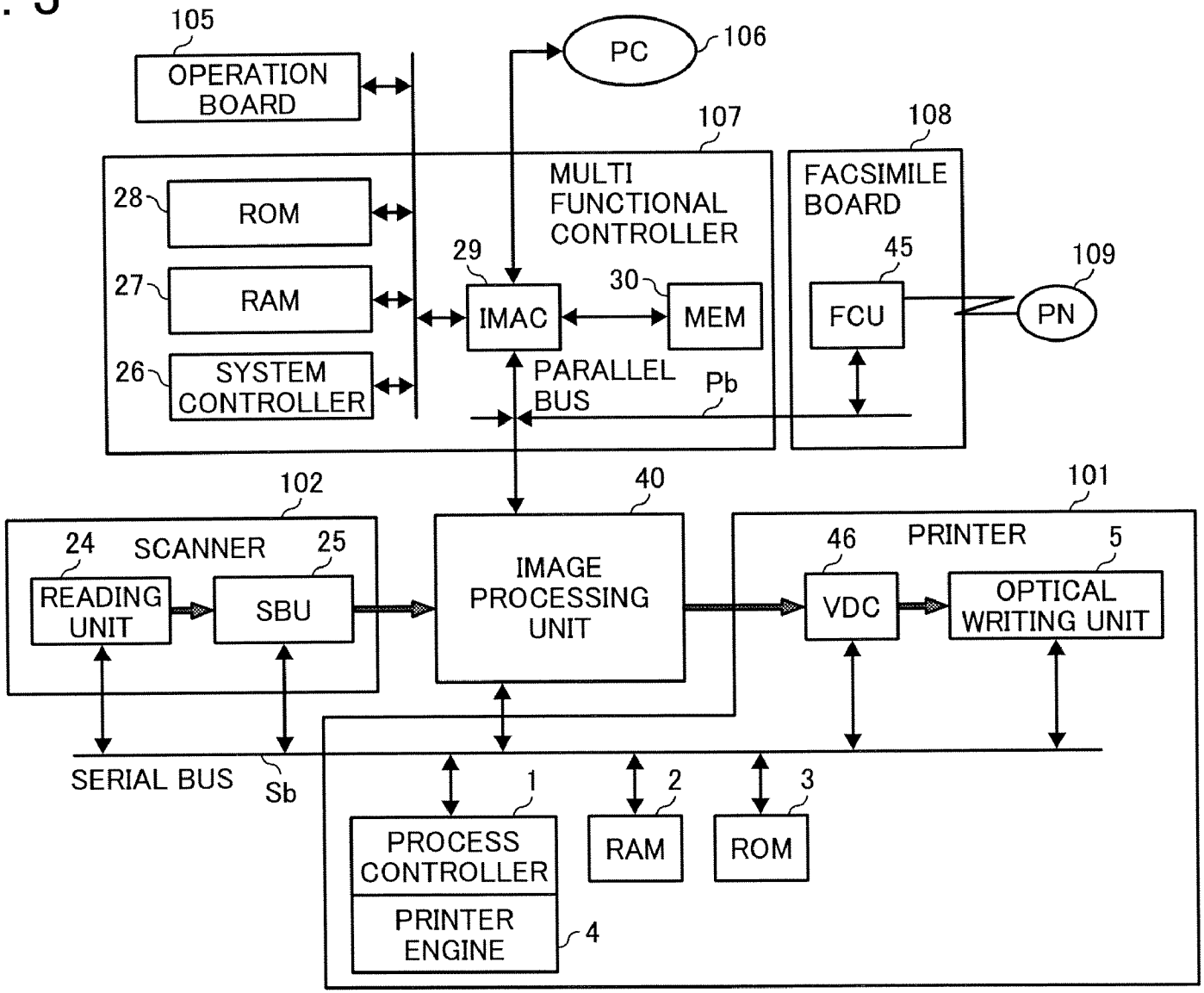
FIG. 3 is a block diagram of an electrical system structure of the image forming system of FIG. 1.

FIG. 3 is a block diagram of an electrical system structure of the image forming system 100 and the connected units of FIG. 1.

Figure 4A:
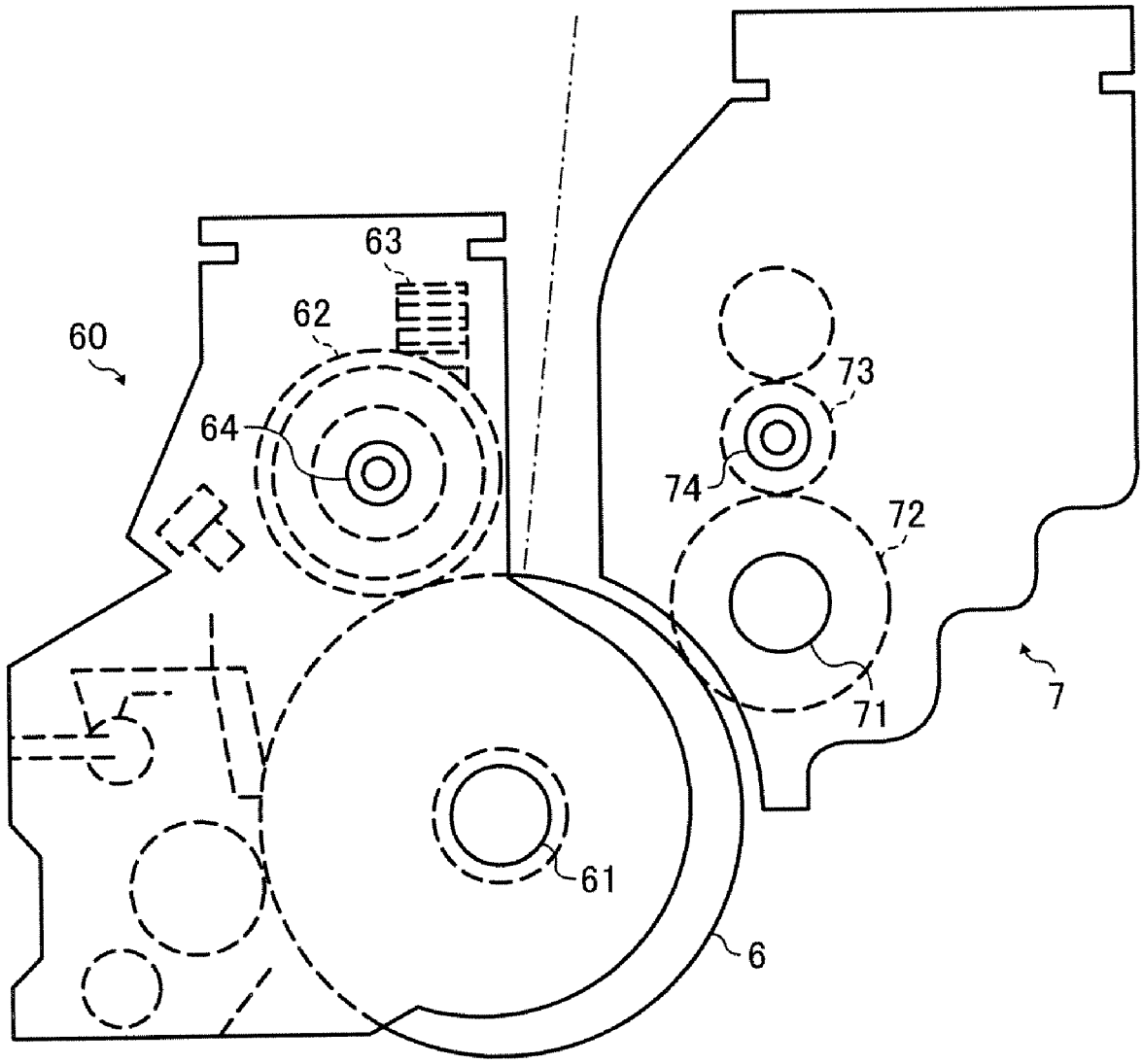
FIG. 4A is a front view of a photoconductor unit and a developing unit of the image forming system of FIG. 1.

FIG. 4A is a front view of a pair of photoconductor unit and developing unit of the image forming system 100 of FIG. 1.

Figure 4B:
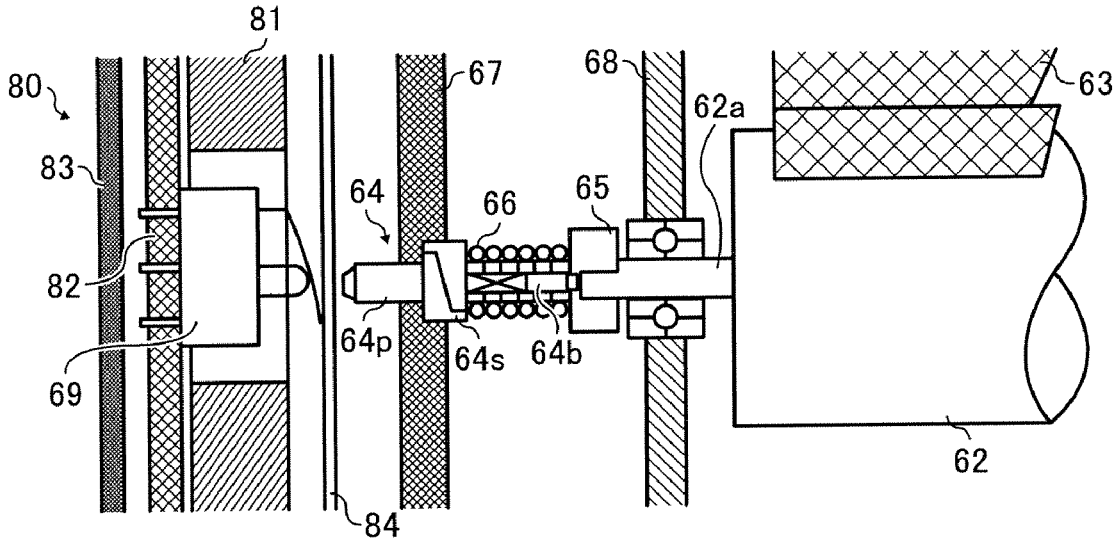
FIG. 4B is a cross-sectional view of a part of the photoconductor unit immediately after the photoconductor unit, which is new, has been attached to the image forming system of FIG. 1.

FIG. 4B is a cross-sectional view of a part in the vicinity of a threaded pin in the photoconductor unit immediately after the photoconductor unit, which is new, has been attached to the image forming system 100.

Figure 4C:
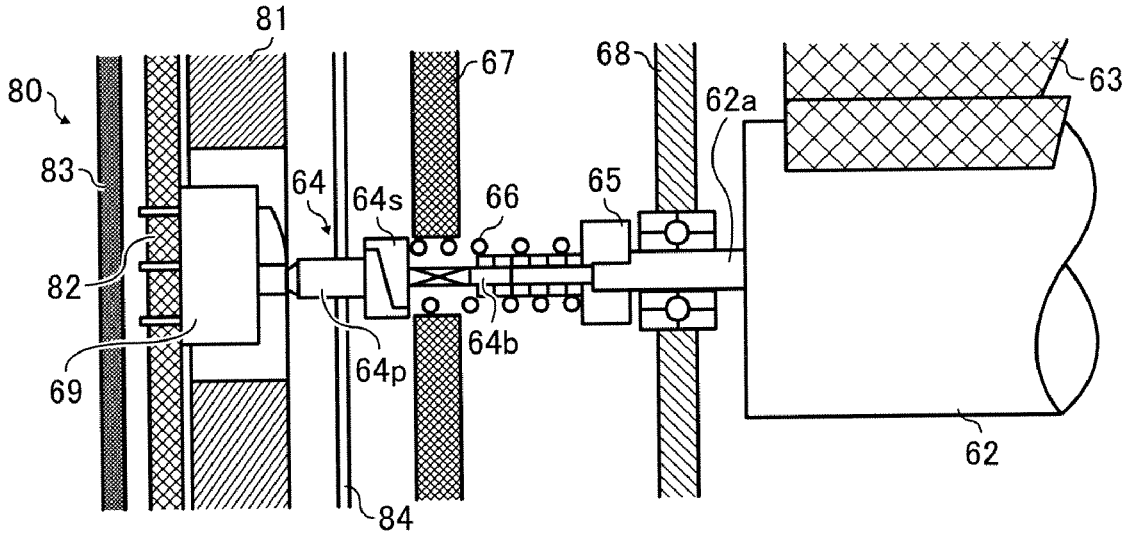
FIG. 4C is a cross-sectional view of a part of the photoconductor unit when a charge roller is rotated after the attachment of the photoconductor unit.

FIG. 4C is a cross-sectional view of a part in the vicinity of a threaded pin in the photoconductor unit when a charge roller is rotated after the attachment of the photoconductor unit.

As shown in FIG. 1, the image forming system 100 is a multifunctional, digital color image forming apparatus including a color printer or printer 101, an image scanner 102, an automatic document feeder or ADF 103, a sorter 104, and an operation board 105. Such a multifunctional image forming apparatus can perform by itself overall procedures of producing copies of an original document.

The image forming system 100 is connected to a personal computer or PC 106. When the image forming system 100 receives print data or image data via a communication interface from the host PC 106, copies may be produced or printed out based on the image data.

The printer 101 shown in FIG. 2 includes an optical writing unit 5, photoconductor drums 6*a*, 6*b*, 6*c*, and 6*d* serving as image carriers, developing units 7*a*, 7*b*, 7*c*, and 7*d*, a sheet feeding cassette 8, a transfer belt 10, transfer members 11*a*, 11*b*, 11*c*, and 11*d*, a fixing device 12, and optical sensors 20*f*, 20*c*, and 20*r*.

Image data of each color emitted by the scanner 102 is converted to black (K) image data, yellow (Y) image data, cyan (C) image data, and magenta (M) image data for recording in each color (hereinafter, referred to as "image data") in an image processing unit 40 of FIG. 3. Then, the image data is sent to an optical writing unit 5 serving as an exposing unit of the printer 101.

As shown in FIG. 2, the optical writing unit 5 emits modulated laser light beams to irradiate respective surfaces of the photoconductor drums 6*a*, 6*b*, 6*c*, and 6*d* and irradiate for forming respective electrostatic latent images of magenta color, cyan color, yellow color, and black color. The respective electrostatic latent images are developed by the developing units 7*a*, 7*b*, 7*c*, and 7*d* with magenta toner, cyan toner, yellow toner, and black toner, respectively, to form respective visible toner images.

At the same time, a recording medium or transfer sheet is fed from the sheet feeding cassette 8 to the transfer belt 10 of a transfer belt mechanism. The respective color toner images formed on the corresponding photoconductor drums 6*a*, 6*b*, 6*c*, and 6*d* are sequentially transferred onto the transfer sheet by the corresponding transfer members 11*a*, 11*b*, 11*c*, and 11*d* so that an overlaid toner image can be formed. Then, the overlaid toner image is fixed onto the transfer sheet by the fixing device 12 to form a full-color image, and is discharged outside of the printer 101.

The transfer belt 10 includes a translucent endless belt and is supported by a drive roller 9, a tension roller 13*a*, and a driven roller 13*b*. Since the tension roller 13*a* pushes down the transfer belt 10 with a spring, not shown, a tension force of the transfer belt 10 is maintained to a substantially constant level.

A description is now given of detailed configuration and functions of the image forming system 100, in reference to FIG. 3.

The electrical system structure of the image forming system 100 in FIG. 3 mainly includes the printer 101, the scanner 102, the operation board 105, a multifunctional controller or MF controller 107, a facsimile communications board 108, and the image processing unit 40. The image forming system 100 shown in FIG. 3 is connected to the PC 106 and a public line communication network or PN 109.

The image scanner 102 optically reads an original document, and includes an image reading unit 24 and a sensor board unit or SBU 25. When a lamp, not shown, emits an original document, the reading unit 24 collects light reflected by the original document via mirrors and lenses to a light receiving element that includes charge-coupled devices or CCDs and so forth and is located on the SBU 25. An image signal converted to an electrical signal in the light receiving element is further converted on the SBU 25 into a digital signal, which is scanned image data, and outputted to the image processing unit 40.

The printer 101 includes a process controller 1, a random access memory or RAM 2, a read-only memory or ROM 3, a printer engine 4, the optical writing unit 5, and a vide data controller or VD controller 46.

The MF controller 107 includes a system controller 26, a random access memory or RAM 27, a read-only memory or ROM 28, an image memory access controller or IMA controller 29, and a memory module or memory 29. The MF controller 107 includes the RAM 27 and the ROM 28 to producing copies of an original document.

The facsimile communications board 108 includes a facsimile control unit or FCU 45.

The image processing unit 40 performs data format exchange for a data interface between the parallel bus Pb and the serial bus Sb.

The process controller 1 of the printer 101 and the system controller 26 of the MF controller 107 communicate via a serial bus Sb and a parallel bus Pb.

Image data read by the SBU 25 is transmitted to the image processing unit 40, in which an image processing operation is performed to correct signal deterioration according to quantization to optical or digital signal or deterioration in scanner signals or distortion in read image data due to a scanner characteristic. The corrected image data is transmitted to the MF controller 107 and stored in the memory 30 or is processed for a production of copies and transmitted to the printer 101 to be printed out.

Specifically, the image processing unit 40 conducts a job for storing the read image data in the memory 30 for reusing and a job for sending the read image data to the VD controller 46 for forming and printing images in the printer 101, without storing the read image data. For example, the read image data is stored in the memory 30 when multiple copies are to produce according to one original document. At this time, the image reading unit 24 is operated only for one time to store the read image data in the memory 30 and to use the stored data for multiple times. By contrast, the read image data is not stored in the memory 30 when one copy is produced from one original document. In this case, the read image data is prepared only to copy, therefore, there is no need to be stored in the memory 30. The MF controller 107 includes the RAM 27 and the ROM 28.

When the memory 30 is not used, the image processing unit 40 corrects the read image data and conducts an image quality processing for converting the tone of the image data to an area based gradation. The image data after the image quality processing is transmitted to the VD controller 46. The VD controller 46 conducts a post-processing for a dot formation and the pulse control for dot reproduction to the signals of the image data converted to the area based gradation. Then, the optical writing unit 5 of the printer 101 forms a reproduced image on a transfer sheet.

In a case in which the read image data is stored in the memory 30 and additional operations, for example, a rotation of direction of the image, composition of images, etc., is performed when the image data is read out therefrom, the corrected image data is sent to the IMA controller 29 via the parallel but Pb. Under the control of the system controller 24, the IMA controller 29 performs access control of image data and the memory 30, text code and character bit exchange for printing data for the PC 106, compression/extension of image data for an effective use of the memory 30, and so forth.

Image data sent to the IMA controller 29 is compressed then stored in the memory 30, and is read out when necessary. The image data read out from the memory 30 is extended to an original size, and is returned to the image processing unit 40 from the IMA controller 29 via the parallel but Pb.

After the image data has been returned, the image processing unit 40 performs the image quality processing and the pulse control in the VD controller 46. Then, the optical writing unit 5 forms a visible toner image on a transfer sheet.

When sending facsimile data, the image data read in image scanner 102 is corrected in the image processing unit 40 and transmitted to the FCU 45 of the facsimile communications board 108 via the parallel bus Pb. The image data is converted in the FCU 45 to data suitable for the facsimile communications, and sent to the PN 109.

By contrast, when receiving facsimile data, facsimile data sent from the PN 109 is converted to image data in the FCU 45 of the facsimile communications board 108 and transmitted to the image processing unit 40 via the parallel bus Pb and the IMA controller 29. At this time, no specific image processing is performed in the image processing unit 40, while the VD controller 46 performs a dot re-formation and the pulse control and the optical writing unit 5 forms a visible image on a transfer sheet.

When multiple jobs, for example, a copying operation, a facsimile sending/receiving operation, and a printing out or output operation are simultaneously performed, the system controller 26 of the MF controller 107 and the process controller 1 of the printer 101 control of allocation of the rights to use the reading unit 24, the optical writing unit 5, and the parallel bus Pb to the multiple jobs.

The process controller 1 of the printer 101 controls a flow of image data, and the system controller 26 of the MF controller 107 controls the entire system and manages activation of each resource. A user can select a desired function of the image forming system 100 from the operation board 105 and set the operation conditions for a job to be performed.

The printer engine 4 corresponds to an electrical system provided to of the printer 101 of FIG. 2 for driving a mechanism including electrical equipments such as motors, solenoids, chargers, heaters, and lamps, electrical sensors, electrical circuits (drivers) for driving the above-described equipments, and detecting circuits (signal processing circuits) for the above-described equipments. The process controller 1 controls operations of these electrical circuits and reads detection signals (operation statuses) of the electrical sensors.

The photoconductor drums 6*a*, 6*b*, 6*c*, and 6*d* are provided to photoconductor units 60*a*, 60*b*, 60*c*, and 60*d*, respectively. Each of the photoconductor units 60*a*, 60*b*, 60*c*, and 60*d* serving as photoconductor units for holding and carrying respective latent images includes a charge roller 62 (see FIG. 4A), a cleaning unit, and a discharge lamp around a corresponding photoconductor drum of the photoconductor drums 6*a*, 6*b*, 6*c*, and 6*d*. The photoconductor units 60*a*, 60*b*, 60*c*, and 60*d* and the developing units 7*a*, 7*b*, 7*c*, and 7*d* are detachably provided to the printer 101. A corresponding pair of photoconductor unit and developing unit forms an image forming unit.

Next, a description is given of a schematic structure of the photoconductor unit 60 including the photoconductor drum 6 and the developing unit 7, in reference to FIG. 4A.

It is noted that the structure and functions of the photoconductor drums 6*a*, 6*b*, 6*c*, and 6*d* are similar to each other, except for the toner colors. In addition, the structure and functions of the photoconductor units 60*a*, 60*b*, 60*c*, and 60*d* are similar to each other, and the structure and functions of the developing units 7*a*, 7*b*, 7*c*, and 7*d* are similar to each other. In this regard, suffixes "a", "b", "c", and "d" are omitted in FIGS. 4A, 4B, and 4C and the description below related to FIGS. 4A, 4B, and 4C.

A front end portion of a photoconductor drum shaft 61 of the photoconductor drum 6 provided in the photoconductor unit 60 protrudes a front cover 67 (see FIGS. 4B and 4C) of the photoconductor unit 60. The front end portion of the photoconductor drum shaft 61 is cone-shaped so that the front end portion can easily be inserted into a positioning hole, not shown, of the photoconductor drum 6 opening on a face plate 81 (see FIGS. 4B and 4C) of a face plate unit 80.

The face plate 81 includes respective positioning holes to receive the photoconductor drum shaft 61 of the photoconductor drum 6 and a developing roller shaft 71 of the developing unit 7. By fixing the face plate 81 to a frame of the face plate unit 80, the front end portions of the photoconductor drum shaft 61 and a front end portion of the developing roller shaft 71 are accurately positioned. The front plate 81 includes large holes for engaging a normally-closed micro switch 69 for detecting the presence/absence of attachment of the photoconductor unit 60 and a normally-closed micro switch 79 (see FIG. 9) for detecting the presence/absence of attachment of the developing unit 7. These micro switches 69 and 79 are supported by a printed board 82. An inner side of the face place 81 is covered by an inside cover 84 and an outer side of the printed board 82 is covered by an outside cover 83.

The photoconductor unit 60 includes a threaded pin 64 controlling the micro switch 69 protruding from the front side thereof, and the developing unit 7 includes a threaded pin 74 controlling the micro switch 79.

FIGS. 4B and 4C show cross-sectional views of the part in the vicinity of the threaded pin in the photoconductor unit 60. The photoconductor unit 60 in FIG. 4B is new and the charge roller 62 has not been rotated. By contrast, the charge roller 62 in FIG. 4C is used after the photoconductor unit 60 is attached to the printer 101.

The charge roller 62 for uniformly charging a surface of the photoconductor drum 6 is held in contact with the photoconductor drum 6 and rotates at a peripheral velocity that is substantially same as the photoconductor drum 6. Contamination adhered on a surface of the charge roller 62 is removed by a cleaning pad 63.

A rotation shaft 62*a* of the charge roller 62 is rotatably supported at a front supporting panel 68 of the photoconductor unit 60 via a bearing, not shown.

A connection sleeve 65 is fixedly attached to a leading end of the rotation shaft 62*a* of the charge roller 62 so as to rotate with the rotation shaft 62*a*. At the center of the connection sleeve 65, there is a hole, the cross section of which is a square shape. The hole is engaged with a leg 64*b*, having a square prism shape, of the threaded pin 64. The leg 64*b* includes a male thread 64*s*, approximately two-third of which is a square prism shape and approximately one-third of which on the leading edge side is a round bar shape for idling with respect to the connection sleeve 65.

As shown in FIG. 4B, a male pin 64*s* having a large diameter is provided between a head pin 64*p* and the leg 64*b* of the threaded pin 64. When the photoconductor unit 60 is new or unused, the male pin 64*s* is coupled with a female thread hole of the front cover 67 of the photoconductor unit 60 while a return spring 66 is pressed. Under this condition, a length of the threaded pin 64 protruding from the front cover 67 of the photoconductor unit 60 is short. When the charge roller 62 is rotated under the above-described condition, the thread pin 64 is rotated to couple with the female thread hole, moves to the face plate 81, and abuts against a switching element of the micro switch 69. As a result, the micro switch 69 that is in a close state is switched to an open state immediately before the male thread 64*s* of the threaded pin 64 passes through the female thread hole.

As shown in FIG. 4C, when the mail pin 64*s* passes through the female pin hole, the return spring 66 may push the threaded pin 64 to protrude from the inside cover 84. This may cause a prism part of the leg 64*b* of the threaded pin 64 to protrude from a square-shaped hole of the connection sleeve 65. As a result, the threaded pin 64 would not rotate even when the charge roller 62 rotates.

Therefore, when a used photoconductor unit, i.e., the photoconductor unit 60, is attached to the image forming system 100, the micro switch, i.e., the micro switch 69, is constantly in an open state or an "OFF" state. On the other hand, even when a new or unused photoconductor unit, i.e., the photoconductor unit 60, is attached to the image forming system 100 or replaced from an old unit, a micro switch, i.e., the micro switch 69 remains in a close state or an "ON" state until a charge roller, i.e., the charge roller 62, is rotated. A first power-on of a new or unused photoconductor unit after the replacement is noticed when a micro switch is switched to the open state after the start of the image forming mechanism while the micro switch remains in a close state at the power-on of an image forming system.

The developing unit 7 includes a developing roller 72, a regulating roller 73, and a threaded pin 74. The threaded pin 74 is coupled with the regulating roller 7 rotating in synchronization with the developing roller 72 in a same direction via a supporting mechanism similar to a supporting mechanism of the front cover 67 of the charge roller 62.

Figure 5:
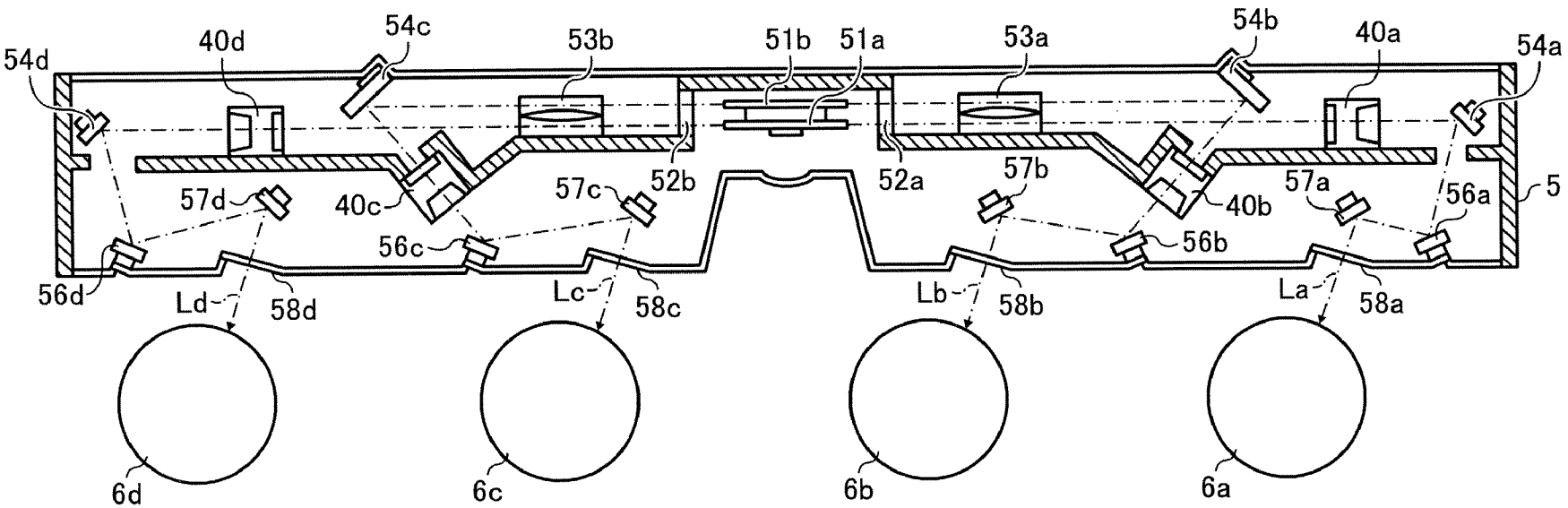
FIG. 5 is a schematic structure of an optical writing unit provided in the printer of FIG. 2.

Referring to FIG. 5, a schematic configuration of the optical writing unit 100 according to an exemplary embodiment of the present invention is described.

The optical writing unit 5 includes two polygon mirrors 51*a* and 51*b*. Each of the polygon mirrors 51*a* and 51*b* are polygonal shaped and includes reflection mirrors on each side. The polygon mirrors 51*a* and 51*b* are rotated at high speed by a polygon mirror, not shown, around a center shaft thereof. When laser light beams emitted from a laser diode or light source, not shown, enters to the sides of the polygon mirrors 51*a* and 51*b*, the laser light beam is reflected and deflected.

The optical writing unit 5 further includes sound-proof glasses 52*a* and 52*b* for blocking out noise generated by the polygon mirrors 51*a* and 51*b*, f-theta lenses 53*a* and 53*b* with which the polygon mirrors 51*a* and 51*b* change an equiangular motion in scanning the laser light beams to a linear motion conducting at a constant speed, mirrors 54*a*, 54*b*, 54*c*, 54*d*, 56*a*, 56*b*, 56*c*, 56*d*, 57*a*, 57*b*, 57*c*, and 57*d* with which the laser light beams are directed to the photoconductor drums 6*a*, 6*b*, 6*c*, and 6*d*, long lens units 40*a*, 40*b*, 40*c*, and 40*d* serving as adjusted member for correcting face tangle error of the polygon mirrors 51*a* and 51*b*, noise-proof glasses 58*a*, 58*b*, 58*c*, and 58*d* for preventing dust falling in a housing, and so forth.

In FIG. 5, the reference numerals La, Lb, Lc, and Ld respectively indicate optical paths of writing the laser light beams emitted to the photoconductor drums 6*a*, 6*b*, 6*c*, and 6*d*.

The optical writing unit 5 has an adjusting mechanism that adjusts curve and inclination of a scanning line. Inclination of the scanning line is adjusted by changing positions of the long lens units 40*a*, 40*b*, 40*c*, and 40*d* that are optical devices including respective long focal length lenses. The adjusting mechanism, by which inclination of scanning line is adjusted, is provided in the long lens units 40*a*, 40*b*, and 40*c* corresponding to the photoconductors 6*a*, 6*b*, and 6*c* for magenta (M), cyan (C), and yellow (Y). However, the adjusting mechanism is not provided in the long lens unit 40*d* for black (K) because the curves and inclinations of scanning lines of colors M, C, and Y are adjusted based on the curve and inclination of color K.

Figure 6A:
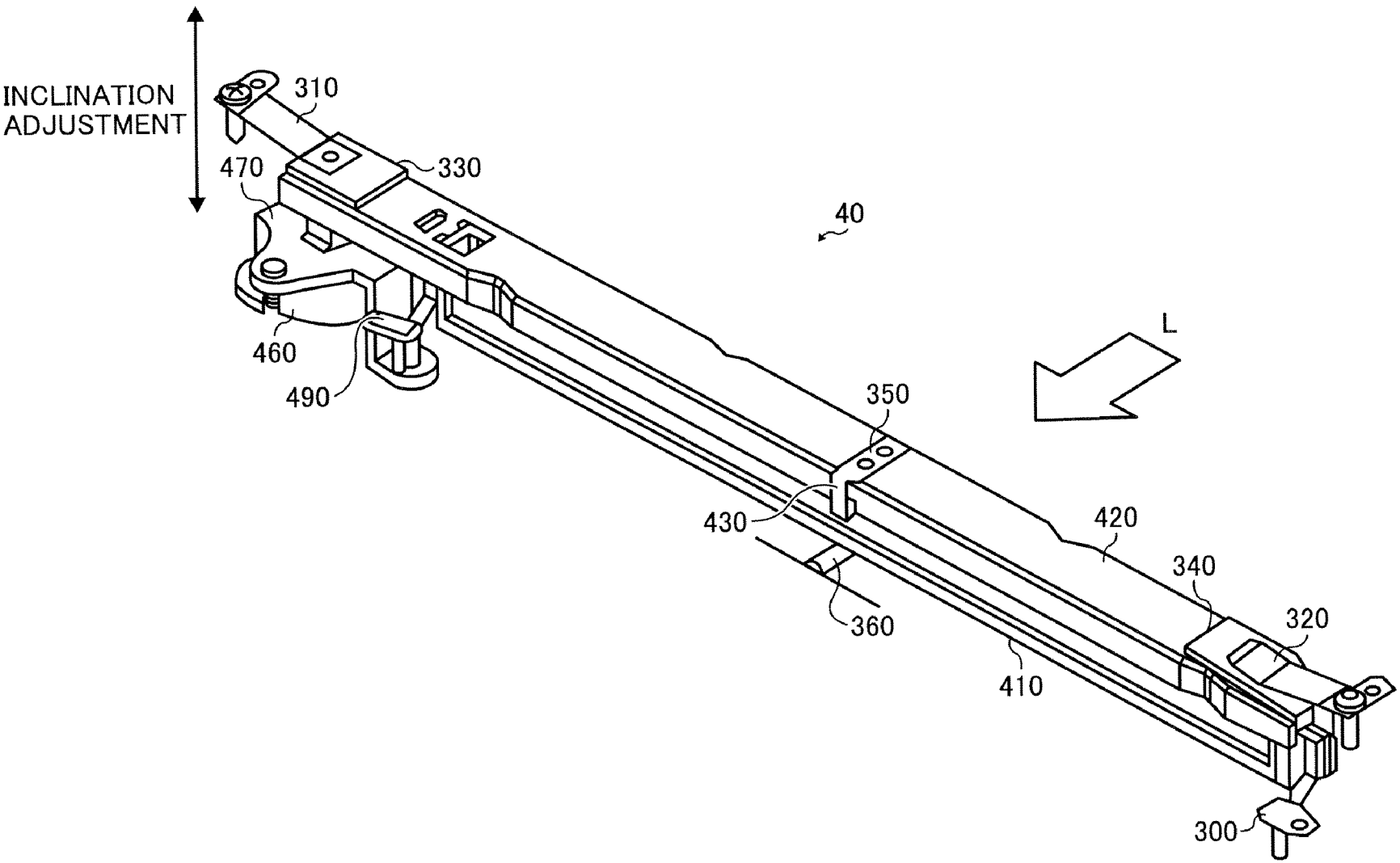
FIG. 6A is a perspective view of a long lens unit mounted in the optical writing unit of FIG. 5.
Figure 6B:
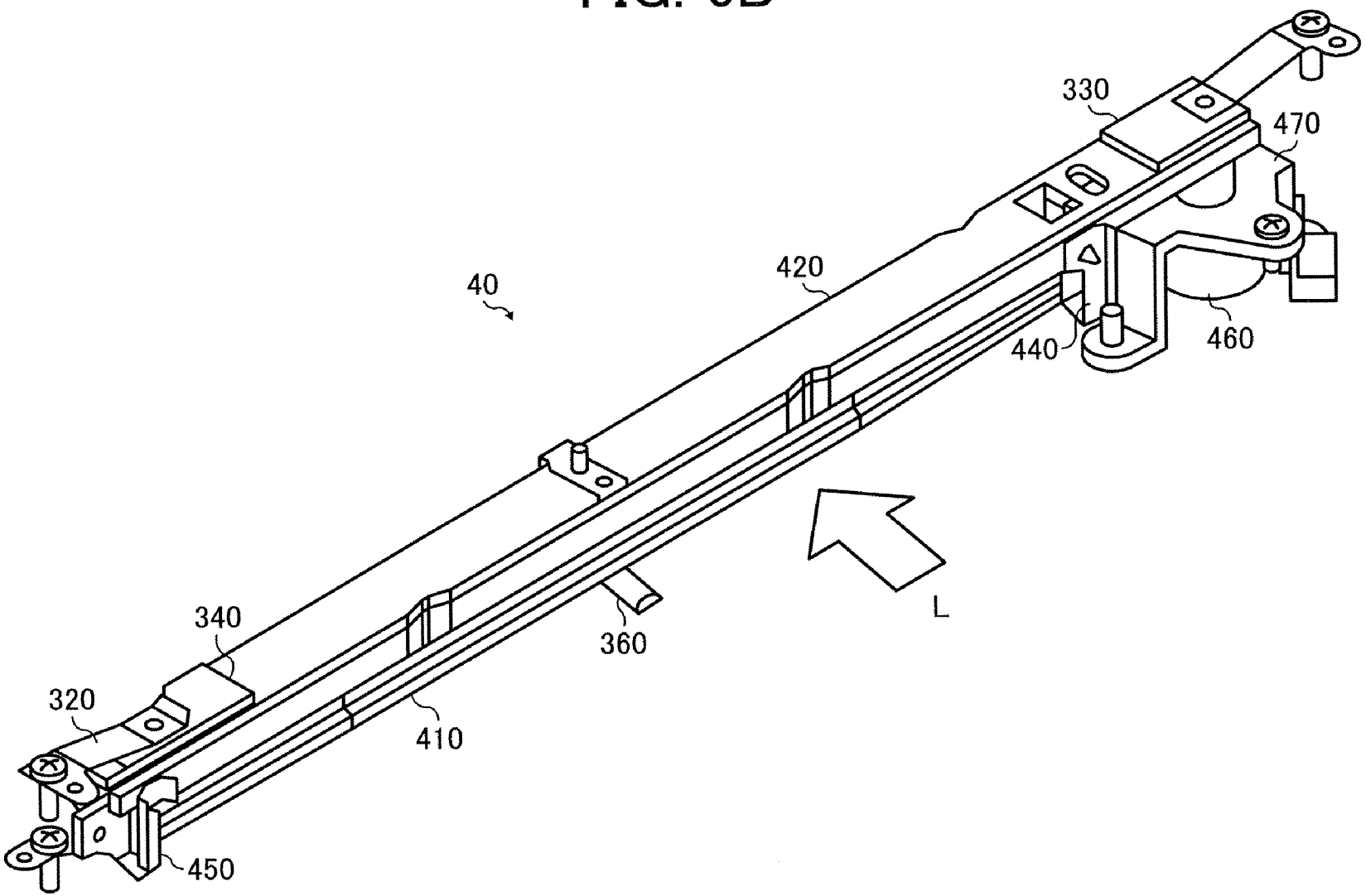
FIG. 6B is a perspective view of the long lens unit mounted in the optical writing unit of FIG. 5.

Referring to FIGS. 6A and 6B, different views showing the adjusting mechanism are described. Hereinafter, the description of the adjusting mechanism will be made while taking the long lens unit 40*a* corresponding to the photoconductor 6*a* for yellow (Y) as an example. In the description below, suffixes will be omitted.

FIGS. 6A and 6B are perspective views of the long lens unit 40, which is any of the long lens units 40*a*, 40*b*, 40*c*, and 40*d*.

FIGS. 6A and 6B are perspective views of different angles of the long lens unit 40 mounted in the optical writing unit 5.

The long lens unit 40 has a long lens 410 that corrects face tangle errors of the polygon mirrors 51*a* and 51*b*, a bracket 420 that holds the long lens 410, a curve adjusting plate spring 430 (see FIG. 6A), securing plate springs 440 and 450 (see FIG. 6B) for securing the long lens 410 and the bracket 420, a driving motor 460 for automatically adjusting inclination of scanning line, a driving motor holder 470, a screw bracket 480, not shown, a housing securing member 490 (see FIG. 6A), unit supporting plate springs 300, 310, and 320, smooth surface members 330 and 340 serving as a friction coefficient reducing unit, and a curve adjusting screw 350 (see FIG. 6A).

For adjusting an inclination of a scanning line, a rotation angle of the driving motor 460 is controlled based on a skew amount calculated by control of correction or adjustment of misregistration as will be described later.

As a result, a lifting screw attached to the rotation axis of the driving motor 460 moves up and down and an end of the long lens unit 40 on the side of the driving motor 460 moves in the direction of the arrow indicated by a bidirectional arrow in FIG. 6A.

To be more specific, when the lifting screw moves up, the end on the side of the driving motor 460 of the long lens unit 40 rises against the force applied by the unit supporting plate spring 310. As a result, the long lens unit 40 swivels in the clockwise direction in FIGS. 6A and 6B about a supporting base 360, and thus changes its position.

On the other hand, when the lifting screw moves down, the end of the side of the driving motor 460 of the long lens unit 40 moves down by the help of the force applied by the unit supporting plate spring 310. As a result, the long lens unit 40 swivels in the counterclockwise direction in FIGS. 6A and 6B, supported on the supporting base 360, and thus changes the position.

When the position of the long lens unit 40 changes in the manner as described above, the position at which the laser light beam L enters the entrance face of the long lens 410 also changes.

The long lens 410 has the following characteristic: when the entrance position of the laser light beam L on the entrance face of the long lens 410 changes the direction that is perpendicular to the longitudinal direction and the direction of optical path of the long lens 410 (vertical direction), the angle relative to the vertical direction of the laser light beam L outgoing from the outgoing face of the long lens 410 (outgoing angle) changes.

Due to this characteristic, when the position of the long lens unit 40 changes by means of the lifting screw, the outgoing angle of the laser light beam L outgoing from the outgoing face of the long lens 410 changes correspondingly, with the result that the inclination of the scanning line on the photoconductor drum 6 by this laser light beam L changes.

Figure 7:
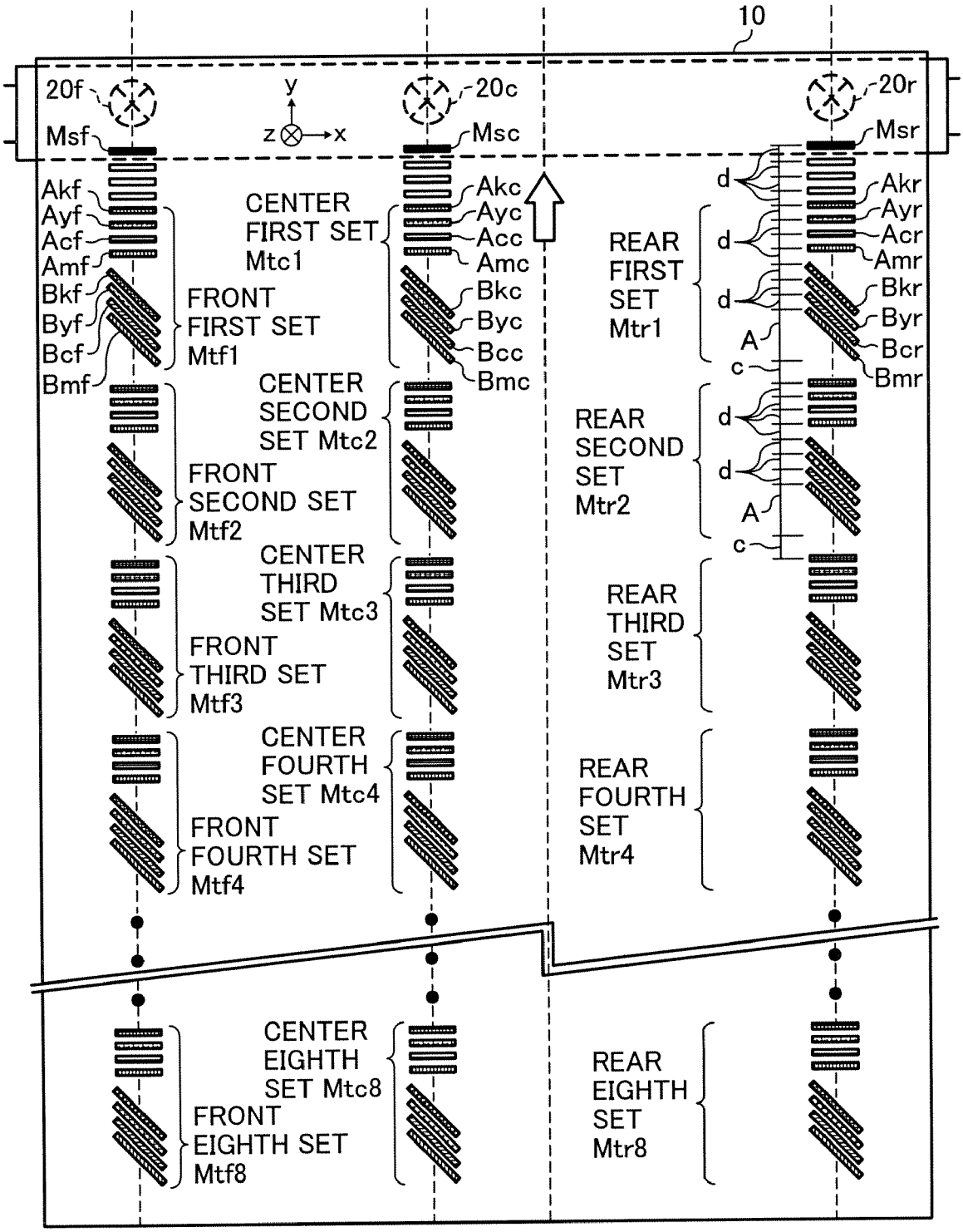
FIG. 7 is a view for explaining a group of mark patterns formed on a transfer belt.

Referring to FIG. 7, the control of color misregistration adjustment is described.

FIG. 7 is a view for explaining a group of mark patterns formed on a transfer belt, e.g., the transfer belt 10.

As shown in FIG. 7, in conducting the control of color misregistration adjustment, misregistration detection images, which are also referred to as test patterns, are formed on the transfer belt 10.

In FIG. 7, a direction "x" represents a direction perpendicular to the travel direction of the transfer belt 10, which can be a horizontal scanning direction or width direction of the transfer belt 10. Further, in FIG. 7, a direction "y" represents the travel direction of the transfer belt 10, which can be a vertical scanning direction or vertical direction of the transfer belt 10.

The test patterns formed on the transfer belt 10 are read by optical sensors 20*r*, 20*f*, and 20*c*. The optical sensors 20*r*, 20*c*, and 20*f* serve as image detector.

Detailed descriptions of the test patterns, which are positional deviation detection images, are illustrated below.

In a rear end part (rear) along the direction "x" of the transfer belt 10, a start mark Msr of black (K) is formed followed by a space of four pitches (4×d) of mark pitch "d", and eight sets of mark sets Mtr1 to Mtr8 are sequentially formed within one-twentieths cycle of the transfer belt 10 at a set pitch or constant pitch of 7d+A+cc.

It is noted that three outline rectangular boxes shown in the area explaining the space of four pitches 4*d* in FIG. 7 are drawn for convenience. The actual image has no visible outline rectangular boxes in the area shown in FIG. 7.

In the printer 101 according to an exemplary embodiment of the present invention, as rear side test patterns, a start mark Msr and eight sets of mark sets Mtr1 to Mtr8 are formed within one cycle of the rear end part of the intermediate transfer belt 20, and the start mark Msr and the eight sets of mark sets Mtr1 to Mtr8 include a total of 65 marks.

The first mark set Mtr1 includes as a perpendicular mark group with a group of mark patterns that are parallel with the direction "x", which is a width direction of the transfer belt 10:

first perpendicular mark Akr of black (K);
second perpendicular mark Ayr of yellow (Y);
third perpendicular mark Acr of cyan (C); and
fourth perpendicular mark Amr of magenta (M).

The first mark set Mtr1 further includes as a diagonal mark group with a group of mark patterns that form an angle of 45 degrees with respect to the direction "x":

first diagonal mark Bkr of black (BK);
second diagonal mark Byr of yellow (Y);
third diagonal mark Bcr of cyan (C); and
fourth diagonal mark Bmr of magenta (M).

The marks Akr to Amr and Bkr to Bmr are arranged at a mark pitch "d" in the direction "y", which is a travel direction of the transfer belt 10).

The second to eight mark sets Mtr2 to Mtr8 are identical to the first mark set Mtr1, and the mark sets Mtr1 to Mtr8 are arranged at a clearance "cc" in the direction "y."

Like the start mark Msr describe above, in a front end part (front) along the direction "x" of the transfer belt 10, a start mark Msf of black (K) is formed followed by a space of four pitches (4×d) of mark pitch "d", and eight sets of mark sets Mtf1 to Mtf8 are sequentially formed within one-twentieths cycle of the intermediate transfer belt 20 at a set pitch or constant pitch of 7d+A+cc.

In the printer 101 according to an exemplary embodiment of the present invention, as front side test patterns, a start mark Msf and eight sets of mark sets Mtf1 to Mtf8 are formed within one cycle of the front end part of the transfer belt 10, and the start mark Msf and the eight sets of mark sets Mtf1 to Mtf8 include a total of 65 marks.

The first mark set Mtf1 includes as a perpendicular mark group with a group of mark patterns that are parallel with the direction "x":

first perpendicular mark Akf of black (K);
second perpendicular mark Ayf of yellow (Y);
third perpendicular mark Acf of cyan (C); and
fourth perpendicular mark Amf of magenta (M).

The first mark set Mtf1 further includes as a diagonal mark group with a group of mark patterns that form an angle of 45 degrees with respect to the direction "x":

first diagonal mark Bkf of black (K);
second diagonal mark Byf of yellow (Y);
third diagonal mark Bcf of cyan (C); and
fourth diagonal mark Bmf of magenta (M).

The marks Akf to Amf and Bkf to Bmf are arranged at a mark pitch "d" in the direction "y".

The second to eight mark sets Mtf2 to Mtf8 are identical to the first mark set Mtf1, and the mark sets Mtf1 to Mtf8 are arranged at a clearance "cc" in the direction "y".

Like the start mark Msf described above, in a center part (center) along the direction "x" of the intermediate transfer belt 20, a start mark Msc of black (K) is formed followed by a space of four pitches (4×d) of mark pitch "d", and eight sets of mark sets Mtc1 to Mtc8 are sequentially formed within one-twentieths cycle of the intermediate transfer belt 20 at a set pitch or constant pitch of 7d+A+cc.

In the printer 101 according to an exemplary embodiment of the present invention, as center test patterns, a start mark Msc and eight sets of mark sets Mtc1 to Mtc8 are formed within one cycle of the center part of the transfer belt 10, and the start mark Msc and the eight sets of mark sets Mtc1 to Mtc8 include a total of 65 marks.

The first mark set Mtc1 includes as a perpendicular mark group with a group of mark patterns that are parallel with the direction "x":

first perpendicular mark Akc of black (K);
second perpendicular mark Ayc of yellow (Y);
third perpendicular mark Acc of cyan (C); and
fourth perpendicular mark Amc of magenta (M).

The first mark set Mtc1 further includes as a diagonal mark group with a group of mark patterns that form an angle of 45 degrees with respect to the direction "x":

first diagonal mark Bkc of black (K);
second diagonal mark Byc of yellow (Y);
third diagonal mark Bcc of cyan (C); and fourth diagonal mark Bmc of magenta (M).

The marks Akc to Amc and Bkc to Bmc are arranged at a mark pitch "d" in the direction "y."

The second to eight mark sets Mtc2 to Mtc8 are identical to the first mark set Mtc1, and the mark sets Mtc1 to Mtc8 are arranged at a clearance "cc" in the direction "y".

The last character "r" in the reference names denoting the marks Msr, Akr to Amr, and Bkr to Bmr contained in these test patterns represents that the mark belongs to the rear end part.

The last character "f" in the reference names denoting the marks Msf, Akf to Amf, and Bkf to Bmf contained in these test patterns represents that the mark belongs to the front end part.

The last character "c" in the reference names denoting the marks Msc, Akc to Amc, and Bkc to Bmc contained in these test patterns represents that the mark belongs to the center part.

These first mark sets of the eight mark sets belonging to the front end part, the rear end part, and the center part are collectively called "one mark set group."

Figure 8:
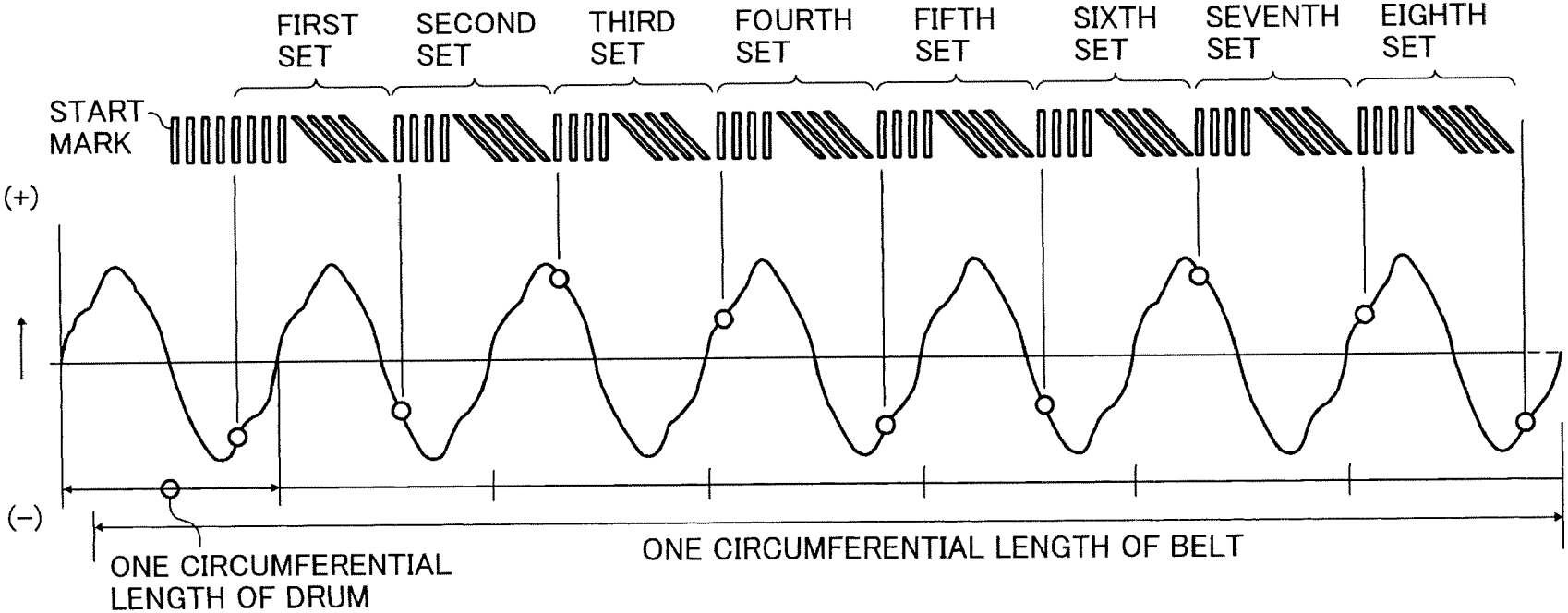
FIG. 8 is a graph showing test pattern distribution formed on the transfer belt and amounts of deviation of a mark forming position to a reference position.

FIG. 8 is a graph showing amounts of deviation of a mark forming position to a reference position, due to eccentricity of a circumferential surface of the photoconductor drum 6, a circumferential length during one revolution of the transfer belt 10, and mark sets transferred from the photoconductor drum 6, rendering in line.

In an exemplary embodiment of the present invention, a circumferential length substantially seven times the circumferential length of the photoconductor drum 6 equals to a circumferential length during one revolution of the photoconductor drums 6, and the eight mark sets are transferred over six circumferential lengths of the photoconductor drums 6*a*, 6*b*, 6*c*, and 6*d*. Since the start marks are formed before the eight mark sets, the total of 65 marks including the start marks and the eight mark sets are formed over a length corresponding to seven circumferential lengths of the photoconductor drum 6. Since the marks of one mark set are arranged at intervals, total of which ranging equal to three fourths of the circumferential length of the photoconductor drum 6, each of the first to fourth mark sets are formed at different positions on the surface of the photoconductor drum 6. However, the fifth to eight mark sets are respectively formed at substantially same positions of the first to fourth mark sets on the surface of the photoconductor drum 6.

Referring to FIGS. 9A, 9B, 10A, and 10B, structure and function of the process controller 1 of the printer 101 of the image forming system 100 are described.

Figure 9A:
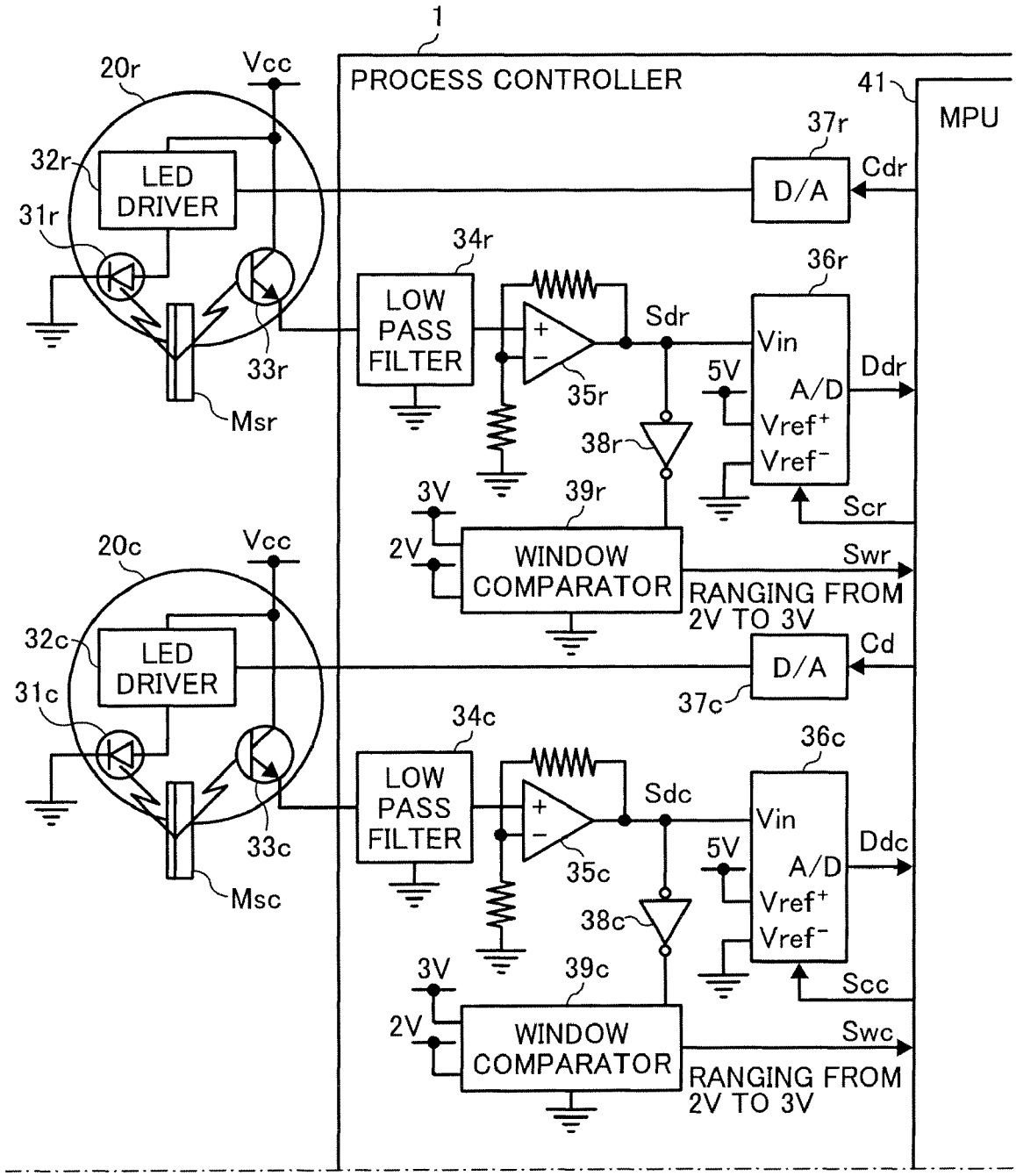
FIG. 9A is one part of a diagram for explaining a part of a control unit of the printer of FIG. 2.
Figure 9B:
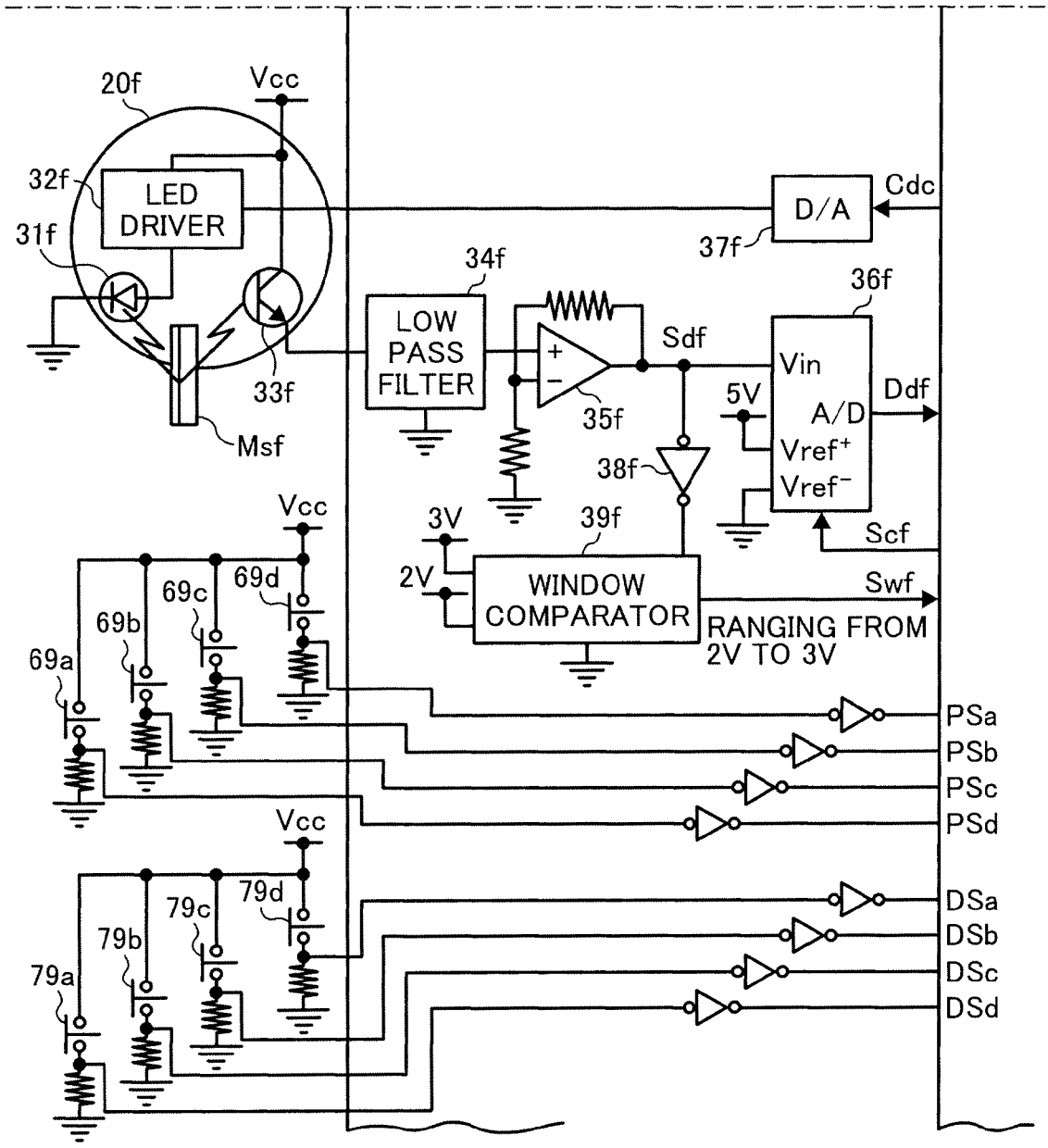
FIG. 9B is another part of the diagram of FIG. 9A.

FIGS. 9A and 9B show a diagram of a part of the process controller 1 of the printer 100.

Specifically, FIGS. 9A and 9B show micro switches 69*a*, 69*b*, 69*c*, and 69*d* for detecting attachment of the photoconductor units 60*a*, 60*b*, 60*c*, and 60*d*, respectively, of respective colors, micro switches 79*a*, 79*b*, 79*c*, and 79*d* for detecting attachment of the developing units 7*a*, 7*b*, 7*c*, and 7*d* (see FIG. 2) of respective colors, and the optical sensors 20*r*, 20*c*, and 20*f*, as well as electric circuits for reading detection signals thereof.

The process controller 1 includes a micro computer 41 that mainly includes a read-only memory or ROM, a random access memory or RAM, a central processing unit or CPU, a first-in first-out memory or FIFO memory for storing detection data, and so forth. Hereinafter, the micro computer 41 is referred to as an "MPU 41."

The MPU 41 serves as a controller that conducts operations of misregistration adjustment for reducing misregistration generally caused due to replacement of image forming components or parts by a new image forming component or part, which can result in a reduction of occurrence of color misregistration or a reduction of frequency of a color misregistration adjustment.

In a mark detecting stage, the micro computer 30 supplies digital-to-analog converters or D/A converters 37*r*, 37*c*, and 37*f* with conduction data that specifies conduction currents of light emitting diodes (LEDs) 31*r*, 31*c*, and 31*f* of the optical sensors 20*r*, 20*c*, and 20*f* shown in FIG. 7.

The D/A converters 37*r*, 37*c*, and 37*f* send the conduction data to LED drivers 32*r*, 32*c*, and 32*f* after converting the conduction data into analog voltages.

These drivers 32*r*, 32*c*, and 32*f* energize the LEDs 31*r*, 31*c*, and 31*f* with currents that are proportional to the analog voltages from the D/A converters 37*r*, 37*c*, and 37*f*.

The laser light beams La, Lb, Lc, and Ld occurring at LEDs 31*r*, 31*c*, and 31*f* hit on the transfer belt 10 (see FIG. 7) after passing through a slit (not shown), and most of the laser light beams La, Lb, Lc, and Ld transmit to the transfer belt 10 and are reflected by one of the tension rollers 13*a*.

The reflected laser light beams La, Lb, Lc, and Ld transmit the transfer belt 10 and hit on transistors 33*r*, 33*c*, and 33*f* through another slit (not shown).

As a result, impedances between collector and emitter in the transistors 33*r*, 33*c*, and 33*f* become low, and emitter potentials of the transistors 33*r*, 33*c*, and 33*f* increase.

When the marks on the transfer belt 10 reach the positions opposing the LEDs 31*r*, 31*c*, and 31*f*, the marks block the light from the LEDs 31*r*, 31*c*, and 31*f*.

Accordingly, impedances between collector and emitter in the transistors 33*r*, 33*c*, and 33*f* increase, and emitter voltages of the transistors 33*r*, 33*c*, and 33*f*, or levels of detection signals of the optical sensors 20*r*, 20*c*, and 20*f* decrease.

Therefore, as described above, when the test patterns are formed on the moving transfer belt 10, the detection signals of the optical sensors 20*r*, 20*c*, and 20*f* rise or fall.

A high level of detection signal means that the "mark is absent", while a low level of detection signal means that the "mark is present." In this way, the optical sensors 20*r*, 20*c*, and 20*f* constitute a mark detecting unit that detects each mark of rear side, each mark of center part, and each mark of front side on the transfer belt 10.

Therefore the optical sensors 20*r*, 20*c*, and 20*f* serve as image detector for detecting multiple visible images or marks.

The detection signals of the optical sensors 20*r*, 20*c*, and 20*f* are passed through low-pass filters 34*r*, 34*c*, and 34*f* for removing high-frequency noise and the levels thereof are calibrated to 0V to 5V by amplifiers 35*r*, 35*c*, and 35*f* for level calibration, and then applied to analog-to-digital or A/D converters 36*r*, 36*c*, and 36*f*.

Figure 10A:
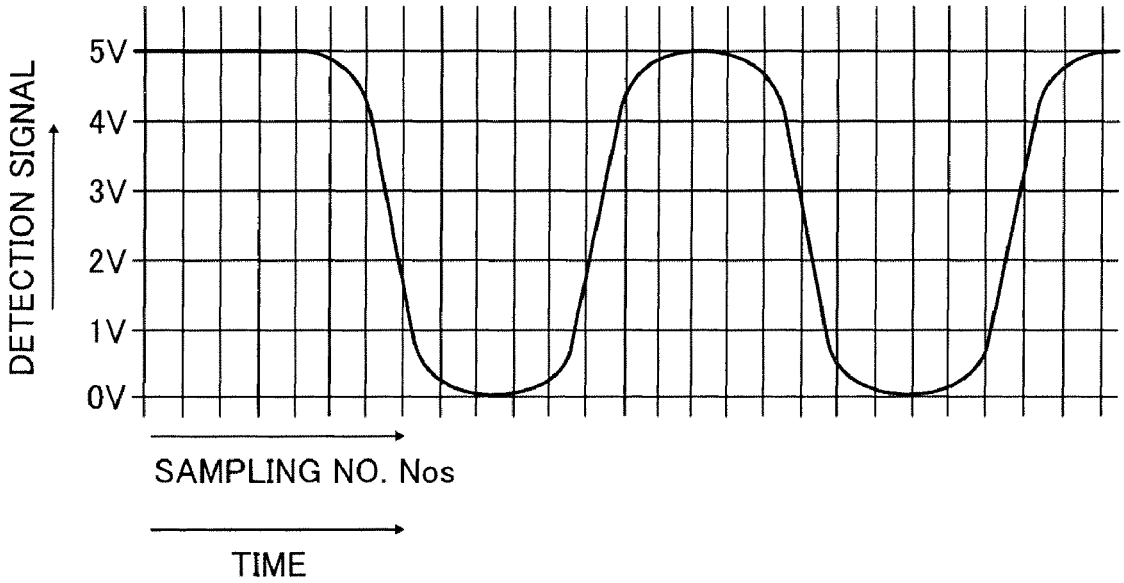
FIG. 10A is a timing chart of detection signals of the mark patterns.
Figure 10B:
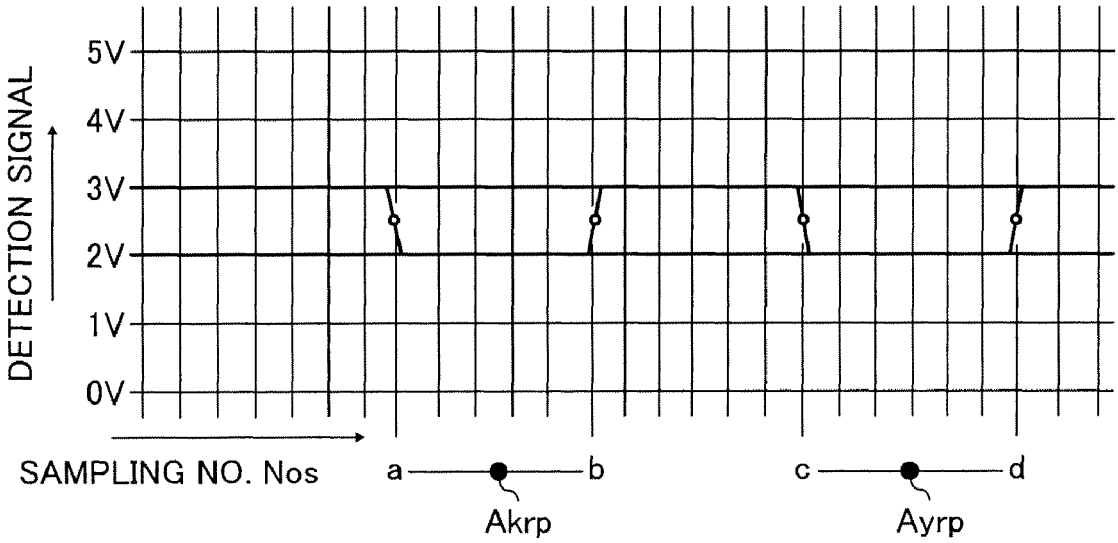
FIG. 10B is a timing chart representing only a range of the detection signals shown in FIG. 10A in which A/D conversion data is a written into a FIFO memory.

FIG. 10A is a timing chart of detection signals Sdr, Sdc, and Sdf of the mark patterns. FIG. 10B is a timing chart of level determination signals of low level L Swr, Swc, and Swf of the mark patterns.

The detection signals Sdr, Sdc, and Sdf have the wave forms as shown in FIG. 10A. In other words, at 5V the tension roller 13*a* is detected, and at 0V a mark is detected.

The part in which the signal falls from 5V to 0V means the leading end of a mark, and the part in which the signal rises from 0V to 5V means the trailing end of a mark.

The width of the mark is defined between the falling part and the raising part. These detection signals Sdr, Sdc, and Sdf are supplied to the A/D converters 36*r*, 36*c*, and 36*f* as shown in FIGS. 9A and 9B, as well as to window comparators 39*r*, 39*c*, and 39*f* through amplifiers 38*r*, 38*c*, and 38*f* shown in FIGS. 9A and 9B.

The A/D converters 36*r*, 36*c*, and 36*f* have sample hold circuits on their input sides in the interior thereof, and data latches (output latches) on their output sides. Upon reception of A/D conversion indicating signals Scr, Scc, and Scf from the MPU 41, the A/D converters 36*r*, 36*c*, and 36*f* hold the current detection signals Sdr, Sdc, and Sdf from the amplifiers 35*r*, 35*c*, and 35*f* and convert the current detection signals Sdr, Sdc, and Sdf to digital data and store in the data latches. Therefore, when it is necessary to read the detection signals Sdr, Sdc, and Sdf, the MPU 41 can supply the A/D converters 36*r*, 36*c*, and 36*f* with the A/D conversion indicating signals Scr, Scc, and Scf, and read digital data representing the levels of the detection signals Sdr, Sdc, and Sdf, which are detection data Ddr, Ddc, and Ddf.

The window comparators 39*r*, 39*c*, and 39*f* issue the level determination signals of low level L for signals Swr, Swc, and Swf when the detection signals from the amplifiers 38*r*, 38*c*, and 38*f* are at levels ranging from 2V to 3V. On the other hand, the window comparators 39*r*, 39*c*, and 39*f* issue level determination signals of high level H for signals Swr, Swc, and Swf when the detection signals from the amplifiers 38*r*, 38*c*, and 38*f* are out of the levels ranging from 2V to 3V.

FIG. 10B shows level determination signals of low level L for signals Swr, Swc, and Swf.

The MPU 41 can immediately recognize whether the detection signals Sdr, Sdc, and Sdf fall within the range by looking up these level determination signals Swr, Swc, and Swf.

Further, the MPU 41 captures from the micro switches 69*a* to 69*d* and 79*a* to 7*d* signals that represent an open/close status thereof.

Figure 11A:
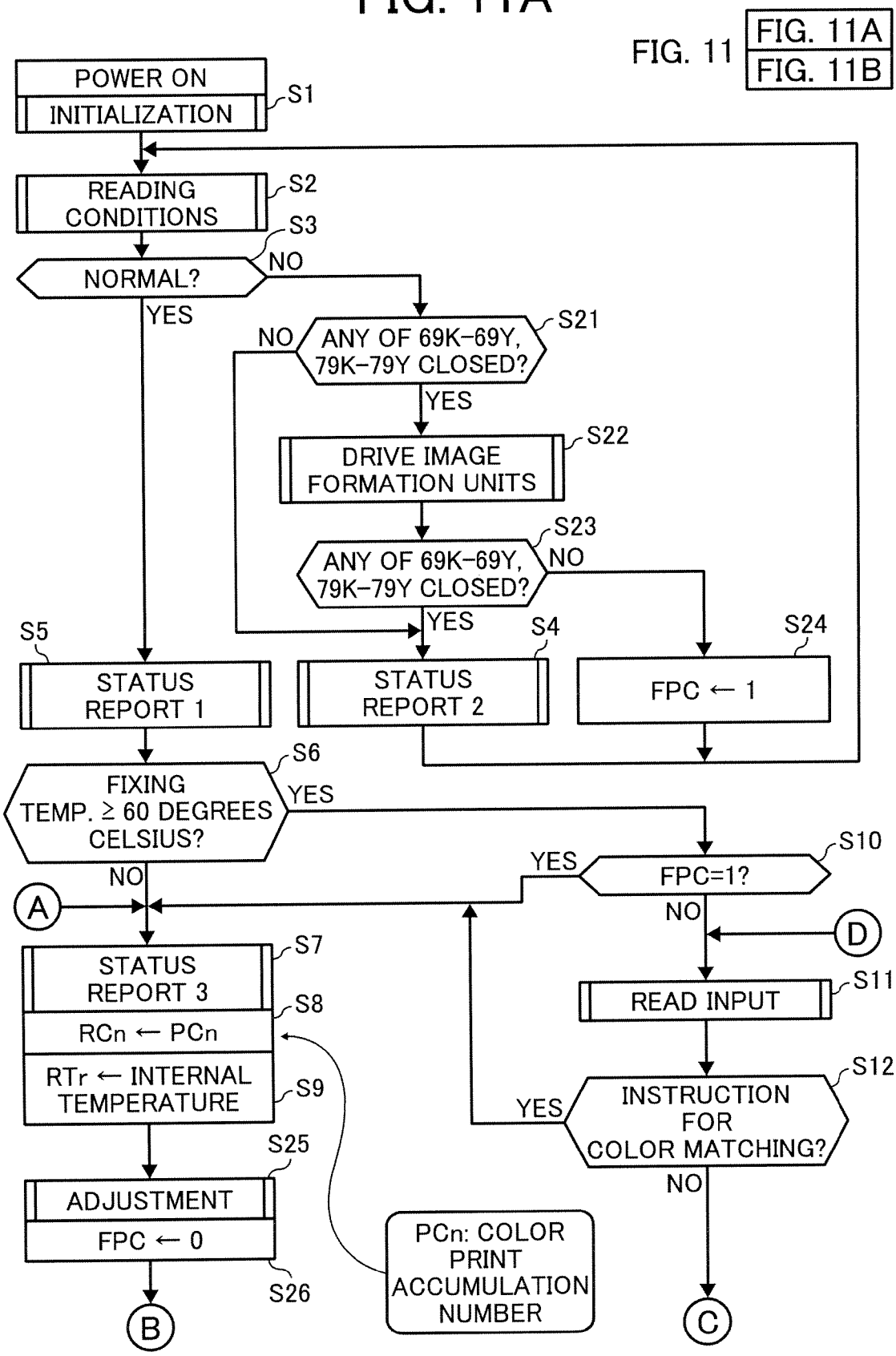
FIG. 11A is one part of a flowchart for explaining a part of control flow of the printer of FIG. 2.
Figure 11B:
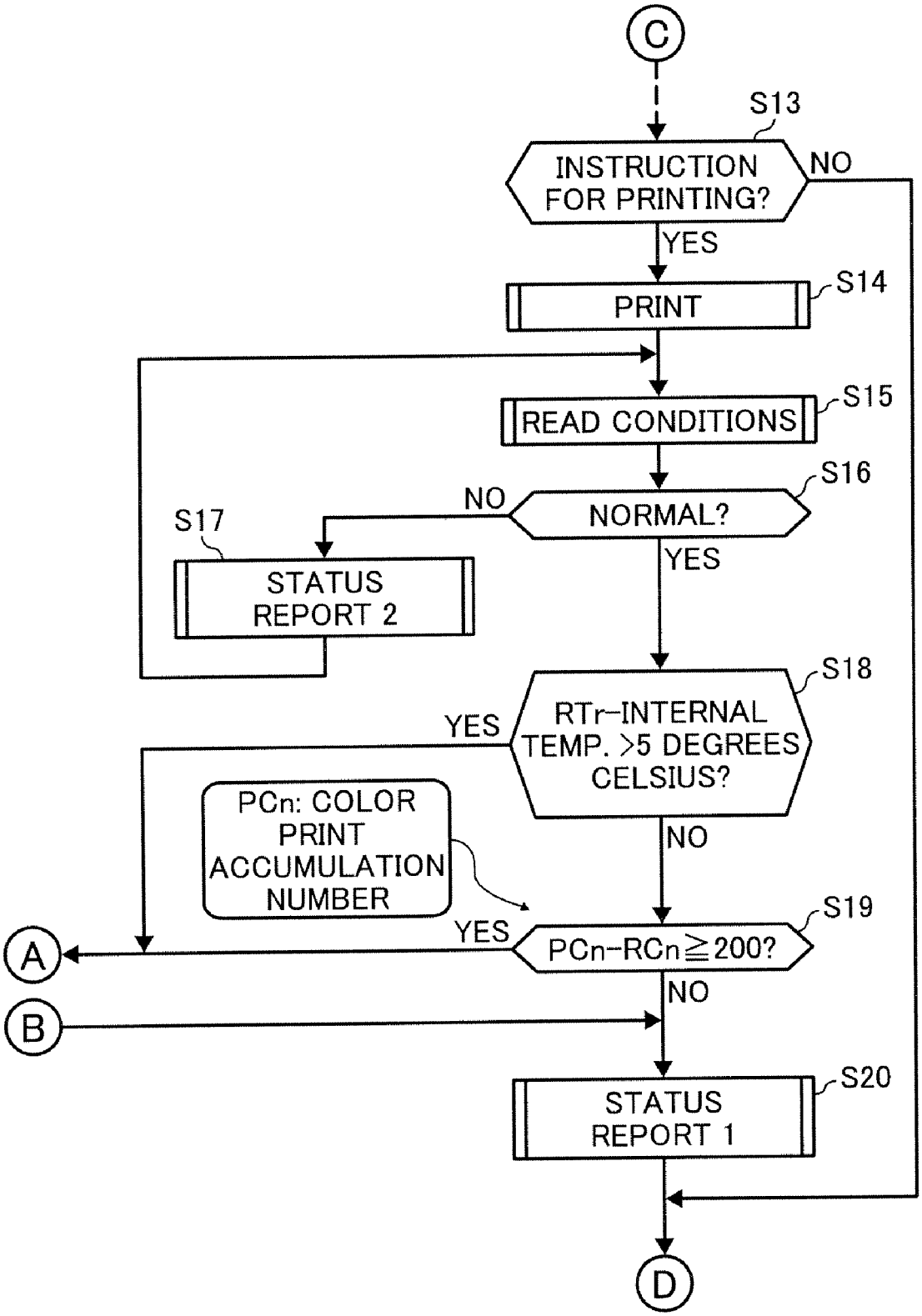
FIG. 11B is another part of the flowchart of FIG. 11A.

Referring to FIGS. 11A and 11B, a flowchart of a control flow of the MPU 41 of the printer 101 is described.

In step S1 in the flowchart of FIGS. 11A and 11B, when an operation voltage is applied upon turning on the power of the printer 101, the MPU 41 sets the signal level in the input/output port at a condition for standby state, and sets an internal register and a timer at conditions for standby state, which is an initialization operation.

After completing the initialization in step S1, the MPU 41 determines whether any trouble occurs in image formation by reading conditions of the mechanical parts and electric circuits of the printer 101 in steps S2 and S3.

When the condition is normal, the result of step S3 is YES, and the process goes to step S5.

When the condition is not normal, the result of step S3 is NO, and the process goes to step S21.

In step S21, the MPU 41 checks the open/close status of the micro switches 69*a* to 69*d* and 79*a* to 79*d*.

When none of the micro switches 69*a* to 69*d* and 79*a* to 79*d* is closed (ON), the result of step S21 is NO, and the process goes to step S4.

In step S4, the MPU 41 makes an operation display board or operation panel inform of the abnormality as "status report 2", and the process goes back to step S2. When any one of the micro switches 69*a* to 69*d* and 79*a* to 79*d* is closed (ON), the result of step S21 is YES, that is, an unit (e.g., any of the developing units 7*a*, 7*b*, 7*c*, and 7*d* and the photoconductor units 60*a*, 60*b*, 60*c*, and 60*d*) corresponding to the closed micro switch is not attached to the printer 101, or it is in the power ON state immediately after replacement of the unit by a new unit.

The micro switches 69*a* to 69*d* are switches that detect the presence/absence of attachment of four photoconductor units 60*a*, 60*b*, 60*c*, and 60*d* including the charge roller 62, the photoconductor drum 6, and the cleaning unit of each of the photoconductor units 60*a*, 60*b*, 60*c*, and 60*d* to a main body of the printer 101.

The micro switches 79*a* to 79*d* are switches that detect presence/absence of attachment of the developing units 7*a*, 7*b*, 7*c*, and 7*d* to the main body of the printer 101.

When any one of micro switches 69*a* to 69*d* and 79*a* to 79*d* is closed (ON), the result of step S21 is YES, and the MPU 41 temporarily drives the four photoconductor units 60*a*, 60*b*, 60*c*, and 60*d* that respectively form images on the photoconductor drums 6*a*, 6*b*, 6*c*, and 6*d* and the developing units 7*a*, 7*b*, 7*c*, and 7*d* in step S22.

To be more specific, the transfer belt 10 is driven, and the respective charge rollers 62 and the developing rollers 72 of the developing units 7*a*, 7*b*, 7*c*, and 7*d* that respectively contact the photoconductor drums 6*a*, 6*b*, 6*c*, and 6*d* are rotated.

In step S23, the MPU 41 determines the open/close status of the micro switches 69*a* to 69*d* and 79*a* to 79*d*.

When any one of the micro switches 69*a* to 69*d* and 79*a* to 79*d* is closed (ON), the result of step S23 is YES, and the process goes to step S4.

When none of the micro switches 69*a* to 69*d* and 79*a* to 79*d* is closed (ON), the result of step S23 is NO, and the process goes to step S24.

Specifically, immediately after replacement of the photoconductor units 60*a*, 60*b*, 60*c*, and 60*d* or the developing units 7*a*, 7*b*, 7*c*, and 7*d* by new devices, the micro switch that is in the closed state is switched into the open state (unit attached) by the drive of the photoconductor units 60*a*, 60*b*, 60*c*, and 60*d* or the developing units 7*a*, 7*b*, 7*c*, and 7*d*.

On the other hand, when the unit is not attached to the printer 101, the micro switch remains in the closed state.

As a result of driving the photoconductor units 60*a*, 60*b*, 60*c*, and 60*d* and the developing units 7*a*, 7*b*, 7*c*, and 7*d*, when any one of the micro switches 69*a* to 69*d* and 79*a* to 79*d* that are closed is switched to the open state, the result of step S23 is NO, and the process proceeds to step S24.

In this case, for example, when the micro switches 69*a* that detects the detachment of the photoconductor unit 60*a* of black (K) is switched from closed (PSd=L) to open (PSd=H), the MPU 41 clears the print number accumulating register RTn (one area on nonvolatile memory) corresponding to the photoconductor unit 60*a* of black (K). In other words, the MPU 41 initializes the black color print accumulation number to zero, and writes a "1" indicating that the unit is replaced into a unit replacement register FPC in step S24. After step S24, the process goes back to step S2.

On the other hand, when no micro switch is switched to open, the result of step S23 is YES, and the process goes to step S4.

In this case, it is regarded that there is no unit attachment, and the MPU 41 makes an operation board 105 or an operation panel inform of the abnormality as "status report 2" in step S4.

Then the flow of condition reading, abnormality check and abnormality report described in steps S2 to S4 is repeated until no abnormality is detected.

The operation display board includes a displaying unit that includes a liquid display (not shown) and an operation unit that includes a keyboard. The operation display board receives input information by a general user and sends the information to the MPU 41.

As previously described, when the condition is normal in step S3, the process goes to step S5.

In step S5, the MPU 41 starts energizing the fixing unit 12, and checks whether the fixing temperature of the fixing unit 12 is at fixable temperature.

When the fixing unit 12 is not at the fixable temperature, the MPU 41 makes the operation board indicate "standby" as a status report 1, and when the fixing unit 12 is at the fixable temperature, the MPU 41 makes the operation display board indicate "print available."

After completion of step S5, the MPU 41 determines whether the fixing temperature is equal to or greater than 60 degrees Celsius in step S6.

When the fixing temperature of the fixing unit 12 is smaller than 60 degrees Celsius, the result of step S6 is NO, and the process goes to step S7.

In step S7, the MPU 41 determines that it is in power On state of the printer 101 after a long idling period, e.g., when the printer is first turned on in the morning: the environment inside the printer 101 largely varies), and makes the operation display board indicate "execution of color misregistration adjustment" as a status report 3.

Next, in step S8, a color print accumulation number register PCn that is retained in the nonvolatile memory at that time is written into the register RCn (one area of memory) of the MPU 41. After step S8, the process proceeds to step S9.

In step S9, the internal temperature of the printer 101 at that time is written into the register RTr.

After step S9, "adjustment" is executed in step S23, and the unit replacement register FPC is cleared in step S24.

The data, which indicates the number of print sheets, stored in the print number accumulating register RTn is counted up by one when each sheet is printed, according to a predetermined rule. Then, the process proceeds to step S18, as indicated by "B" in FIGS. 10A and 10B.

The details of the "adjustment" in step S25 will be described later.

When the fixing temperature of the fixing unit 12 is equal to or greater than 60 degrees Celsius, the result of step S6 is YES, and the process proceeds to step S10.

When the fixing temperatures of the fixing unit 12 is equal to or greater than 60 degrees Celsius, the lapse time from previously turning off the printer 101 is short. In this case, it can be expected that the internal environment of the printer 101 has changed little from the time between turning off and turning on the printer 101. However, when the photoconductor unit 60 (i.e., the photoconductor units 60*a*, 60*b*, 60*c*, and 60*d*) or the developing unit 7 (i.e., the developing units 7*a*, 7*b*, 7*c*, and 7*d*) of any one of colors has been replaced, the environment inside the printer 101 has largely changed. Therefore, also when the photoconductor unit 60 or the developing unit 7 has been replaced, the "adjustment" is executed.

When the fixing temperature of the fixing unit 12 is equal to or greater than 60 degrees Celsius, the result in step S6 is YES, and the process goes to step S10.

In step S10, the MPU 41 checks whether information representing unit replacement is generated in step S24 (the unit replacement register FPC is 1).

When information indicative of unit replacement is generated (the unit replacement register FPC is 1), the result of step S10 is YES, and steps S7 through S9 are executed, and the "adjustment" in steps S25 and S26, later described, are executed. After step S26, the process proceeds to process B, where process B starts at step S20.

When the photoconductor unit 60 or the developing unit 7 has not been replaced, the result of step S10 is NO, and the process goes to step S11.

In step S11, the MPU 41 waits for an input by an operator via the operation board 105 and a command from the PC 106 connected with the printer 101, and reads the input and command. After step S11, the process goes to step S12.

In step S12, the MPU 41 determines whether instructions for "color misregistration adjustment" is sent from the operator via the operation board 105 or the PC 106.

When the instructions are received, the result of step S12 is YES, and the process goes to step S7.

Specifically, upon reception of instructions for "color misregistration adjustment" from the operator via the operation display board or the personal computer PC, the MPU 41 executes steps S7 through S9, and the "adjustment" process in steps S25 and S26. After step S26, the process proceeds to process B, where process B starts at step S20.

When the instruction is not received, the result of step S12 is NO, and the process proceeds to process C.

Process C starts at step S13. In step S13, the MPU 41 determines whether instructions to start copying or print instructions is sent or not.

When the print instructions are not received, the result of step S13 is NO, and the process goes to process D, where process D starts at step S11.

When the print instructions are received, the result of step S13 is YES, and the process goes to step S14.

Under the condition that the fixing temperature of the fixing unit 12 is at the fixable temperature, and each part of the image forming system 100 is ready, when the print instructions are given from the operation board 105 or a print start indication form the PC 106, the MPU 41 executes image formation of the specified number in step S14. After step S14, the process goes to step S15.

Every time image formation of one transfer sheet is completed and the transfer sheet is discharged, the MPU 41 increments the data of the print total number register, a color print accumulation number register PCn, and print accumulation number registers of K, Y, C, and M that are allocated in the nonvolatile memory, respectively by one, when the image formation is color image formation.

When the image formation is monochrome image formation, the data of the print total number register, monochrome print accumulation number register, and the print accumulation number register of K are respectively incremented by one.

The data of the print accumulation number registers of K, Y, C, and M are initialized or cleared to a value (i.e., "0"), indicative that a respective color of the photoconductor unit 60 or the developing unit 7 is replaced by a new device.

In step S15, the MPU 41 checks for the presence/absence of abnormality such as paper trouble every time one image is formed, while checking the presence/absence of abnormality by reading the development density, fixing temperature, internal temperature of the image forming system 100, and conditions of other parts after completion of image formation of a predetermined number. Then, in step S16, the MPU 41 checks whether the above-described conditions are normal.

When the conditions are normal, the result of step S16 is YES, and the process proceeds to step S18.

When abnormality is found, the result of step S16 is NO, and the process proceeds to step S17.

In step S17, the abnormal condition is displayed on the operation display board as a status report 2, and steps S15 to S17 are repeated until no abnormality is found.

In step S18, the MPU 41 determines whether the difference between the current internal temperature and the internal temperature at the time of previous color misregistration adjustment (the data RTr of the register RTr) is more than 5 degrees Celsius.

When the difference between the current internal temperature and the internal temperature at the time of previous color misregistration adjustment (the data RTr of the register RTr) is more than 5 degrees Celsius, the result in step S18 is YES, the MPU 41 executes steps S7 through S9 then steps S25 and S26. "Adjustment" conducted in steps S25 and S26 will be described later. After step S26, the process proceeds to process B, where process B starts at step S20.

On the other hand, when the difference between the current internal temperature and the internal temperature at the time of previous color misregistration adjustment (the data RTr of the register RTr) is not more than 5 degrees Celsius, the result in step S18 is NO, and the process goes to step S19.

In step S19, the MPU 41 determines whether the value of the color print accumulation number register PCn is greater than the value RCn of the color print accumulation number register PCn at the time of previous color misregistration adjustment (the data of the register RCn) by equal to or more than 200.

When the value of the color print accumulation number register PCn is greater than the value RCn of the color print accumulation number register PCn at the time of previous color misregistration adjustment (the data of the register RCn) by equal to or more than 200, the result in step S19 is YES, and the MPU 41 executes steps S7 through S9 then steps S25 and S26. After step S26, the process proceeds to process B, where process B starts at step S20.

On the other hand, when the value of the color print accumulation number register PCn is not greater than the value RCn of the color print accumulation number register PCn at the time of previous color misregistration adjustment (the data of the register RCn) by equal to or more than 200, the MPU 41 determines whether the fixing temperature of the fixing unit 12 is a fixable temperature.

When the fixing temperature of the fixing unit 12 is not the fixable temperature, the operation board 105 is made to display "standby" as the status report 1 in step S20, and the process proceeds to step S7 for S11 for "input reading."

When the fixing temperature of the fixing unit 12 is the fixable temperature, the operation board 105 is made to display "printable", and process A, where process A starts at step S7.

According to the control flow shown in FIGS. 11A and 11B, the MPU 41 executes the "adjustment" process (step S25) when (1) the power is turned ON at a fixing temperature of the fixing unit 12 of less than 60 degrees Celsius, (2) either of the K, Y, C, and M units (the photoconductor units 60*a*, 60*b*, 60*c*, and 60*d* or the developing units 7*a*, 7*b*, 7*c*, and 7*d*) is replaced by a new unit, (3) instructions for color misregistration adjustment are made by the operation board 105 or the PC 106, (4) a specified number of images have been printed out and the internal temperature has changed by more than 5 degrees Celsius from that at the time of previous color misregistration adjustment, or (5) the number of print sheets stored in the print number accumulating register RTn becomes equal to or greater than 200 immediately after a print job or during a serial print job. Execution of (1), (2), (4), and (5) is referred to as "automatic execution", and execution of (3) is referred to as "manual execution."

Figure 12A:
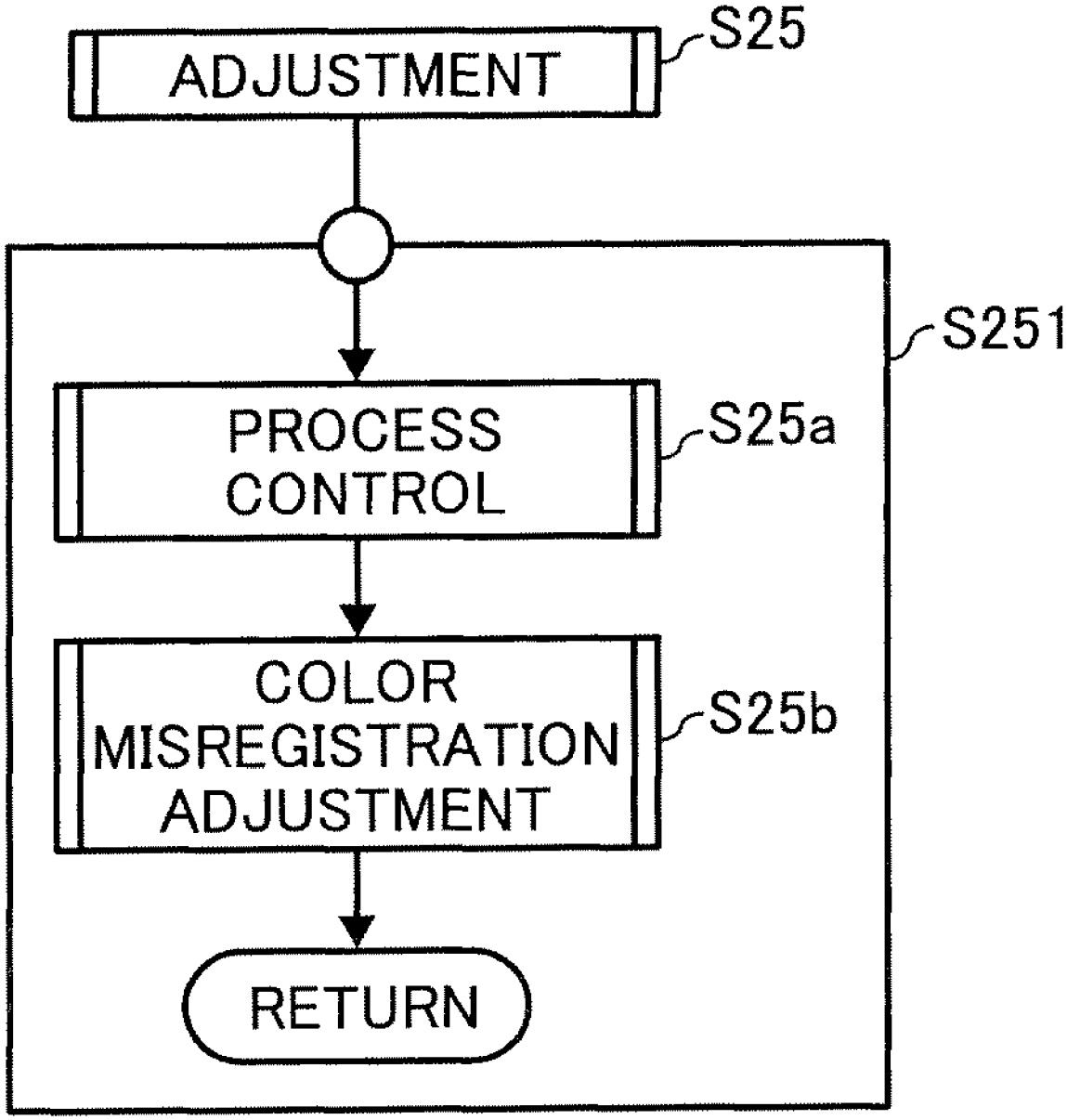
FIG. 12A is a flowchart for explaining an "adjustment"
Figure 12B:
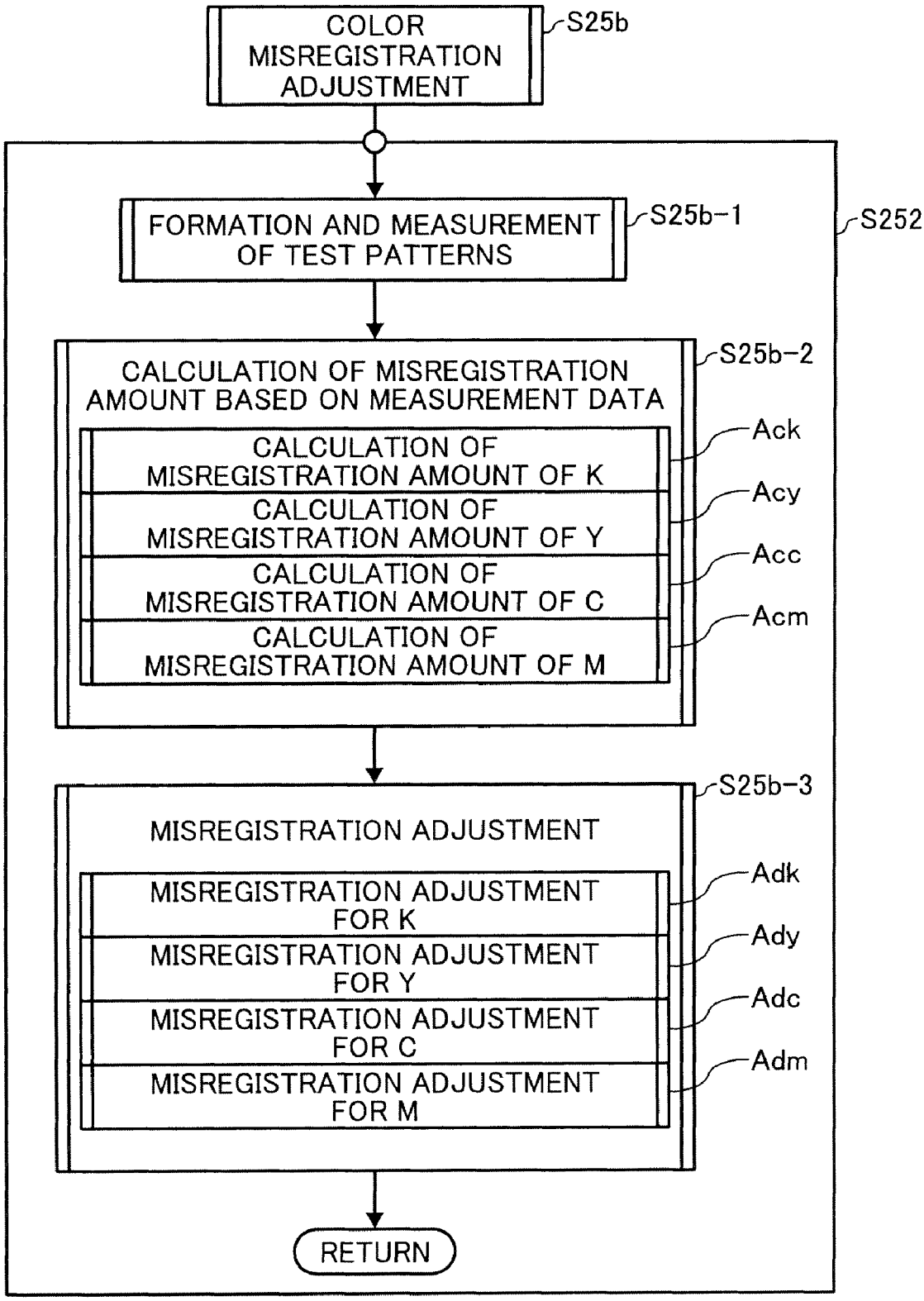
FIG. 12B is a flowchart for explaining a "color misregistration adjustment"

Referring to FIGS. 12A and 12B, flowcharts of performing the "adjustment" in the flowchart shown in FIGS. 11A and 11B are described.

FIG. 12A is a flowchart for explaining the "adjustment" process. FIG. 12B is a flowchart for explaining a "color misregistration adjustment" process.

First, the MPU 41 sets all the image forming conditions such as charging, exposure, development, and transfer at reference values in the "process control" process in step S27, forms images of K, Y, C, and M in either of the rear part "r", the center part "c", and the front part "f" on the transfer belt 10, detects image density with either of the optical sensors 20*f*, 20*c*, and 20*r*. The MPU 41 adjusts and sets the voltage applied to the charging roller 62 from the power source, exposure intensity of the optical writing unit 5, and development bias of the developing unit 7 so that the detected image density is a reference value.

After the completion of the "process control" process in step S25*a*, the MPU 41 executes the "color misregistration adjustment process" in step S25*b*, as shown in the flowcharts of FIGS. 12A and 12B. The flowchart of FIG. 12B shows the details of the operation flow of the "color misregistration adjustment."

In "formation and measurement of test patterns" in step S25*b*-1, the MPU 41 causes a test pattern signal generator (not shown) to supply the optical writing unit 5 with a pattern signal in the image formation conditions (parameters) set in the "process control" (step S25*a*), and forms the start marks Msr, Msc, and Msf and eight sets of mark set group as shown in FIG. 7 as toner images in each of the rear end part "r", the center part "c", and the front end part "f" of the transfer belt 10.

These marks are detected by the optical sensors 20*r*, 20*c*, and 20*f* and the resultant mark detection signals Sdr, Sdc, and Sdf are read in after being converted to digital data, i.e., mark detection data Ddr, Ddc, and Ddf by the A/D converters 36*r*, 36*c*, and 36*f*.

From these mark detection data Ddr, Ddc, and Ddf, the MPU 41 calculates position (distribution) of the middle points of each mark of the test patterns on the transfer belt 10.

The MPU 41 further calculates an average pattern (average value group of mark position) of the rear mark set group (eight sets of mark sets), an average pattern (average value group of mark position) of the center mark set group (eight sets of mark sets), and an average pattern (average value group of mark position) of the front mark set group (eight sets of mark sets). The details of the "formation and measurement of test patterns" performed in step S25*b*-1 will be described later.

After calculation of the average patterns, the MPU 41 calculates the misregistration amount in the photoconductor unit 60 by each of the average patterns K, Y, C, and M based on the average patterns in step S25*b*-2. Next, in step S25*b*-3, the MPU 41 performs the adjustment so that the misregistration in image formation is removed based on the calculated misregistration amounts.

Figure 13:
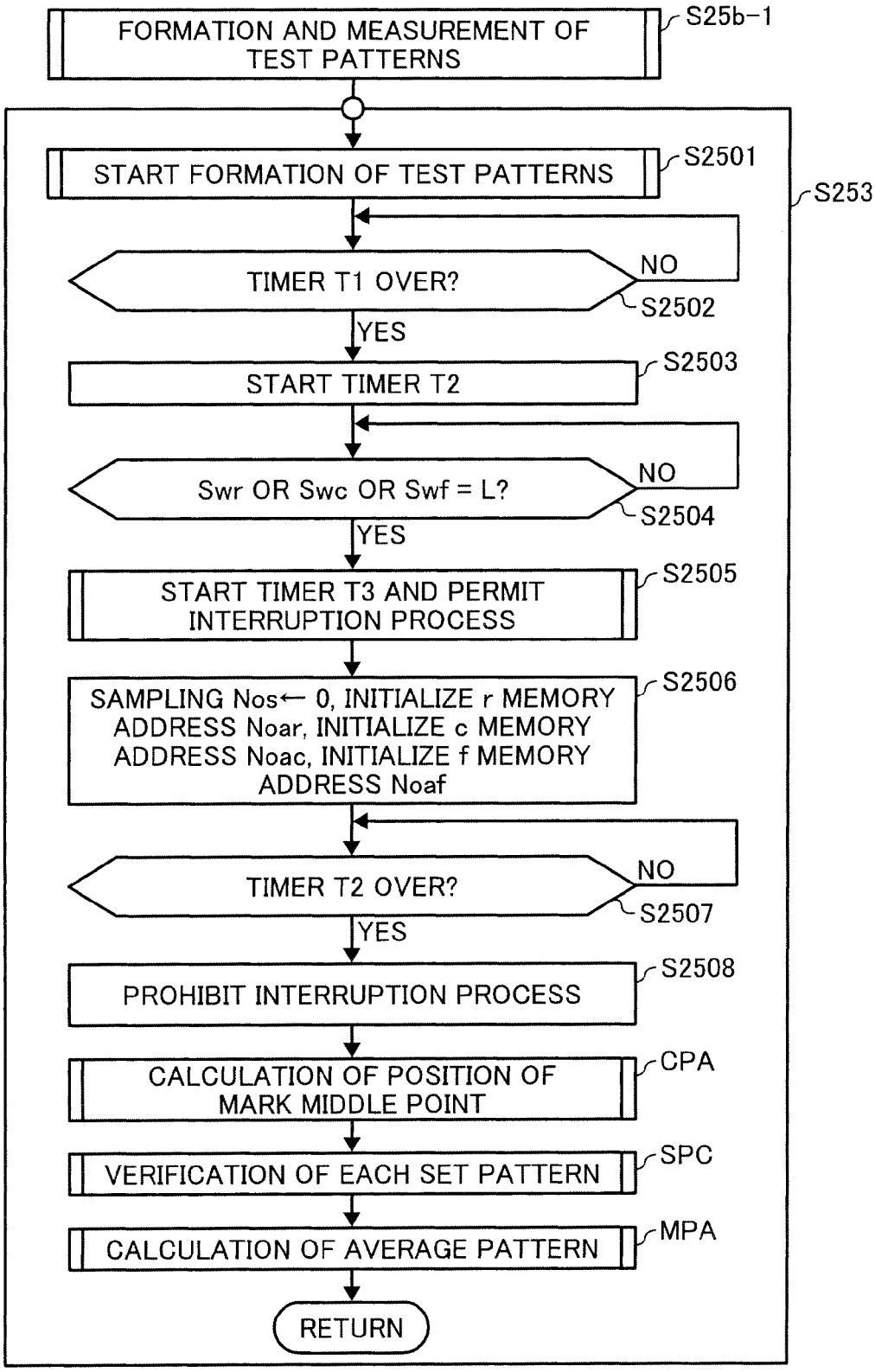
FIG. 13 is a flowchart for explaining a formation and a measurement of the mark pattern.

Referring to FIG. 13, a flowchart showing operations of formation and measurement of the mark pattern is described.

First, while the transfer belt 10 is rotating constantly at a constant speed, the MPU 41 simultaneously forms, on the surfaces of the rear end part "r", the center part "c", and the front end part "f" of the transfer belt 10, the start marks Msr, Msc, and Msf and eight sets of mark sets having a width "w" of the direction "y", a length "A" of the direction "x", a pitch "d", and a clearance "cc" between mark sets. In one embodiment, the transfer belt is rotating at 125 mm/sec, the width "w" is 1 mm, the length "A" is 20 mm, the pitch "d" is 3.5 mm, and the clearance is 9 mm.

To count the timing immediately before the start marks Msr, Msc, and Msf reach under the optical sensors 20*r*, 20*c*, and 20*f*, the MPU 41 starts a timer T1 having a time limit value of Tw1 in step S2501, and wait for the time Tw1 to elapse in step S2502.

Upon the elapse of time Tw1 of the timer T1, the MPU 41 starts a timer T2 having a time limit value of Tw2 to measure the timing at which the last marks in the mark set groups in the rear end part "r", the center part "c", and the front end part "f" of the transfer belt 10 finish passing through the optical sensors 20*r*, 20*c*, and 20*f* in step S2503.

FIG. 13 is a view for explaining a relation between the mark pattern and level variations of the detection signals Sdr, Sdc, and Sdf.

As described above, when there is no mark of K, Y, C, or M in the fields of the optical sensors 20*r*, 20*c*, and 20*f*, the detection signals Sdr, Sdc, and Sdf from the optical sensors 20*r*, 20*c*, and 20*f* are 5V. When there is a mark in the fields of the optical sensors 20*r*, 20*c*, and 20*f*, the detection signals Sdr, Sdc, and Sdf from the optical sensors 20*r*, 20*c*, and 20*f* are 0V.

Figure 14:
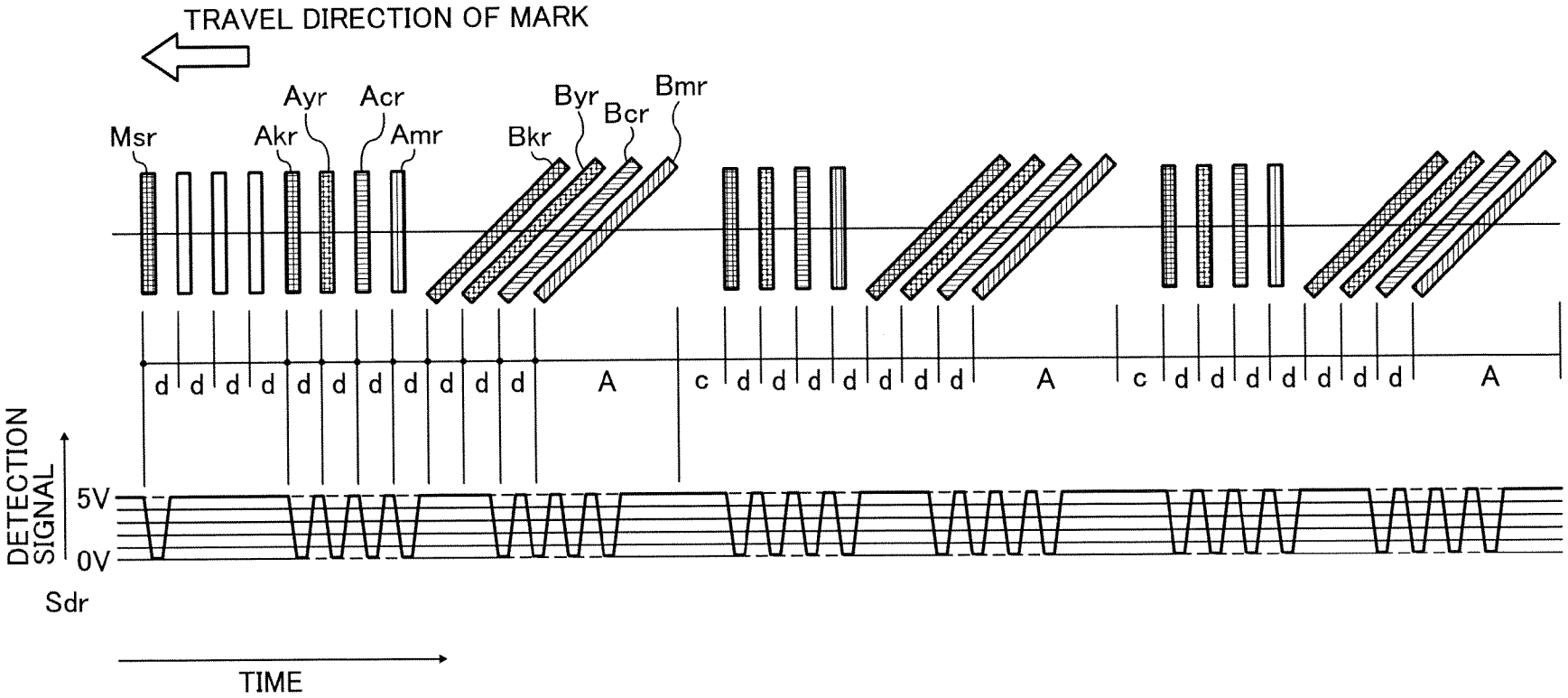
FIG. 14 is a view for explaining a relation between the mark pattern and level variations of detection signals Sdr, Sdc, and Sdf.

Accordingly, the constant velocity movement of the transfer belt 10 results in the level variations in the detection signals Sdr, Sdc, and Sdf as shown in FIG. 14. The enlarged view in FIG. 10A shows a part of such level variation.

As shown in the flowchart of FIG. 14, in the course that the start marks Msr, Msc, and Msf arrive at the fields of the optical sensors 20*r*, 20*c*, and 20*f* and the detection signals Sdr, Sdc, and Sdf vary from 5V to 0V, the MPU 41 waits until the level determination signals Swr, Swc, and Swf, output from the window comparators 39*r*, 39*c*, and 39*f* of FIG. 9, changes from the H determination signal to the L determination signal indicating that the detection signals Sdr, Sdc, and Sdf are in a range of approximately 2V to approximately 3V.

As shown in FIG. 10B, since the L determination signal corresponds to the edge area of the mark, the "L" of the level determination signals Swr, Swc, and Swf means that at least one of the edges of the mark has arrived at the field of the optical sensors 20*r*, 20*c*, and 20*f*. In other words, in step S2504, the MPU 41 monitors whether the leading end of the start marks Msr, Msc.

When at least one of the edges of the start marks Msr, Msc, and Msf has arrived at the field of the optical sensors 20*r*, 20*c*, and 20*f*, the MPU 41 starts a timer T3 having a short time limit value Tsp (e.g., 50 microseconds) in step S2505. The shorter the time limit value Tsp becomes, the more accurately the position of the middle point of a mark can be calculated. However, the contradictions of the data stored in memory increases.

On the contrary, the longer the time limit value Tsp becomes, the smaller the amount of data is stored in memory. However, the position of the middle point of the mark cannot be calculated accurately.

Therefore, the time-limit value Tsp is determined in consideration of the memory capacity and accuracy of the position of middle point of mark.

In step S2305 on the flowchart of FIG. 12, the MPU 41 permits to execute the "interruption process", which may be represented by "TIP."

Figure 15:
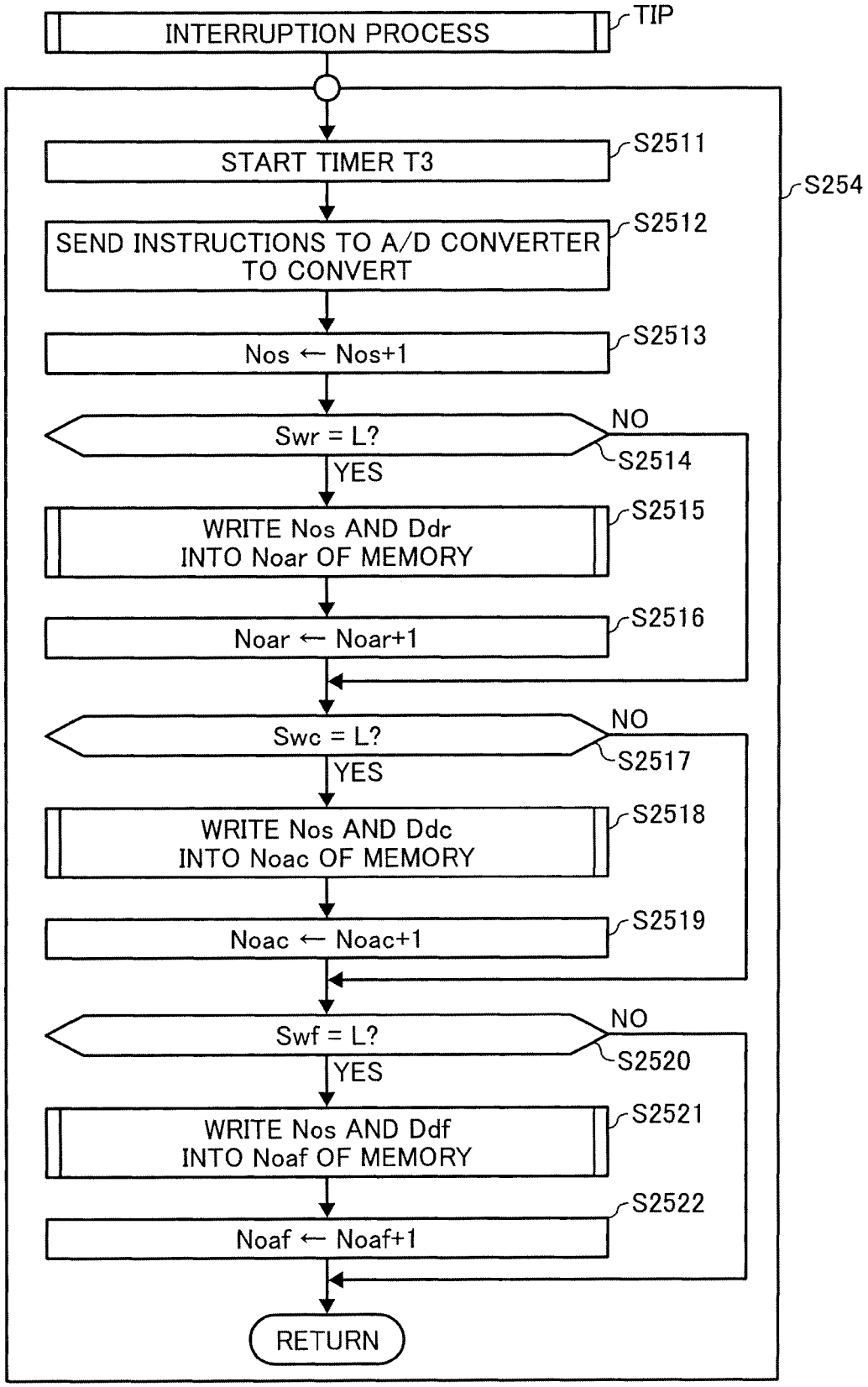
FIG. 15 is a flowchart for explaining an interruption process (TIP)

When the timer T3 reached the time limit (e.g., the time limit value Tsp has lapsed), the MPU 41 permits the execution of the "interruption process" (TIP) in step S2505 as shown in FIG. 15. Next, the MPU 41 initializes sampling number value Nos of the sampling number register Nos to zero. In addition, in step S2506, a writing address Noar of an "r" memory (a data storage area of rear mark reading data), a writing address Noac of a "c" memory (a data storage area of center mark reading data), and a writing address Noaf of an "f" memory (a data storage area of front mark reading data) that are allocated to the FIFO memory of the MPU 41 are initialized to the start addresses.

Next, in step S2507, the MPU 41 determines whether the timer T2 has reached the time line Tw2. Specifically, the MPU 41 waits until all of the eight sets of test pattern finish passing through the fields of the optical sensors 20*r* and 20*f*.

Now, referring to FIG. 15, the detailed description of the "interruption process" will be provided. FIG. 15 shows a flowchart of the operations for the "interruption process (TIP)".

In one exemplary embodiment, "interruption process" (TIP) is executed every time the timer T3 reaches the time limit Tsp.

In step S2511, the MPU 41 first starts the timer T3, and the process goes to step S2512. In step S2512, the MPU 41 instructs the A/D converters 36*r*, 36*c*, and 36*f* to conduct A/D conversion. For example, the voltages of the detection signals Sdr, Sdc, and Sdf from the amplifiers 35*r*, 35*c*, and 35*f* at that time are held and converted into digital data, and retained in the data latch.

In step S2513, the MPU 41 increments the sampling number value Nos of the sampling number register Nos, which is A/D conversion instruction number, by one.

As a result, the sampling number value Nos×the time limit value Tsp represents the lapse time from the time of detection of the leading edge of either one of the start marks Msr, Msc, and Msf, which is equal to the current position of the transfer belt 10 opposing the optical sensors 20*r*, 20*c*, and 20*f* in the sub-scanning direction, or the belt travel direction based on either one of the start marks Msr, Msc, and Msf.

In step S2514, the MPU 41 determines whether the detection signal Swr from the window comparator 39*r* is L (the optical sensor 20*r* is detecting an edge part of the mark, and 2V≦Sdr≦3V). When the detection signal Swr from the window comparator 39*r* is L, the result of S2514 is YES, and the process goes to step S2515.

In step S2515, the sampling number value Nos of the sampling number register Nos and the A/D conversion data Ddr stored in the data latch (the digital value of the mark detection signal Sdr of the optical sensor 20*r*) are written as writing data into the address Noar of the "r" memory. Then, the process proceeds to step S2516.

In step S2516, the writing address of the "r" memory Noar is incremented by one, and the process goes to step S2517.

When the detection signal Swr from the window comparator 39*r* is not L, the result of S2514 is NO, and the process goes to step S2517.

Specifically, when the detection signal Swr from the window comparator 39*r* is H (Sdr<2V or 3V<Sdr), the MPU 41 does not write the A/D conversion data Ddr retained in the data latch into the "r" memory. This step helps reduction of the amount of data written to memory and simplification of subsequent data processing.

Next, as described above, the MPU 41 checks whether the detection signal Swc from the window comparator 39*c* is L (the optical sensor 20*c* is detecting an edge part of the mark, and 2V≦Sdc≦3V) in step S2517. When the detection signal Swc from the window comparator 39*c* is not L, the result of step S2517 is NO, and the process goes to step S2520, which will be described later. When the detection signal Swc from the window comparator 39*c* is L, the result of step S2517 is YES, and the process goes to step S2518.

In step S2518, the MPU 41 writes the sampling number value Nos of the sampling number register Nos and the A/D conversion data Ddc (the digital value of the mark detection signals Sdc of the optical sensor 20*c*) as writing data into the address Noac of the "c" memory. After step S2518 is completed, the process goes to step S2519.

In step S2519, the MPU 41 increments the writing address Noac of the "c" memory by one, and the process goes to step S2520.

Next, in step S2520, the MPU 41 checks whether the detection signal Swf from the window comparator 39*f* is L (the optical sensor 20*f* is detecting the edge part of the mark, and 2V≦Sdc≦3V). When the detection signal Swf from the window comparator 39*f* is not L, the result of step S2520 is NO, and the process returns to step S2511 to repeat the procedure.

When the detection signal Swf from the window comparator 39*f* is L, the result of step S2520 is YES, and the process goes to step S2521.

In step S2521, the MPU 41 writes the sampling number value Nos of the sampling number register Nos and the A/D conversion data Ddf (the digital value of the mark detection signals Sdf of the optical sensor 20*f*) as writing data into the address Noaf of the "f" memory. After step S2521, the process goes to step S2522.

In step S2522, the MPU 41 increments the writing address Noaf of the "f" memory by one, and the process returns to step S2311 to repeat the procedure.

Since such interruption process is repeatedly executed at a cycle of the time Tsp, when the mark detection signals Sdr, Sdc, and Sdf of the optical sensors 20*r*, 20*c*, and 20*f* vary up and down as shown in FIG. 10A, only digital data Ddr, Ddc, and Ddf of the detection signals Sdr, Sdc, and Sdf ranging between 2V and 3V shown in FIG. 10B is stored together with the sampling number value Nos in the "r" memory and the "f" memory that are allocated to the FIFO memory within the MPU 41.

From the sampling number value Nos stored in each memory (the "r", "c", and "f" memories), the position in the direction "y", the direction in which the transfer belt 10 travels in, of each mark from the start mark can be described as follows: the time Tsp×the sampling number value Nos×the conveyance velocity of the transfer belt 10.

Referring back to FIG. 13, the operation of the formation and measurement of the mark pattern is further described. After the last mark of a mark set group (the last mark of the eighth set of mark sets) has passed the optical sensors 20*r*, 20*c*, and 20*f*, the timer T2 is over.

As shown in the flow of FIG. 13, when the timer T2 is over, the result of step S2507 is YES, and the process goes to step S2508. The interruption process is prohibited in step S2508, and the process goes to step or operation CPA.

In step CPA, the MPU 41 calculates position of a middle point of each mark based on the detection data Ddr, Ddc, and Ddf of the "r" memory, the "c" memory, and the "f" memory in the FIFO memory.

The position of the middle point of a mark may be evaluated in the following manner. As data to be written into the writing addresses Noar, Noac, and Noaf of the "r" memory, the "c" memory, and the "f" memory, respectively, plural sets of data ranging from 2V to 3V are respectively stored that correspond to the falling region where the level of the mark detection signal falls and that correspond to the subsequent rising region where the level rises. FIG. 10B shows the details of the data to be written into the writing addresses Noar, Noac, and Noaf of the "r" memory, the "c" memory, and the "f" memory, respectively.

From the sets of data corresponding to the first falling region of the K mark, a middle position "a" is calculated, and from the sets of data corresponding to the rising region of the K mark, a middle position "b" is calculated. Next, from the middle position "a" and the middle position "b", a middle point of the K mark (the middle point Akrp) is calculated. Likewise, a middle position "c" of the falling region of the next mark, which is the Y mark, and a middle position "d" of the subsequent rising region are calculated from the sets of data corresponding to the respective regions, and then a middle point (the middle point Akrp) of the Y mark is calculated. The above-described processes are executed for each mark.

Figure 16:
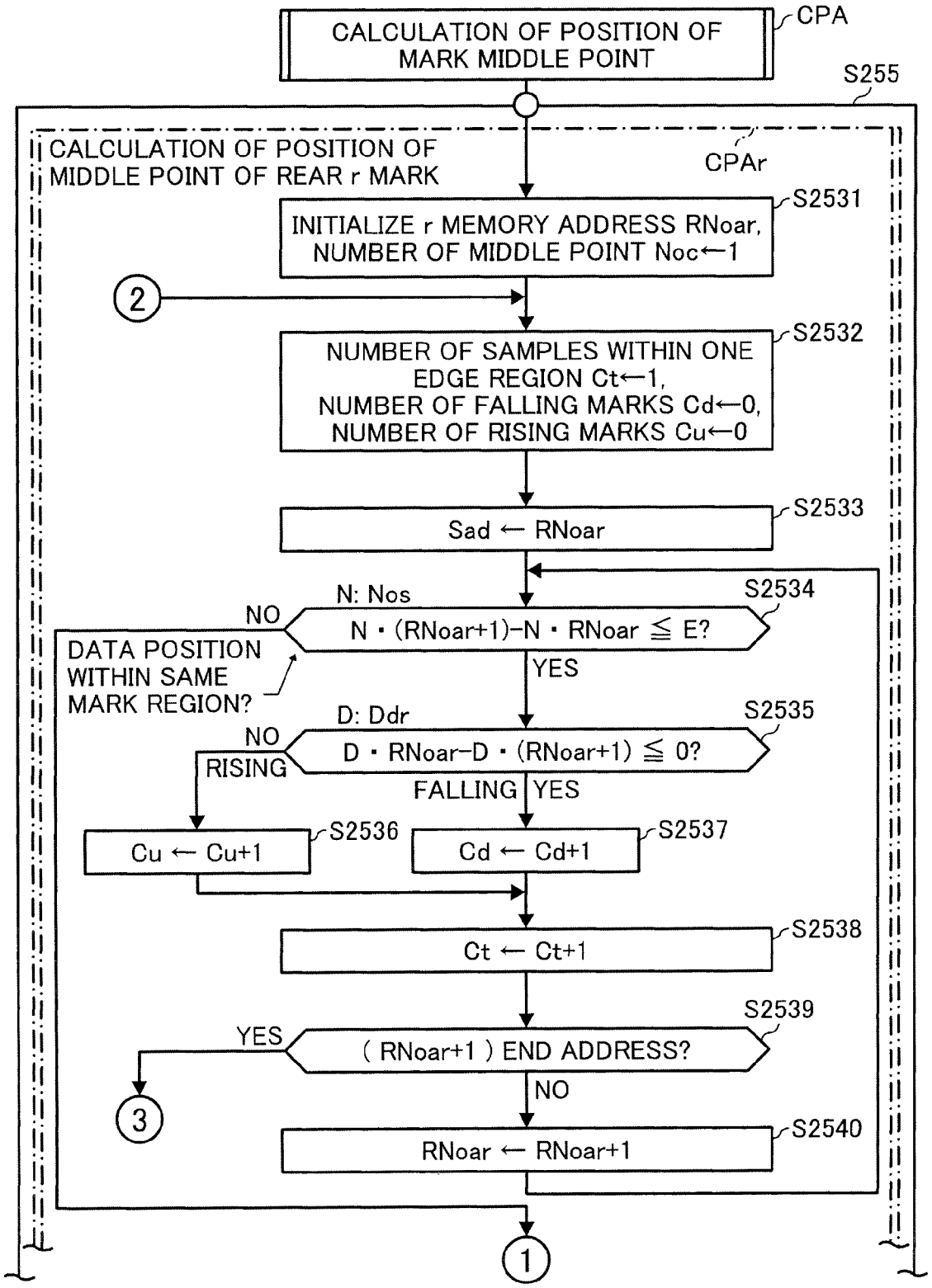
FIG. 16 is a flowchart for explaining one part of a "calculation of mark middle point position (CPA)"
Figure 17:
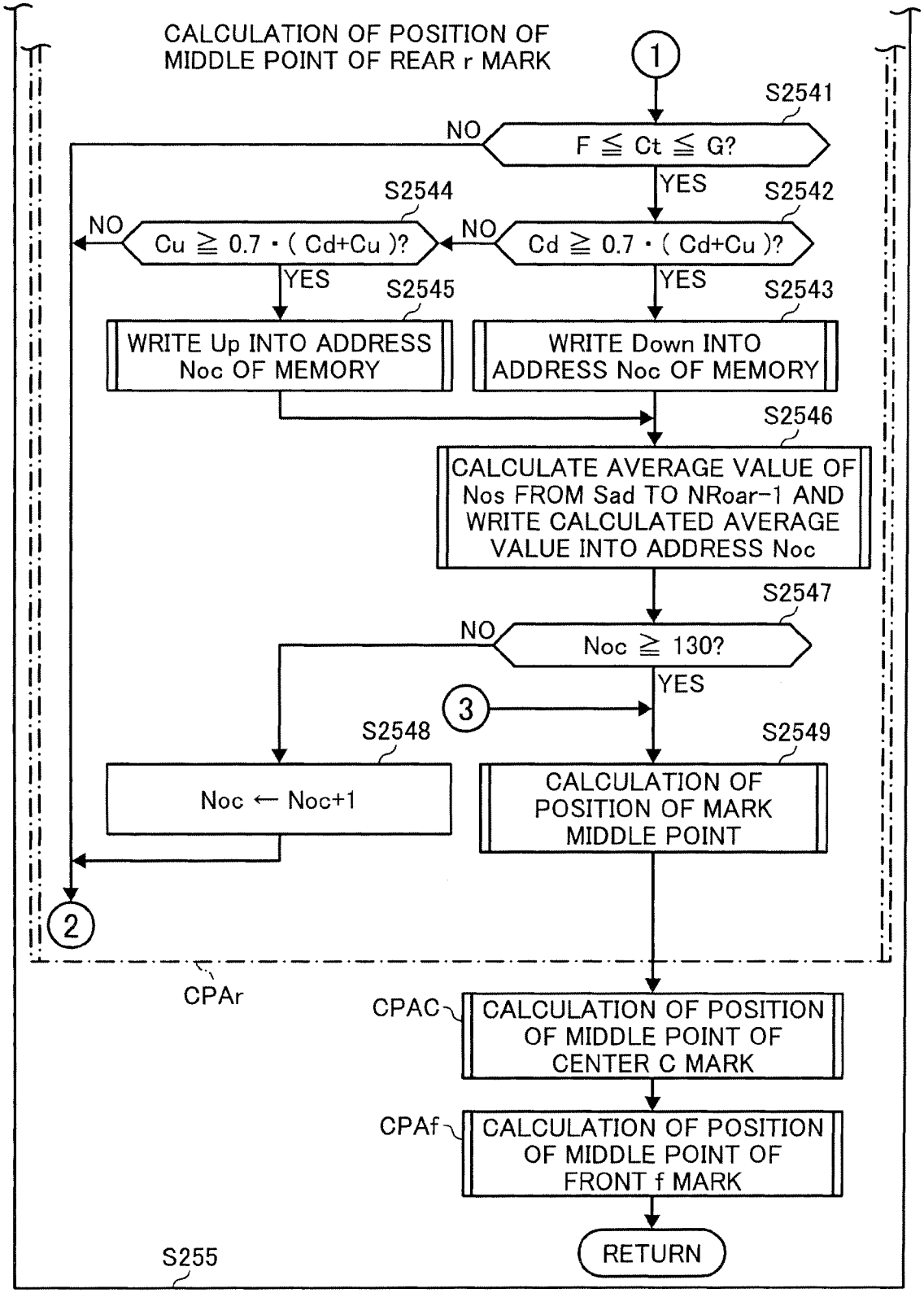
FIG. 17 is a flowchart for explaining another part of the "calculation of mark middle point position (CPA)"

Referring to FIGS. 16 and 17, a flowchart showing operations of the "calculation of position of mark middle point" (CPA) is described. FIG. 16 is a flowchart for explaining one part of a "calculation of position of mark middle point" (CPA), and FIG. 17 is the following part of the flowchart of FIG. 16.

In step CPA, a "calculation of position of middle point of mark in the rear end part 'r' (CPAr)", a "calculation of position of middle point of mark in the center part 'c' (CPAc)", and a "calculation of position of middle point of mark in the front end part 'f' (CPAf)" are executed.

In the "calculation of position of middle point of mark in rear end part 'r' (CPAr)", the MPU 41 first initializes the reading address RNoar of the "r" memory allocated to the FIFO memory therein, and initializes the data of an edge middle point number register Noc at "1" that is indicative of the first edge, in step S2531. This edge middle point under a register Noc corresponds to "a", "b", "c", and "d" as shown in FIG. 10B. After step S2531, the process goes to step S2532.

In step S2532, the MPU 41 initializes data Ct of the sample number register within one edge region Ct at "1", and initializes data Cd and Cu of the falling number register Cd and the rising number register Cu at "0". After step S2532, the process goes to step S2533. In step S2533, the MPU 41 writes a reading address RNoar into an edge region data group leading address register Sad. The leading address registers are for the preparatory process for data processing of first edge region.

Next, the MPU 41 reads data from an address RNoar of the "r" memory. The data includes the position Nos in the direction "y": N·RNoar, detection level Ddr: D·RNoar. The position Nos in the direction "y", which is "N·RNoar", is obtained by multiplying the time Tsp by the sampling number value Nos and by the conveyance velocity of the transfer belt 10.

The MPU 41 also reads out data from the subsequent address RNoar+1. The data includes the position Nos in the direction "y": N·(RNoar+1), a detection level Ddr: D·(RNoar+1).

Next, in step S2534, the MPU 41 checks whether the difference of the directions "y" of both read data (N·(RNoar+1)−N·RNoar) is equal to or less than "E". For example, E=w/2=value corresponding to ½ mm on the same edge region. When the difference of position in the direction "y" of both read data (N·(RNoar+1)−N·RNoar) is greater than E, the result of step S2534 is NO, and the process proceeds to process 1 starting at step S2541, which will be described later.

When the difference of position in the direction "y" of both read data (N·(RNoar+1)−N·RNoar) is equal to or smaller than E, the result of step S2534 is YES, and the process proceeds to step S2535.

In step S2535, the MPU 41 checks whether the difference in detection level between these read data (D·RNoar−D·(RNoar+1)) is equal to or greater than zero. When the difference in the detection level between these data is equal to or greater than zero, the result of step S2535 is YES, and the process goes to step S2537.

In step S2537, the MPU 41 represents the falling trend, so that the data Cd of the falling number register Cd is incremented by one. The process then proceeds to step S2538.

On the other hand, when the difference in the detection level between these data is smaller than zero, the result of step S2535 is NO, and the process proceeds to step S2536. In step S2536, the MPU 41 represents the rising trend, so that data Cu of the rising number register Cu is incremented by one, and the process proceeds to step S2538.

In step S2538, the MPU 41 increments the data Ct of the sample number register within one edge Ct by one. After step S2538, the MPU 41 checks whether the memory reading address RNoar of the "r" memory is an end address of the "r" memory in S2539.

When the reading address RNoar of the "r" memory reading address is an end address of the "r" memory, the result of step S2539 is YES, and the process goes to step S2549. When the reading address RNoar of the "r" memory reading address is not an end address of the "r" memory, the result of step s2539 is NO, and the process goes to step S2540. In step S2540, the memory reading address RNoar is incremented by one, and the processes (steps S2534 to S2540) are repeated.

On the other hand, as previously described, when the read data of the first edge region changes to the read data of the next edge region, the difference of position in the direction "y" of both read data (N·(RNoar+1)−N·RNoar) is greater than E in step S2534, the result of step S2534 is NO, and the process proceeds to process 1 starting at step S2541 in FIG. 17.

By proceeding to step S2341, it is determined that the MPU 41 has completed the checking of every sampling data of one mark edge (the leading edge or the trailing edge) region for falling and rising trends.

Next, in step S2541, the MPU 41 checks whether the sample number data Ct of the sample number register Ct within a single edge at this time is a corresponding value within a single edge region (ranging from 2V to 3V). In other words, the MPU 41 checks whether the relationship of $F \leqq Ct \leqq G$ is satisfied.

In step S2541, the symbol "F" represents a lower limit value of data written into the "r" memory when the leading edge or trailing edge of a properly formed mark is detected, and the symbol "G" represents an upper limit (set value) value of data written into the "r" memory when the leading edge or trailing edge of a properly formed mark is detected.

When the sample number data Ct satisfies the relationship of $F \leqq Ct \leqq G$, the result of step S2541 is YES, and it is regarded that data reading and storing are properly conducted, and the process goes to step S2342.

In step S2542, the MPU 41 checks whether the first edge is in a falling trend. More specifically, when the data Cd of the falling number register Cd is equal to or greater than 70% of the sum of the data Cd of the falling number register Cd and the data Cu of the rising number register Cu ($Cd \geqq 0.7\ (Cd+Cu)$), the result of step S2542 is YES, and the process goes to step S2543.

In step S2543, the MPU 41 writes information "DOWN" representing falling into the address to the edge No. of memory Noc. The process then proceeds to step S2546. On the other hand, when the data Cd of the falling number register Cd is smaller than 70% of the sum of the data Cd of the falling number register Cd and the data Cu of the rising number register Cu (Cd≧0.7 (Cd+Cu)), the result of step S2542 is NO, and the process goes to step S2544.

In step S2544, the MPU 41 checks whether the first edge is in a rising trend. Specifically, when the data Cu of the rising number register Cu is equal to or greater than 70% of Cd+Cu of the rising number register Cu (Cu≧0.7 (Cd+Cu)), the result of step S2544 is YES, and the process goes to step S2545.

In step S2545, the MPU 41 writes information "UP" that is indicative of the rising trend into the address to the edge No. of memory Noc. Then, the process goes to step S2546.

On the other hand, when the data Cu of the rising number register Cu is smaller than 70% of Cd+Cu of the rising number register Cu (Cu≧0.7 (Cd+Cu)), the result of step S2544 is NO, and the process goes to process 2 starting at step S2532.

Next, in step S2546, the MPU 41 calculates an average value of the "y" position data of the first edge region, i.e., the middle point position of the edge region ("a" in FIG. 8B), and writes the average value into the address to the edge No. of memory Noc. After step S2346, the process goes to step S2347.

In step S2547, the MPU 41 checks whether the edge No. Nos is equal to or greater than 130. Namely, the MPU 41 checks whether the calculation of middle position of every mark in the leading edge region and the trailing edge region in the start mark Msr and eight sets of mark sets have been completed.

When the edge No. Nos is greater than 130, the result of step S2347 is NO, and the process goes to step S2348. Specifically, when the result of step S2347 is NO, the data of the edge middle point number register Noc is incremented by one representing the second edge (the trailing end of the mark Akr of K), changing from 1 representing the first edge (the leading edge of the mark Akr of K).

As to the second edge, the process of steps S2532 to S2546 is executed, and information that is indicative of the rising or falling and middle point position of the edge region ("b" in FIG. 9B) are written into the address to the edge No. of memory Noc.

The above-described process is repeated up to the edge region of the trailing end of the last mark (Bmr) of the eight sets of mark sets.

When the edge No. Nos is equal to or smaller than 130, the result of step S2547 is YES, and the process goes to step S2549. Thus, the result of step S2547 is YES upon completion of calculation of the middle position of each mark in the leading edge region and the trailing edge region for every start mark Msr and eight sets of mark sets. In addition, when the result of or the "r" memory reading address RNoar is an "r" end address, namely when reading of stored data from the "r" memory has completed, which is YES in step S2539, a mark middle point position is calculated based on the edge middle point position data (the "y" position data calculated in step S2546).

For calculating a mark middle point position, the address data addressing to the edge No. of memory Noc (falling/rising data and position data of edge middle point) is read out. Then, the MPU 41 determines whether the positional difference between the middle point position of the previous falling edge region and the middle point position of the rising edge region following the falling edge region falls within the range corresponding to the width "w" in the "y" direction of the mark.

When the positional difference between the middle point position of the previous falling edge region and the middle point position of the rising edge region following the falling edge region does not fall within the range corresponding to the width "w" in the "y" direction of the mark, these data are deleted.

When the positional difference between the middle point position of the previous falling edge region and the middle point position of the rising edge region following at the falling edge region falls within the range corresponding to the width "w" in the "y" direction of the mark, an average value of these data is determined, and written to the mark No. from the leading end in the memory as a middle point position of one mark.

When all of the mark formation, mark detection, and detection data processing are properly executed, the middle point position data for a total of 65 marks including the start mark Msr and eight sets of mark sets (8 marks/set×8=64 marks) is obtained in regard to the rear end part "r", and stored in the memory.

Next, the MPU 41 executes the "calculation of mark middle point position of center 'c' (CPAc)" in the same manner as described in the "calculation of mark middle point position of rear 'r' (CPAr)", and the measurement data in the memory is processed.

When all of the mark formation, mark measurement, and measurement data processing are properly executed, the middle point position data for a total of 65 marks including the start mark Msc and eight sets of mark sets (8 marks/set×8=64 marks) is obtained in regard to the center part "c", and stored in the memory.

Next, the MPU 41 executes the "calculation of mark middle point position of front 'f' (CPAf)" in the same manner as described in the "calculation of mark middle point position of rear 'r' (CPAr)", and the measurement data on the memory is processed.

When all the mark formation, mark measurement, and measurement data processing are properly executed, the middle point position data for a total of 65 marks including the start mark Msf and eight sets of mark sets (8 marks/set×8=64 marks) is obtained in regard to the front end part "f", and stored in the memory.

Upon completion of calculation of middle point position of mark in the manner as described above, the MPU 41 executes a "verification of each set pattern" in step SPC in the flowchart of FIG. 13.

By the "verification of each set pattern" in step SPC, the MPU 41 verifies whether the data group of the middle point position of mark written into the memory has a center point distribution corresponding to the mark distribution shown in FIG. 7.

Specifically, the MPU 41 deletes from the mark middle point position data group written into the memory, the data that is out of the mark distribution shown in FIG. 7 in set units. As a result, only the data sets (the position data group including eight pieces of data per one set) that show the distribution pattern corresponding to the mark distribution shown in FIG. 7 are left.

When all the data is proper, eight sets of data in the rear end part "r", eight sets of data in the center part "c", and eight sets of data in the front end part "f" are left in the group of mark middle point position data written in the memory.

Next, the MPU 41 changes the middle point position data of the first mark (Akr) of each set that follows the second set, into the middle point position of the first mark (Akr) of the leading set (the first set) in the rear data set, and changes the middle point position data of the second to the eighth marks by the differential values corresponding to the changes. That is, the MPU 41 makes changes on the middle point position data group of each set that follows the second set in such a manner that the values are shifted in the "y" direction so that the middle point position of the leading mark of the first set.

The MPU 41 also changes the middle point position data in each set that follows the second set in the center part "c" and the front end part "f" in the same way as the rear end part "r".

After the "verification of each set pattern" (step SPC) has been completed, the MPU 41 executes a "calculation of average pattern" in step MPA in the flowchart of FIG. 13.

Figure 18:
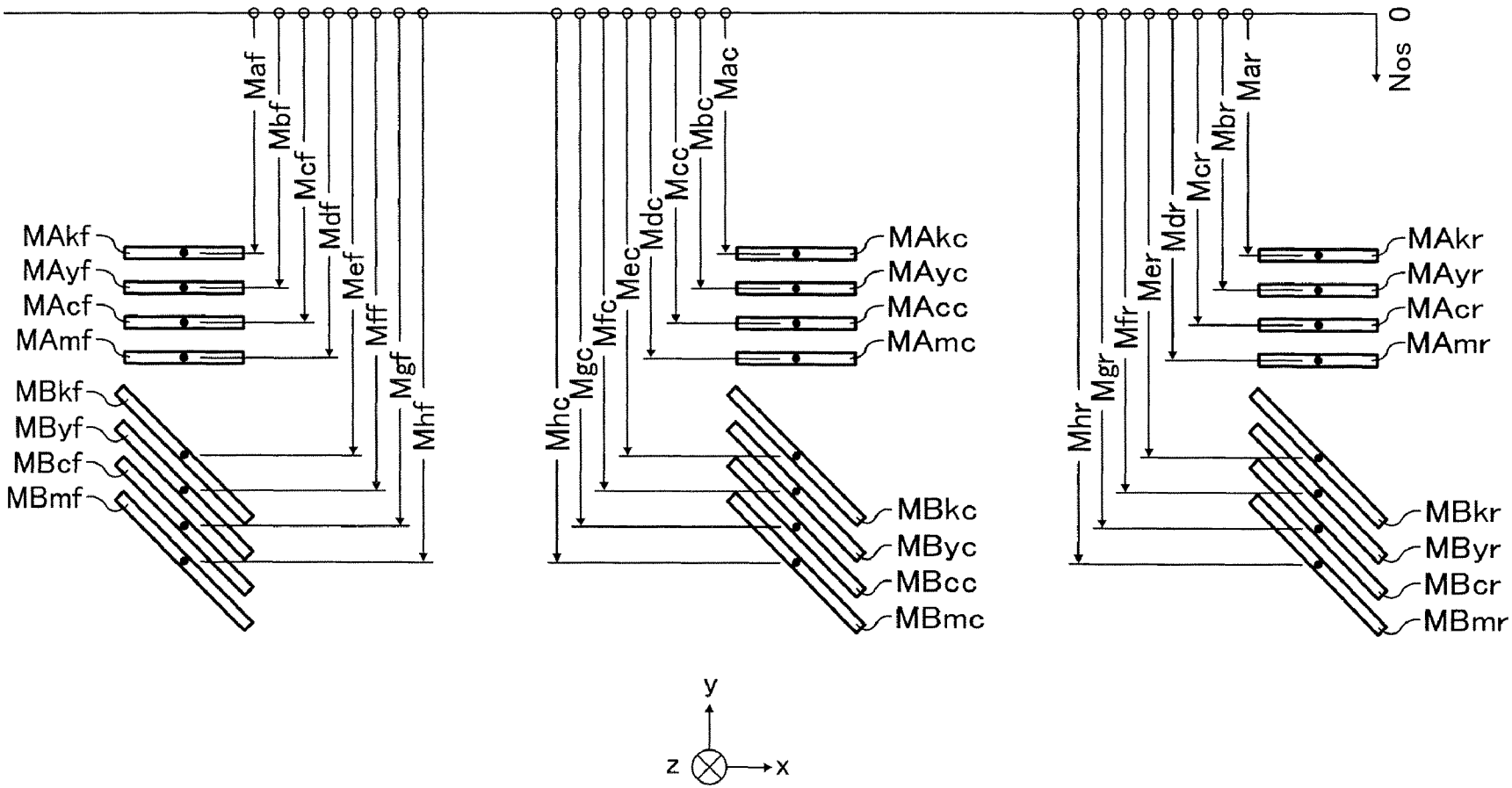
FIG. 18 is a view for explaining an assumed average position mark.

Referring to FIG. 18, a view of assumed average position marks is described for operations of the "calculation of average pattern" in step MPA.

In step MPA, the MPU 41 calculates average values, Mar to Mhr, of the middle point position data of each mark for each set in the rear end part "r" of the transfer belt 10. In a similar manner, the MPU 41 calculates average values, Mac to Mhc, of the middle point position data of each mark for each set in the center part "c", and average values, Maf to Mhf, of the middle point position data of each mark for each set in the front end part "f".

These average values represent middle point positions of hypothetical average position marks that distribute as shown in FIG. 18:

MAkr (representative of the rear perpendicular mark of K);
MAyr (representative of the rear perpendicular mark of Y);
MAcr (representative of the rear perpendicular mark of C);
MAmr (representative of the rear perpendicular mark of M);
MBkr (representative of the rear diagonal mark of K);
MByr (representative of the rear diagonal mark of Y);
MBcr (representative of the rear diagonal mark of C);
MBmr (representative of the rear diagonal mark of M);
MAkc (representative of the center perpendicular mark of K);
MAyc (representative of the center perpendicular mark of Y);
MAcc (representative of the center perpendicular mark of C);
MAmc (representative of the center perpendicular mark of M);
MBkc (representative of the center diagonal mark of K);
MByc (representative of the center diagonal mark of Y);
MBcc (representative of the center diagonal mark of C);
MBmc (representative of the center diagonal mark of M);
MAkf (representative of the front perpendicular mark of K);
MAyf (representative of the front perpendicular mark of Y);
MAcf (representative of the front perpendicular mark of C);
MAmf (representative of the front perpendicular mark of M);
MBkf (representative of the front diagonal mark of K);
MByf (representative of the front diagonal mark of Y);
MBcf (representative of the front diagonal mark of C); and
MBmf (representative of the front diagonal mark of M).

After completion of step MPA for "calculation of average pattern", the process described in the flowchart of FIG. 13 completes.

Upon completion of the "formation and measurement of test patterns" (step S25*b*-1) as described above, the MPU 41 executes a "calculation of deviation amount based on measurement data" (step S25*b*-2) as shown in FIG. 12B, and calculates an amount of color misregistration.

In the printer 101, the MPU 41 calculates color misregistration of colors Y, M, and C relative to reference color K. Based on the amounts of color misregistration of colors Y, M, and C relative to the reference color K obtained in step S25*b*-2, the MPU 41 conducts image deviation adjustment for colors K, Y, M, and C in step S25*b*-3.

Next, a further description is given of a calculation of color misregistration of Y is described.

First, the MPU 41 determines distance dyyr between the rear perpendicular mark MAkr of reference color K and the rear perpendicular mark MAyr of color Y based on the difference in middle point position between the rear perpendicular mark MAkr of K and the rear perpendicular mark MAyr (Mbr to Mar). In the same manner, distance dyyc between the center perpendicular mark MAkc of reference color K and the center perpendicular mark MAyc of color Y is determined from the difference between the respective middle point positions (Mbc to Mac). Further, distance dyyf between the front perpendicular mark MAkf of reference color K and the front perpendicular mark MAyf of color Y is determined from the difference between the respective middle point positions (Mbf to Maf).

Then the MPU 41 calculates a curve amount dcuy in the "y" direction of Y image, relative to K image. The curve amount dcuy in the "y" direction of Y image relative to K image is determined by Equation 1.

$$dcuy = \frac{dyyr + dyyf}{2} - dyyc. \qquad \text{Equation 1}$$

Then, the MPU 41 calculates a correction amount dryy in the "y" direction of Y image. The correction amount dRyy in the "y" direction of Y image is calculated according to the following equation, Equation 2, on the basis of the curve amount dcuy and a target distance "d" of the Y perpendicular mark with respect to the K perpendicular mark.

$$\begin{aligned} dRyy &= \frac{dyyr + dyyf}{2} - d - \frac{dcuy}{2} \\ &= \left[\left(\frac{dyyr + dyyf}{2} + dyyc\right)\Big/2\right] - d. \end{aligned} \qquad \text{Equation 2}$$

The value calculated by the mathematical equation, Equation 2, is a correction amount of the "y" direction, and in the image deviation adjustment (step S25*b*-3) as will be described later, color misregistration is corrected based on the correction amount thus calculated.

Then, the MPU 41 calculates a skew amount dsqy of Y image relative to K image. The skew amount dsqy of Y image relative to K image is determined according to a mathematical equation, Equation 3.

$$dsqy = \frac{dyyr - dyyf}{2}. \qquad \text{Equation 3}$$

The value determined in Equation 3 is skew correction amount, and in the image deviation adjustment (step S25*b*-3) as will be described later, a skew correction is conducted based on the skew amount dsqy thus calculated.

Figure 19:
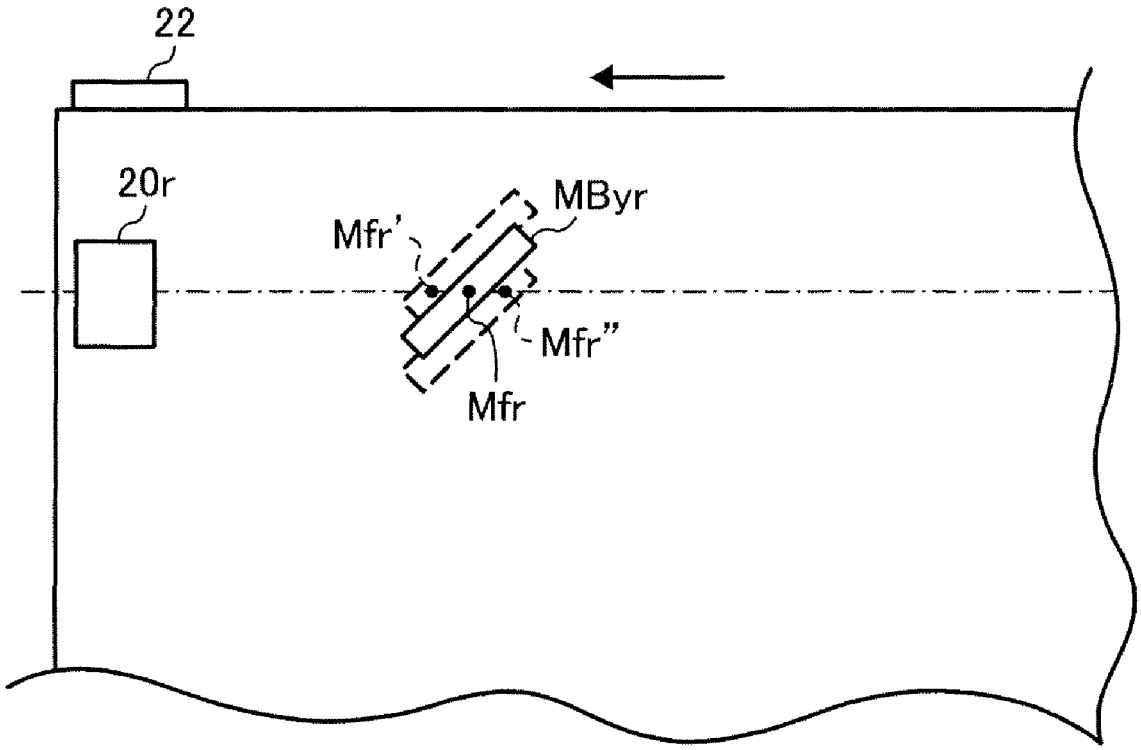
FIG. 19 is a view for describing a diagonal mark Mbyr is displaced in a main scanning direction.

FIG. 19 is a view for describing that a diagonal mark Mbyr is displaced in a horizontal scanning direction or a main scanning direction. Then the MPU 41 determines misregistration amount dxy in the horizontal scanning direction "x" or the "x" direction of Y image in the manner as described below.

As shown in FIG. 19, when the diagonal mark Mbyr shifts upward (rear side) in the drawing, the position of middle point in the vertical scanning direction "y" or the "y" direction of the diagonal mark Mbyr detected by the optical sensor is anterior to the target position (Mfr').

On the other hand, when the image shifts downward (front side) of the drawing, the position of middle point in the vertical scanning direction of the diagonal mark Mbyr detected by the optical sensor is posterior to the target position (Mfr"). By determining deviation amount dxy of the difference in middle point position of the perpendicular mark May and diagonal mark Mby, relative to the target (ideal) distance, 4d+(L/2) cos 45°, it is possible to know that the misregistration amount in the "x" direction.

First, as shown in Equation 4 described below, the MPU 41 calculates a misregistration amount of the difference in middle point position between the perpendicular mark Mayr and the diagonal mark Mbyr of the rear part "r" (Mfr to Mbr), relative to the reference value, 4d+(L/2) cos 45° (see FIG. 7).

$$dxyr = (Mfr - Mbr) - \left(4d + \frac{L}{2}\cos 45^\circ\right). \quad \text{Equation 4}$$

Next, as shown in Equation 5, a misregistration amount of the difference in middle point position between the perpendicular mark Mayr and the diagonal mark Mbyc of center "c" (Mfc to Mbc), relative to the reference value, 4d+(L/2) cos 45° (see FIG. 7) is calculated.

$$dxyc = (Mfc - Mbc) - \left(4d + \frac{L}{2}\cos 45^\circ\right). \quad \text{Equation 5}$$

Next, as shown in Equation 6, a misregistration amount of difference in middle point position between the perpendicular mark Mayc and the diagonal mark Mbyc of the front part "f" (Mff to Mbf), relative to the reference value, 4d+(L/2) cos 45° (see FIG. 7) is calculated.

$$dxyf = (Mff - Mbf) - \left(4d + \frac{L}{2}\cos 45^\circ\right). \quad \text{Equation 6}$$

Then as shown in Equation 7, by calculating an average value of misregistration amount of the rear part "r", misregistration amount of the center part "c", and misregistration amount of the front part "f", the misregistration amount dxy in the horizontal scanning direction of Y image is calculated.

$$dxy=(dxyr+dxyc+dxyf)/3 \quad \text{Equation 7.}$$

The value obtained by Equation 7 is the misregistration amount dxy in the horizontal scanning direction of Y image. Then, the misregistration amount dxy in the image deviation adjustment for colors K, Y, M, and C in step S25*b*-3 may adjust misregistration in the "x" direction based on the misregistration amount dxy in the scanning direction.

Next, as shown in Equation 8, the MPU 41 calculates a misregistration amount dLxy of horizontal scanning line length of Y image by subtracting skew dsqy from the difference in middle point position between the rear diagonal mark Mbyr and the front diagonal mark Mbyf (Mff to Mfr).

$$dLxy=(Mff-Mfr)-dsqy \quad \text{Equation 8.}$$

The value obtained by Equation 8 is a misregistration amount dLxy of horizontal scanning line length of Y image, and the length of the horizontal scanning line is corrected in the misregistration adjustment (step S25*b*-3) as described later, based on the misregistration amount dLxy of horizontal scanning line length of Y image dLxy thus calculated.

The MPU 41 also calculates misregistration amounts of the remaining C and M images (misregistration correction amounts dryc and drym in the "y" direction, misregistration correction amounts dxc and dxm in the "y" direction, skew amounts dsqc and dsqm, and misregistration correction amounts of horizontal scanning line length dLxc and dLxm) in a similar manner as described above for calculation of or misregistration amount of Y image (Ace and Acm). The MPU 41 also calculates misregistration amounts of K image (misregistration amount dxk in the "x" direction, misregistration amount dLxk of the horizontal scanning line length), in the generally same manner as described for calculation of misregistration amounts of Y image, however, in the present laser printer, since color matching in the "y" direction is based on K, as to K, calculation of misregistration correcting amount dRyk and skew amount dsqk in the vertical scanning direction is not executed (Ack).

Once misregistration amounts based on measurement data are calculated in the manner as described above, misregistration adjustment (S25*b*-3) shown in FIG. 12B is executed. First, a detailed description is given of the misregistration amount adjustment (Ady) of the Y color.

First, adjustment of misregistration amount in the direction "y" direction is described.

The misregistration amount in the direction "y" direction is adjusted by shifting the timing at which scanning to the Y color photoconductor of the optical writing unit 5 starts, from the reference (ideal) timing (in the "y" direction) by the amount that corresponds to the misregistration adjustment amount dRyy calculated above.

Next, the adjustment of skew will be described.

As shown in FIGS. 4A and 4B, inclination of the scanning line of the long lens unit 40 of the optical writing unit 5 is adjustable. The MPU 41 achieves adjustment by driving the driving motor 460 by the amount corresponding to the skew dsqy calculated above from the reference position of the driving motor 460.

Next, the adjustment of the misregistration amount dxy in the horizontal or main scanning direction will be described.

The MPU 41 sends image data located at the leading part of the scanning line to a modulator, not shown, of the optical writing unit 5, with respect to a line synchronizing signal representing the leading part of the scanning line for forming a latent image by a laser light beam La emitted from the optical writing unit 5. The MPU 41 determines a timing of sending the image data in the main scanning direction or the "x" direction to be set at a position shifted by the misregistration amount dxy. With the above-described action, the misregistration amount dxy can be adjusted.

Next, the adjustment of the misregistration amount dLxy of a horizontal scanning line length will be described.

A frequency of pixel synchronizing clock is used to allocate image data in a unit of pixel along the horizontal or main scanning line on the photoconductor drum 6. The MPU 41 sets the frequency of pixel synchronizing clocks to a value corresponding to a relation satisfying "reference frequency× Ls/(LS+dLxy)", where "Ls" represents a reference scanning line length.

The MPU 41 adjusts the misregistration amounts of the C and M images in a same manner as the adjustment of misregistration amount of the Y image (Adc and Adm). For the K image, only the misregistration amount dxy in the horizontal scanning direction and the misregistration amount dLxy of a horizontal scanning line length may be adjusted (Adk).

As described above, the first through eighth mark sets are formed on different positions on the circumferential surface of the photoconductor drum 6. Therefore, even when some marks are skipped and not read in mark detection, sufficient detection data for calculating an average value of misregistration amounts can be obtained.

Further, as shown in FIG. 10B, when only read mark data in a range of from 2V to 3V is extracted and stored in a memory and the mark middle points Akrp and Ayrp located between the center points "a" and "c" of data group in a region of decreasing levels and the center points "b" and "d" of data group in a region of increasing levels are calculated as mark positions, the mark detection may be conducted without skipping marks and/or detecting noise as mask. Accordingly, the mark detection can be performed in high accuracy.

Further, the MPU 41 counts up the number of performances of the color adjustments CPA, and stores the result in a non-volatile memory.

When the number of performances of the color adjustments CPA is less than a given set number, the MPU 41 may form the start marks and the first through fourth mark sets on the surface of the transfer belt 10 and calculates the misregistration amounts of color images.

When the number of performances of the color adjustments CPA is equal to or greater than the given set number, the MPU 41 may form the start marks and the first through eighth mark sets on the surface of the transfer belt 10 and calculate the misregistration amount of color images.

Accordingly, the misregistration of color images can effectively be reduced. In addition, since only the test patterns of the first through fourth mark sets are formed, the execution time of the color adjustment CPA may be reduced.

Further, the test pattern includes a perpendicular mark serving as a first mark and a diagonal mark serving as a second mark that forms an angle of 45 degrees with respect to the perpendicular marks. The inclination angle of the diagonal mark is not limited to 45 degrees.

Figure 20:
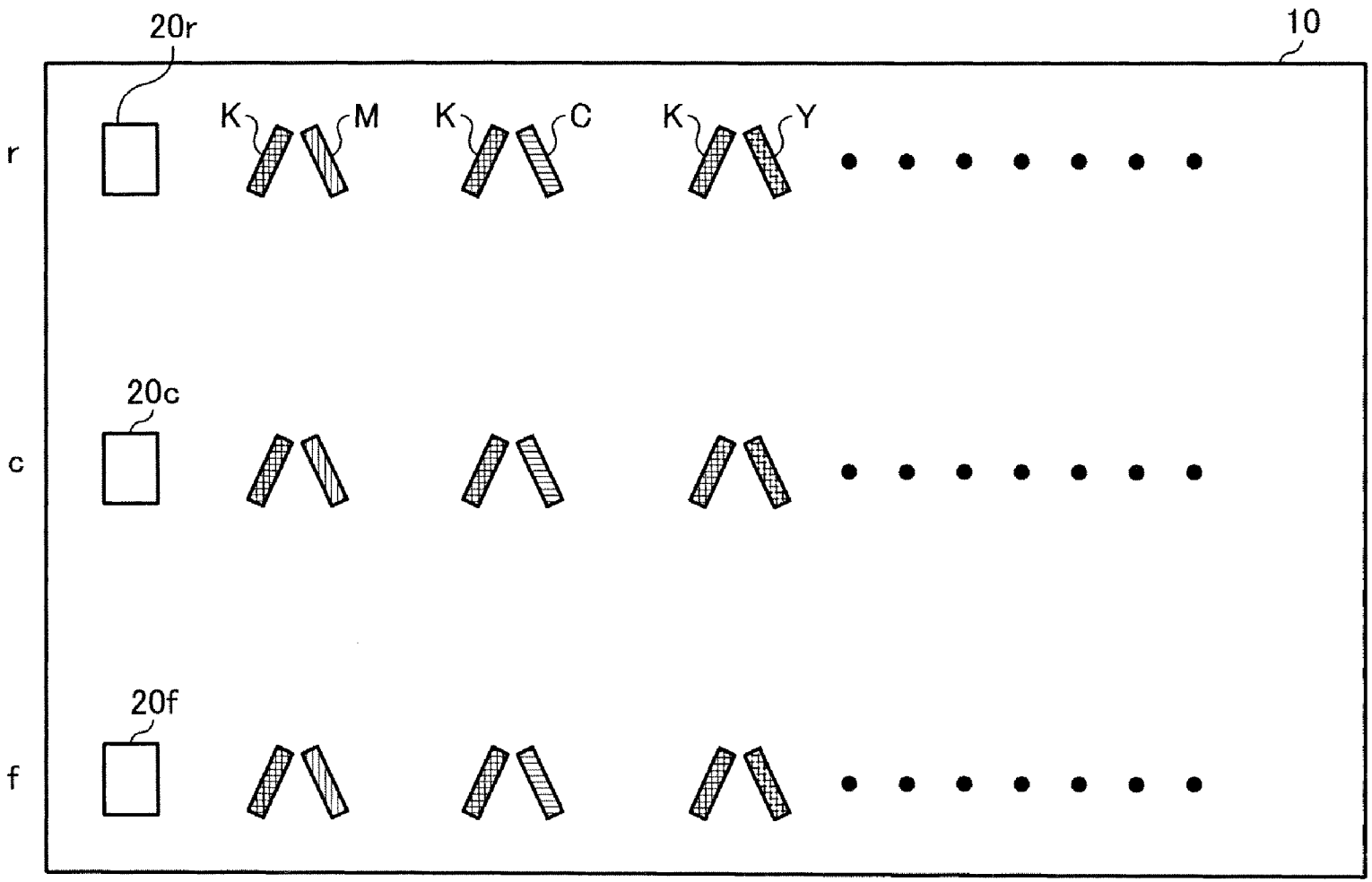
FIG. 20 is a graph showing variations of a travel speed of the transfer belt due to eccentricity of a drive roller.

Further, the test pattern of one exemplary embodiment of the present invention includes a mark set of a group of four perpendicular marks of yellow (Y), magenta (M), cyan (C), and black (K) and a group of four diagonal marks of yellow (Y), magenta (M), cyan (C), and black (K). However, combination of the test pattern is not limited to the above-described mark set. For example, as shown in FIG. 20, the test pattern can include combinations of a reference color (black, in one exemplary embodiment) and each color, such as patterns of black and magenta, black and cyan, and black and yellow.

In one exemplary embodiment of the present invention, the intervals of the perpendicular marks and the intervals between a perpendicular mark and a diagonal mark can be any given values. Alternatively, optimal intervals can be determined according to the settings described below. The intervals of marks within one mark set may include intervals "ma" between a mark of a reference color "K" and respective marks of colors "Y", "C", and "M" in a same mark set and intervals "mb" between marks of same color in a same mark set. The intervals of mark sets may include intervals "L" between adjacent mark sets. The above-described intervals are determined so that a calculation error, which is caused by a composite waveform for calculating a misregistration amount of a color image with respect to a composite waveform including a waveform of a frequency generated by the variations in speed of the transfer belt 10, a waveform of a frequency of driving irregularity generated by variation non-uniformity during one revolution of the photoconductor drum 6, etc., can be set less than a range in which the misregistration of the color image is adjustable. For example, the above-described intervals are set so that the calculation error is equal to or smaller than 20 μm. Therefore, a range of accuracy in misregistration adjustment is equal to or smaller than 20 μm. The value, 20 μm, is half of 40 μm required for forming one dot in 600 DPI. The misregistration amount greater than 20 μm may be adjusted by the above-described adjustment. By contrast, the misregistration amount equal to or smaller than 20 μm may not be adjusted by the above-described adjustment.

The maximum values of respective intervals between the mark of the reference color "K" and the marks of colors "Y", "C", and "M" may include an interval between the perpendicular mark of the reference color "K" and the perpendicular mark of the color "Y", an interval between the perpendicular mark of the reference color "K" and the perpendicular mark of the color "C", an interval between the perpendicular mark of the reference color "K" and the perpendicular mark of the color "M", an interval between the diagonal mark of the reference color "K" and the diagonal mark of the color "Y", an interval between the diagonal mark of the reference color "K" and the diagonal mark of the color "C", and an interval between the diagonal mark of the reference color "K" and the diagonal mark of the color "M". The MPU 41 calculates conditions that the above-described maximum values of respective intervals between the mark of the reference color "K" and the marks of colors "Y", "C", and "M" do not exceed 20 μm in all combinations of phases of the variations in speed of the transfer belt 10, the driving irregularity of the photoconductor drum 6, and so forth. And the MPU 41 sets the intervals "ma" between the mark of the reference color "K" and the respective marks of colors "Y", "C", and "M" in a same mark set, intervals "mb" between marks of same color in a same mark set, and intervals "L" between adjacent mark sets.

That is, the above-described test pattern signal generator providing test pattern signals to the optical writing unit 5 has a configuration to generate the test pattern signals for forming test patterns on the transfer belt 10. The test patterns includes 1) the intervals "ma" between the mark of the reference color "K" and the respective marks of colors "Y", "C", and "M" in a same mark set, 2) intervals "mb" between marks of same color in a same mark set, and 3) intervals "L" between adjacent mark sets. In the test pattern signal generator, the maximum values (an interval between the perpendicular mark of the reference color "K" and the perpendicular mark of the color "Y", an interval between the perpendicular mark of the reference color "K" and the perpendicular mark of the color "C", an interval between the perpendicular mark of the reference color "K" and the perpendicular mark of the color "M", an interval between the diagonal mark of the reference color "K" and the diagonal mark of the color "Y", an interval between the diagonal mark of the reference color "K" and the diagonal mark of the color "C", and an interval between the diagonal mark of the reference color "K" and the diagonal mark of the color "M") of respective intervals between the mark of the reference color "K" and the marks of colors "Y", "C", and "M" do not exceed 20 μm in all combinations of phases of the variations in speed of the transfer belt 10, the driving irregularity of the photoconductor drum 6, and so forth.

Further, one exemplary embodiment of the present invention includes eight sets of mark sets including the group of perpendicular marks and the group of diagonal marks. However, the combination of the mark sets is not limited to the above-described combination, and it is preferable to select the combination according to the characteristics of an image forming system or apparatus. For example, a system or apparatus in which an ultra high image quality is desired for professional use may need to increase the number of mark sets at the expense of the adjustment time so as to increase accuracy in adjustment. By contrast, a system or apparatus used in offices may not need ultra high image quality. In such a system or apparatus, however, a reduction of the waiting time during the adjustment is much needed. Therefore, it is preferable that systems or apparatuses for office use may reduce the number of mark sets so as to reduce the waiting time by reducing the number of mark sets.

Figure 21:
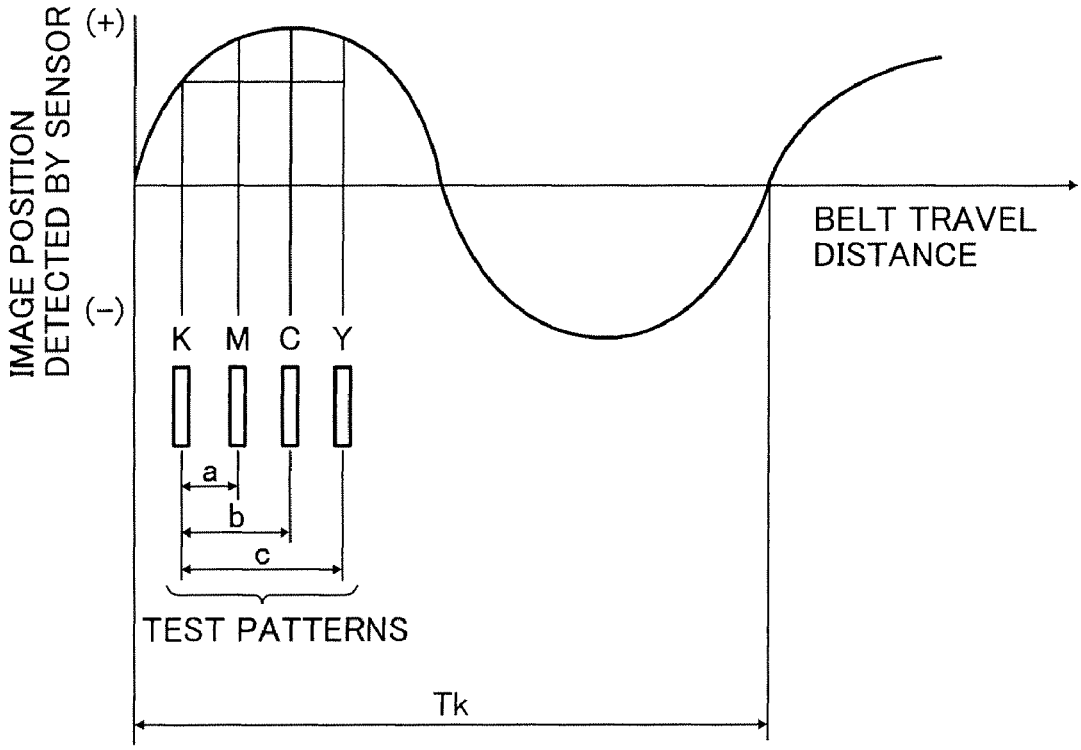
FIG. 21 is a schematic configuration of a driving mechanism of the transfer belt.

As described above, the test patterns for detecting the positions are transferred onto the transfer belt 10 and read by the optical sensors 20*f*, 20*c*, and 20*r* to detect the misregistration, inclination, magnification, etc. of the scanning line of the optical writing unit 5 with respect to the photoconductor drums 6*a*, 6*b*, 6*c*, and 6*d*. The detection results are used to adjust the timing at which the optical writing unit 5 writes to each of the photoconductor drums 6*a*, 6*b*, 6*c*, and 6*d* so as to eliminate the misregistration caused by the above-described factors. However, when the drive roller 9 driving the transfer belt 10 becomes eccentric caused in a process and/or assembly step, the transfer belt 10 cannot maintain a constant travel speed. That is, the travel speed of the transfer belt 10 may sinusoidally vary by one revolution Tk of the drive roller 9, as shown in FIG. 21. The eccentricity of the drive roller 9 is caused by vibration on the surface of the drive roller 9 with respect to its shaft and/or vibration of pulleys provided to the shaft for rotating the roller shaft of the drive roller 9.

Further, the travel speed of the transfer belt 10 may vary due to a slight slippage between the drive roller 9 and the transfer belt 10, shocks or impacts given to a recording medium when fed and/or discharged, a load change caused when applying various biases such as a transfer bias, and so forth.

When the above-described speed variations occur to the transfer belt 10, the misregistration of color images may be caused due to the variations in speed of the transfer belt 10.

In one exemplary embodiment of the present invention, a rotation speed of the driven roller 13*b* around which the transfer belt 10 is spanned to provide a constant travel speed of the transfer belt 10 is detected. Based on the detection data, the rotation of the drive roller 9 is controlled.

Figure 22:
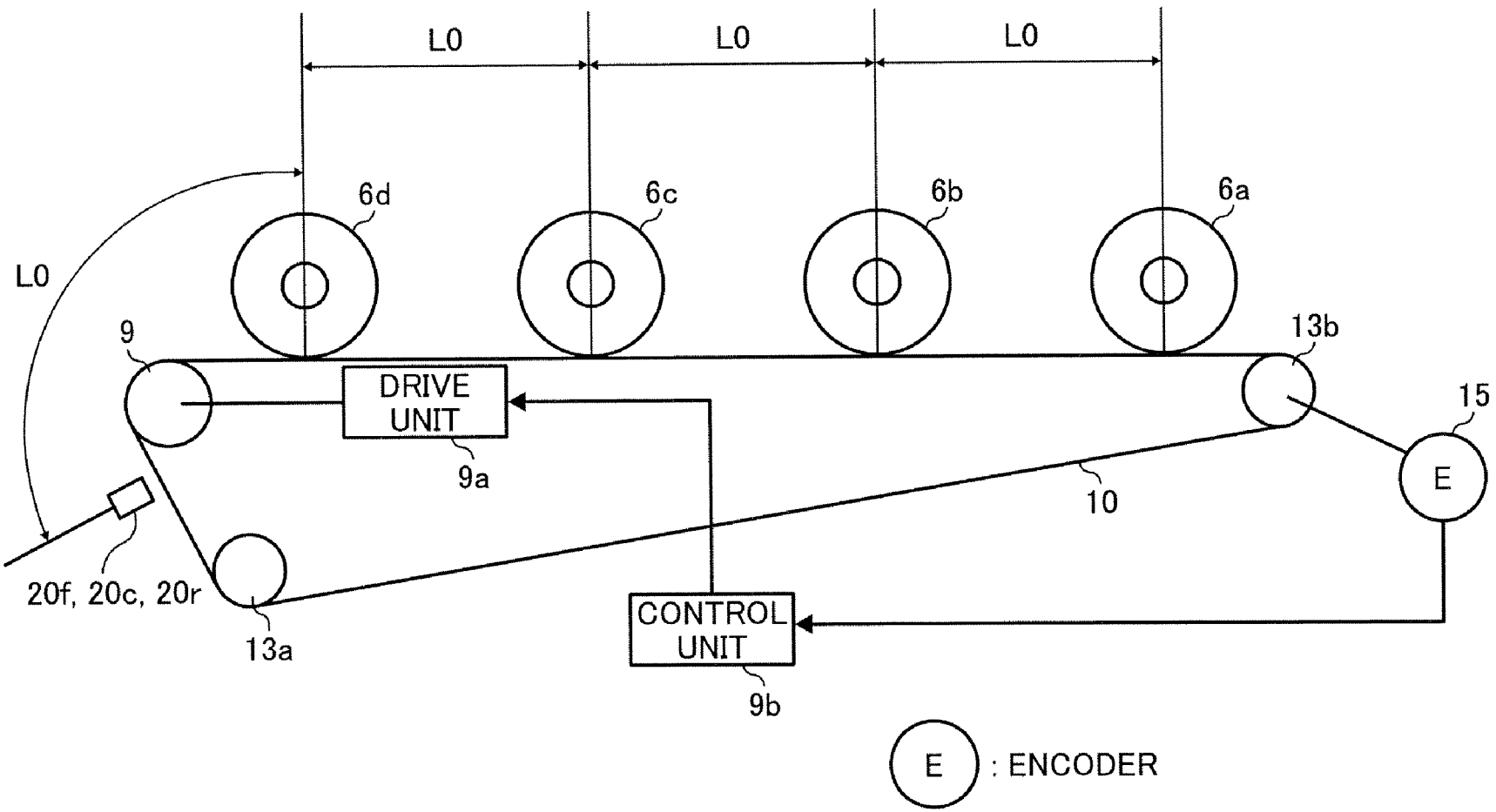
FIG. 22 is a perspective view of a driven roller and an encoder mounted on the driven roller.

Referring to FIG. 22, a schematic configuration of a driving mechanism of the transfer belt 10 is described.

The transfer belt 10 is extendedly spanned around the drive roller 9, a tension roller 13*a*, the driven roller 13*b*, and so forth. The drive roller 9 is connected to a driving part 9*a*. The driving part 9*a* serving as a roller driving unit for driving the drive roller 9 includes a pulse drive motor, not shown, a speed reduction mechanism extending a drive belt between a small pulley mounted on the pulse drive motor and a large pulley mounted on a drive shaft of the drive roller 9, and so forth.

The driving part 9*a* is controlled by a belt control unit 9*b* under a feedback control. That is, the belt control unit 9*b* serving as a belt controller controls the driving part 9*a* to drive at a driving speed according to a given target value based on a value of an output power transmitted thereto from a rotation detector or an encoder 15 (see below). Therefore, a surface travel direction or a belt travel direction of the transfer belt 10 is maintained at a substantially constant value, which is a desired speed corresponding a registration linear velocity.

Specifically, in one exemplary embodiment of the present invention, the driven roller 13*b* includes the encoder 15 serving as a rotation detector to detect a rotation condition of the driven roller 13*b*, and the value of the output power of the encoder 15 is transmitted to the belt control unit 9*b*. Based on the value of the output power of the encoder 15, the travel speed of the transfer belt 10 can be obtained. The belt control unit 9*b* compares the value of the output power of the encoder 15 and a target value needed to drive the transfer belt 10 at the travel speed corresponding to the registration linear velocity. Then, a drive pulse is output to the driving part 9*a* to eliminate such a difference therebetween.

Figure 23:
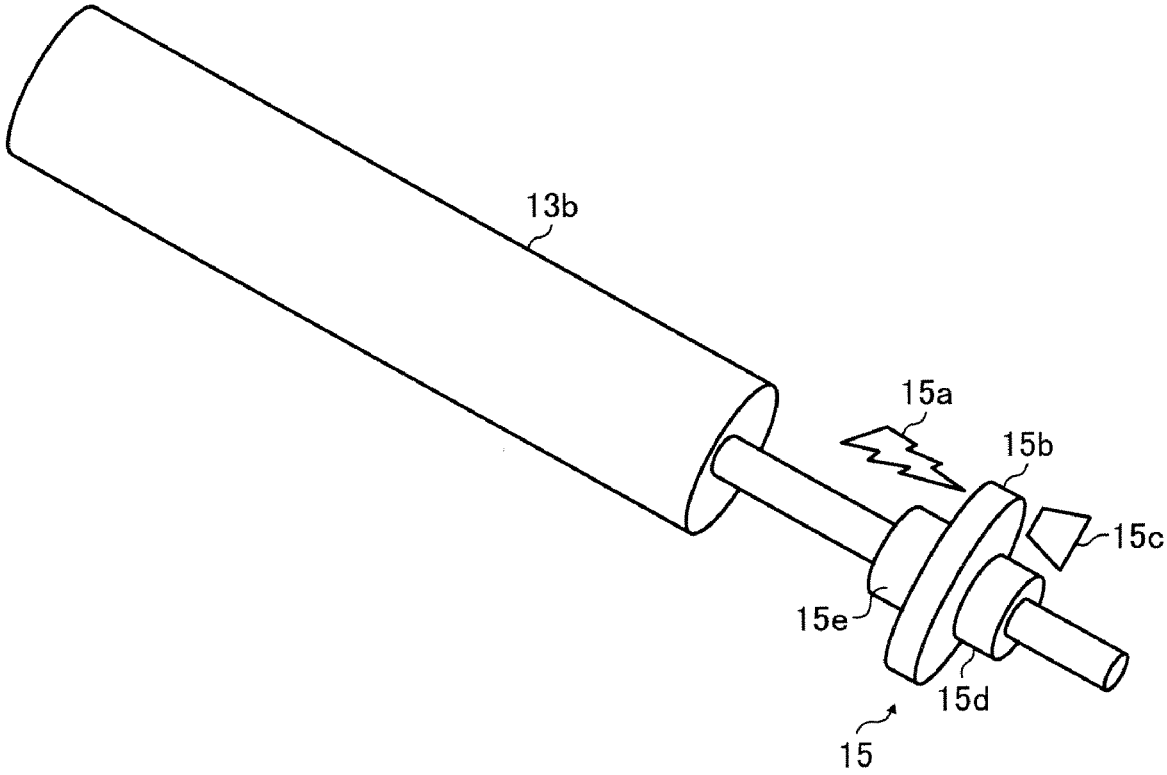
FIG. 23 is a side view of the encoder.
Figure 24:
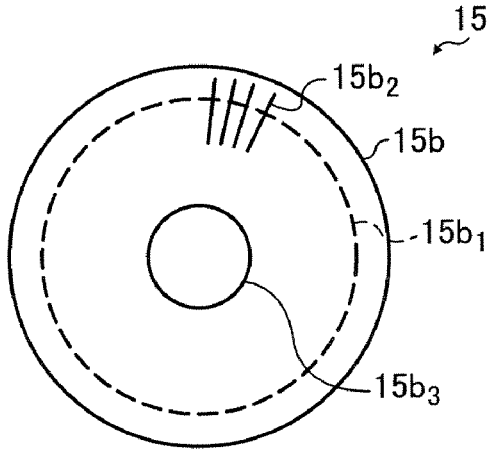
FIG. 24 is a drawing for explaining variations of a travel speed of the transfer belt due to eccentricity of the driven roller.

Referring to FIGS. 23 and 24, a description is given of the encoder 15 attached to the driven roller 13*b*.

In FIG. 23, the encoder 15 includes a disk 15*b*, a light emitting element 15*a*, a light receiving element 15*c*, and press fitting bushes 15*d* and 15*e*.

The disk 15*b* is fixed on the shaft of the driven roller 13*b* by pressing the press fitting bushes 15*d* and 15*e* thereto and is controlled to rotate together with the driven roller 13*b*.

In FIG. 24, the disk 15*b* includes lines 15*b*2, partially shown, extending radially from the center of a region to be read by the light emitting and receiving elements. Hereinafter, the region is referred to as a "line center 15*b*1." At both sides of the disk 15*b*, the light emitting element 15*a* and the light receiving element 15*c* are disposed so that the disk 15*b* can alternately pass and block the light beam from the light emitting element 15*a*. Consequently, the light receiving element 15*c* receives the light beam passed through the disk 15*b*. Thus, a pulsed ON/OFF signal is obtained according to the rotations of the driven roller 13*b*. The pulsed ON/OFF signal is used to detect an angular movement of the driven roller 13*b* so as to control an amount of drive of the driving part 9*a*.

With this control, the transfer belt 10 can eliminate the speed variations, which are caused by the factors such as the slight slippage between the drive roller 9 and the transfer belt 10, the shocks or impacts given to a recording medium when fed and/or discharged, the load change caused when applying various biases such as a transfer bias, and so forth. Accordingly, the misregistration of color images due to the variations in speed of the transfer belt 10 can be reduced or prevented, thereby rapidly enhancing image quality.

Figure 25:
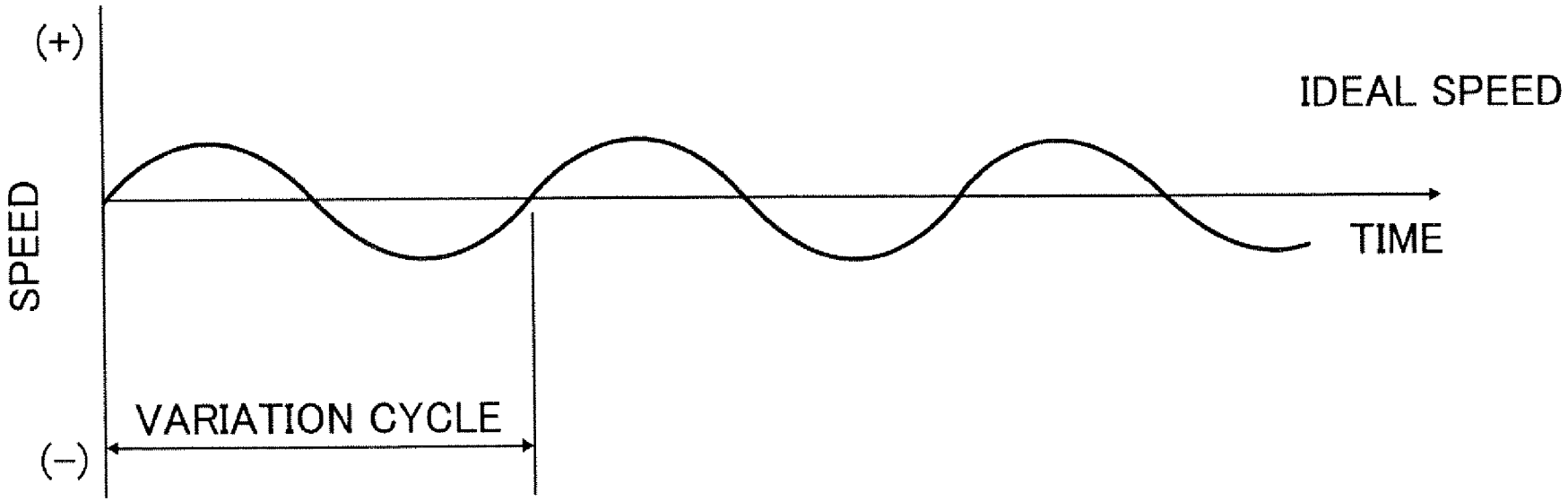
FIG. 25 is a drawing for explaining misreading due to eccentricity of the driven roller.

However, even though the above-described feedback control causes the transfer belt 10 to travel constantly, a slightly small speed variation as shown in FIG. 25 may be generated.

Next, a description is given of these slightly small variations in speed of the transfer belt 10.

When the line center 15*b*1 formed on the disk 15*b* is eccentric with respect to an inner diameter 15*b*3 of the disk 15*b*, the eccentricity of the line center 15*b*1 may cause the reading positions of the light emitting element 15*a* and the light receiving element 15*c* both fixedly mounted on a case, not shown, to be varied. Under the above-described status, the angular speed of the driven roller 13*b* is detected as an incorrect value and the detected incorrect value is fed back. As a result, the transfer belt 10 is driven by an incorrect amount of the eccentricity. That is, deviation during one revolution of the driven roller 9 may be generated.

Further, similar to the eccentricity of the disk 15*b*, when the roller part of the driven roller 13*b* is eccentric with respect to a shaft thereof, a phenomenon same as those described above occurs, thereby generating deviation during one revolution of the driven roller 13*b*.

As described above, in the feedback control in which the encoder 15 detects the rotation condition of the driven roller 13*b* and feeds back the rotation speed of the driven roller 13*b*, the speed variations caused by the factor of the disk 15*b* of the encoder 15 and the driven roller 13*b* on which the encoder 15 is mounted cannot be removed, while the speed variations caused by the factors other than the above-described factor can be removed.

Figure 26:
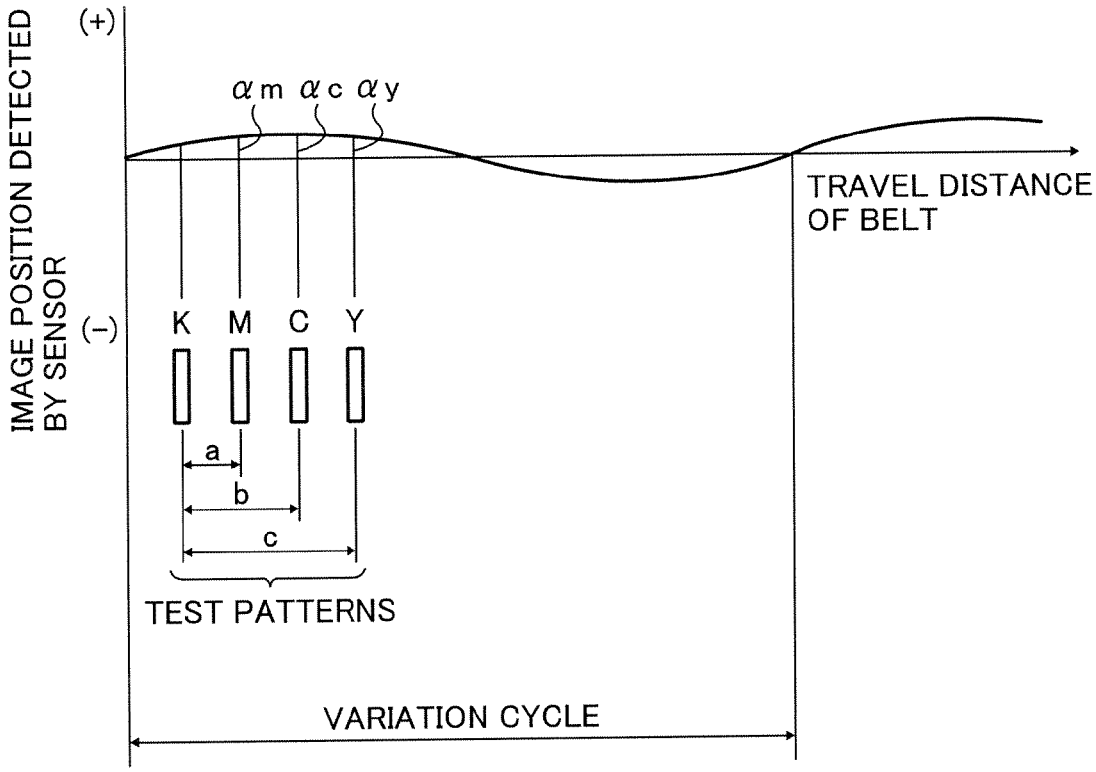
FIG. 26 is a drawing of the driven roller with the transfer belt spanned therearound.

Since toner marks of the test patterns are transferred on the transfer belt 10 causing the above-described slightly small speed variation, errors may occur when reading by the optical sensors 20*f*, 20*c*, and 20*r*. This slightly small speed variation will be described in reference to FIG. 26 showing an error reading due to the eccentricity of the drive roller 9.

When actual distances between different colors of the test patterns formed on the transfer belt 10 are, for example, a distance between the K color and the M color is "a", a distance between the K color and the C color is "b", and a distance between the K color and the Y color is "c", the detection results may include differences "αm", "αc", and "αy", respectively. As a result, the relations between the toner marks may be determined so as to satisfy the error relations of (a+αm) between the K color and the M color, (b+αc) between the K color and the C color, and (c+αy) between the K color and the Y color. Accordingly, the relative misregistration of the scanning line between adjacent photoconductor drums cannot be detected in high accuracy, and the misregistration, inclination, magnification, and so forth cannot effectively be adjusted.

In one exemplary embodiment of the present invention, as shown in FIG. 22, a distance from the transfer position at which each of the test patterns is transferred onto the transfer belt 10 to the optical sensors 20*f*, 20*c*, and 20*r* serving as pattern detection sensors is set to a value being an integer multiple of a distance L0 of travel of the transfer belt 10 during one revolution of the driven roller 13*b*. With this operation, the factors of the variations in speed of the driven roller 13*b* and the encoder 15 can be cancelled.

In one example shown in FIG. 22, a surface travel distance of the transfer belt 10 forming a closed loop between the image carriers 6*a*, 6*b*, 6*c*, and 6*d* is set to a distance L0 of travel of the transfer belt 10 during one revolution of the driven roller 13*b*. In addition, a surface travel distance of the transfer belt 10 from a transfer position of the photoconductor drum 6*d* that is located closest to the optical sensors 20*f*, 20*c*, and 20*r* to the detection position of the optical sensors 20*f*, 20*c*, and 20*r* is also set to a distance same as the distance L0. By setting the distance from the transfer position of the photoconductor drum 6*d* to the detection position of the optical sensors 20*f*, 20*c*, and 20*r* to the distance L0, a distance from the formation of the test patterns to the detection of the test patterns by the optical sensors 20*f*, 20*c*, and 20*r* can be reduced or shortened. Accordingly, the execution time of color misregistration adjustment (CPA) can be reduced, thereby reducing a downtime generated due to the color misregistration adjustment (CPA).

Figure 27:
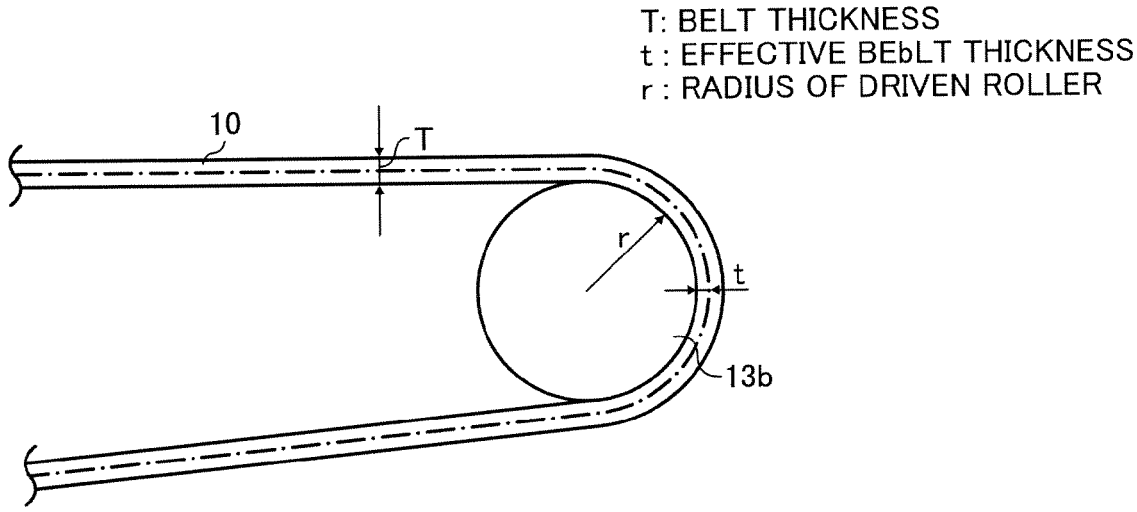
FIG. 27 is a graph showing a relation of an effective belt thickness and a spanning angle of the transfer belt.

Referring to FIG. 27, a description is given of the distance L0 of travel of the transfer belt 10 during one revolution of the driven roller 13*b*.

FIG. 27 shows a condition of the transfer belt 10 spanned around the driven roller 13*b* at a spanning angle "θ" of substantially 180 degrees. At this time, a thickness or length of the transfer belt 10 extends or increases at an outer surface side of the curved section and shrinks or decreases at an inner surface side of the curved section. That is, the length of the transfer belt 10 at an outer surface side of the curved section is greater than a length at a regular condition of the transfer belt 10, and the length of the transfer belt 10 at an inner surface side of the curved section is smaller than the length at a regular condition of the transfer belt 10. In addition, the length of the transfer belt 10 at the other portions are same as the regular length. When the thickness of this portion is defined as an effective belt thickness "t", the distance L0 of travel of the transfer belt 10 during one revolution of the driven roller 13*b* can be obtained by the following equation, Equation 9.

$$L0=(r+t)\times 2\times\pi \qquad \text{Equation 9,}$$

where "L0" represents a travel distance of the transfer belt 10, "r" represents a radius of the driven roller 13*b*, and "t" represents an effective belt thickness of the transfer belt 10.

Therefore, for example, when the line center 15*b*1 of the disk 15*b* is eccentric with respect to the inner diameter 15*b*3, a distance L of transfer of the transfer belt 10 can be obtained by the following equation, Equation 10.

$$L=A\sin(2\times\pi\times f\times t)+L0 \qquad \text{Equation 10,}$$

where "A" represents a variable amplitude due to eccentricity, "f" represents a frequency during one revolution of the disk 15*b*, and "t" represents a time.

Figure 28:
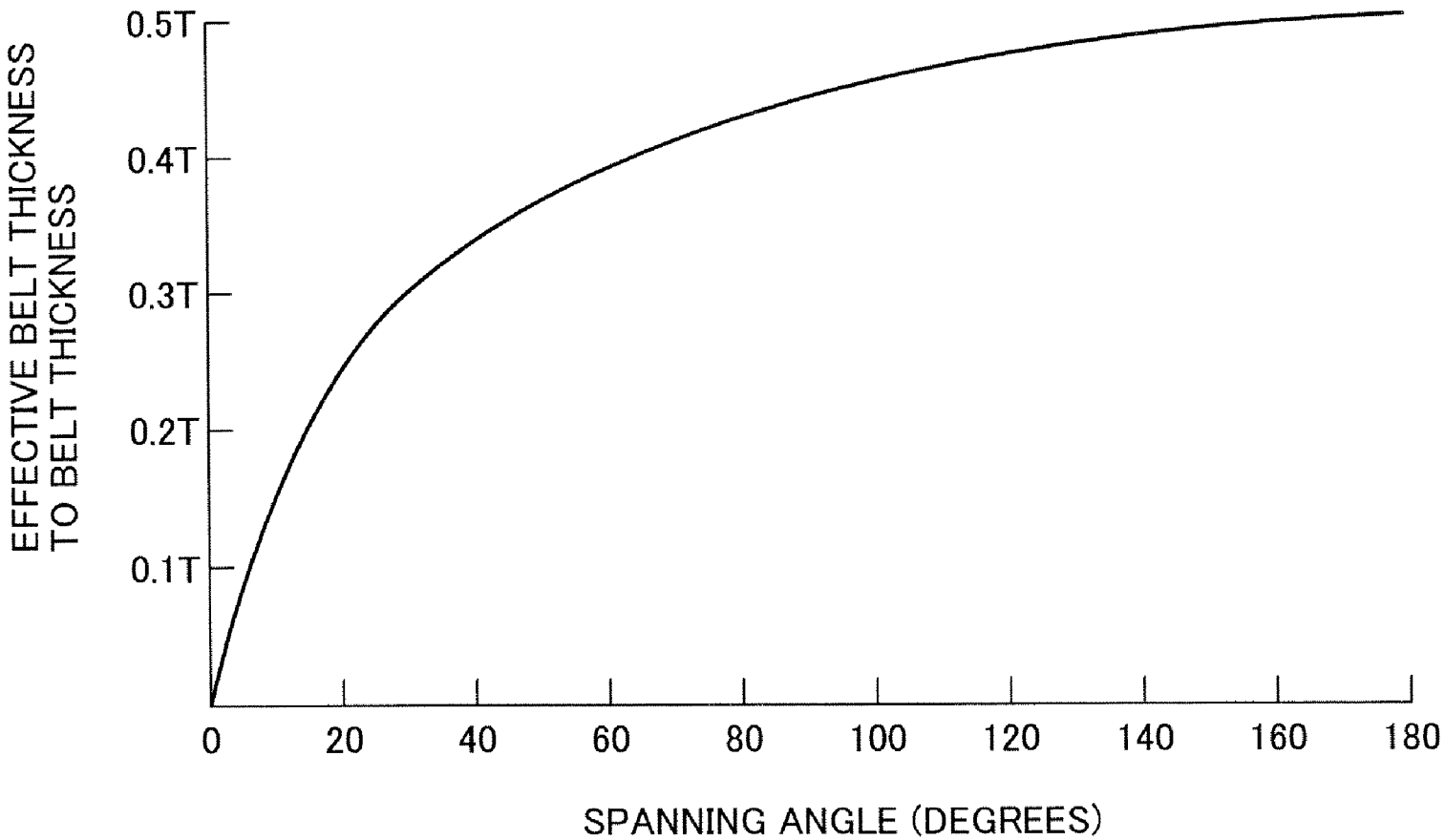
FIG. 28 is a drawing for explaining reasons of canceling factors of misreading due to eccentricity of the driven roller.

According to the result of the test conducted by the inventors of the present invention, the spanning angle "θ" and the effective belt thickness "t" of the transfer belt 10 have relations shown in a graph of FIG. 28. The graph of FIG. 28 shows that the effective belt thickness "t" varies depending on the spanning angle "θ". Therefore, the sheet conveyance distance may vary according to the spanning angle "θ" of the driven roller 13*b* with the encoder 15 mounted thereon. However, it is noted that the results shown in the graph of FIG. 28 were obtained when the inventors of the present invention conducted the test with the transfer belt 10 including polyvinylidenefluoride (PVDF). If the inventors use a transfer belt having a different material, the result may be different.

Figure 29:
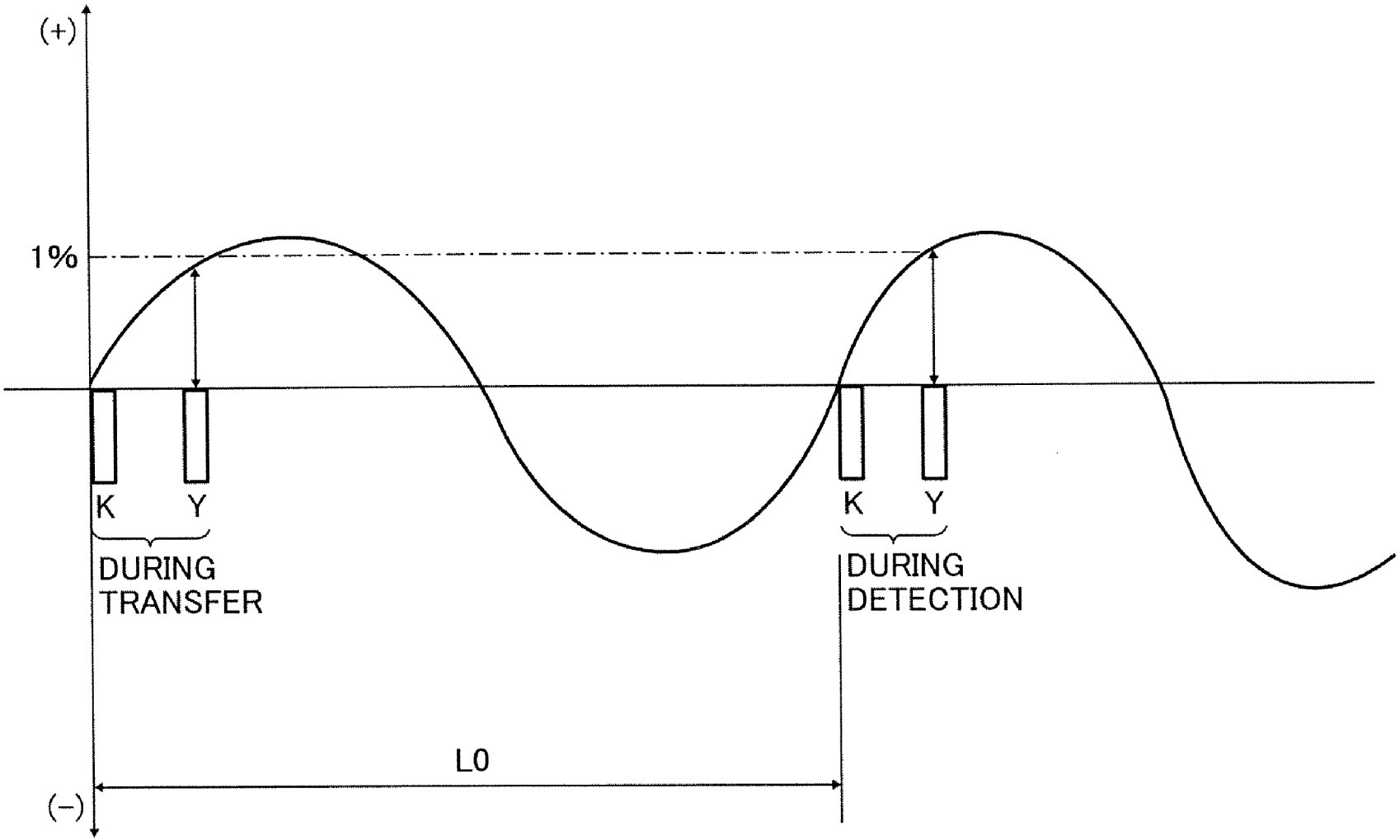
FIG. 29 is a graph for explaining a setting of a distance from a transfer position to a detection position of a photoconductor drum.

Next, in reference to FIG. 29, a description is given of the operability of canceling or removing the factors of the variations in speed of the driven roller 13*b* and the encoder 15 by setting a distance from the transfer position at which the transfer belt 10 receives the test patterns to the detection position of the optical sensors 20*f*, 20*c*, and 20*r*, to a value being an integer multiple of the distance L0 of travel of the transfer belt 10 during one revolution of the driven roller 13*b*.

A graph of FIG. 29 shows that a scanning line formed on the photoconductor drum 6 for a toner mark K and a scanning line formed on the photoconductor drum 6 for a toner mark Y is aligned at a desired interval and has no relative misregistration therebetween. As shown in FIG. 29, if the speed of the transfer belt 10 is faster by 1% than a desired speed when the toner mark Y of the test patterns is transferred from the corresponding photoconductor drum 6 to the transfer belt 10, the interval of the toner mark K and the toner mark Y may become greater by 1%. In addition, if the reading speed of the optical sensors 20*f*, 20*c*, and 20*r* for reading the toner mark Y is faster by 1% than a target reading speed, the interval between the toner mark K and the toner mark Y of the test patterns is extended by 1%, and the optical sensors 20*f*, 20*c*, and 20*r* may read the toner mark K and the toner mark Y faster by 1%. As a result, the detection results of the optical sensors 20*f*, 20*c*, and 20*r* are recognized that the test patterns are arranged at target intervals. Therefore, even when the encoder 15 and the driven roller 13*b* with the encoder 15 mounted thereon have speed variations, the speed variations can be cancelled and the target intervals of the test patterns can be recognized.

Therefore, by setting a distance from the transfer position at which the test patterns are transferred to the transfer belt 10 to the detection position of the optical sensors 20*f*, 20*c*, and 20*r*, to a value being an integer multiple of the distance L0 of travel of the transfer belt 10 during one revolution of the driven roller 13*b*, an amount of relative misregistration of the scanning line from the test patterns and the photoconductor drum 6 can be obtained accurately. Accordingly, the misregistration, inclination, and magnification of the scanning line can be adjusted effectively.

When a distance from the transfer position at which the transfer belt 10 receives the test patterns to the detection position of the optical sensors 20*f*, 20*c*, and 20*r* is accurately set to a value being an integer multiple of the distance L0 of travel of the transfer belt 10 during one revolution of the driven roller 13*b*, an amount of error in detecting the misregistrations in the variations of the driven roller 13*b* and the encoder 15 in the detection results of the optical sensors 20*f*, 20*c*, and 20*f* is 0 μm. However, the detection errors in the misregistration are not necessarily 0 μm. It is acceptable as long as the amount of error in detection is less than 20 μm. That is, it is not necessary that the distance from the transfer position to the detection position of the optical sensors 20*f*, 20*c*, and 20*r* is accurately set to a value being an integer multiple of the distance L0 of travel of the transfer belt 10 during one revolution of the driven roller 13*b*. However, it is preferable that the above-described distance is substantially set to a value being an integer multiple of the distance L0.

The value, 20 μm, is half of 40 μm required for forming one dot in 600 DPI. When the regular misregistration adjustment control is conducted, the misregistration amount greater than 20 μm is adjusted by the misregistration adjustment to adjust the misregistration of the scanning line. At the same time, the misregistration amount equal to or smaller than 20 μm is not adjusted by the above-described adjustment. It is noted that the above description is an example and the allowable range of errors in the misregistration amount can be set according to resolutions of the adjustment control of the regular misregistration.

Figure 30:
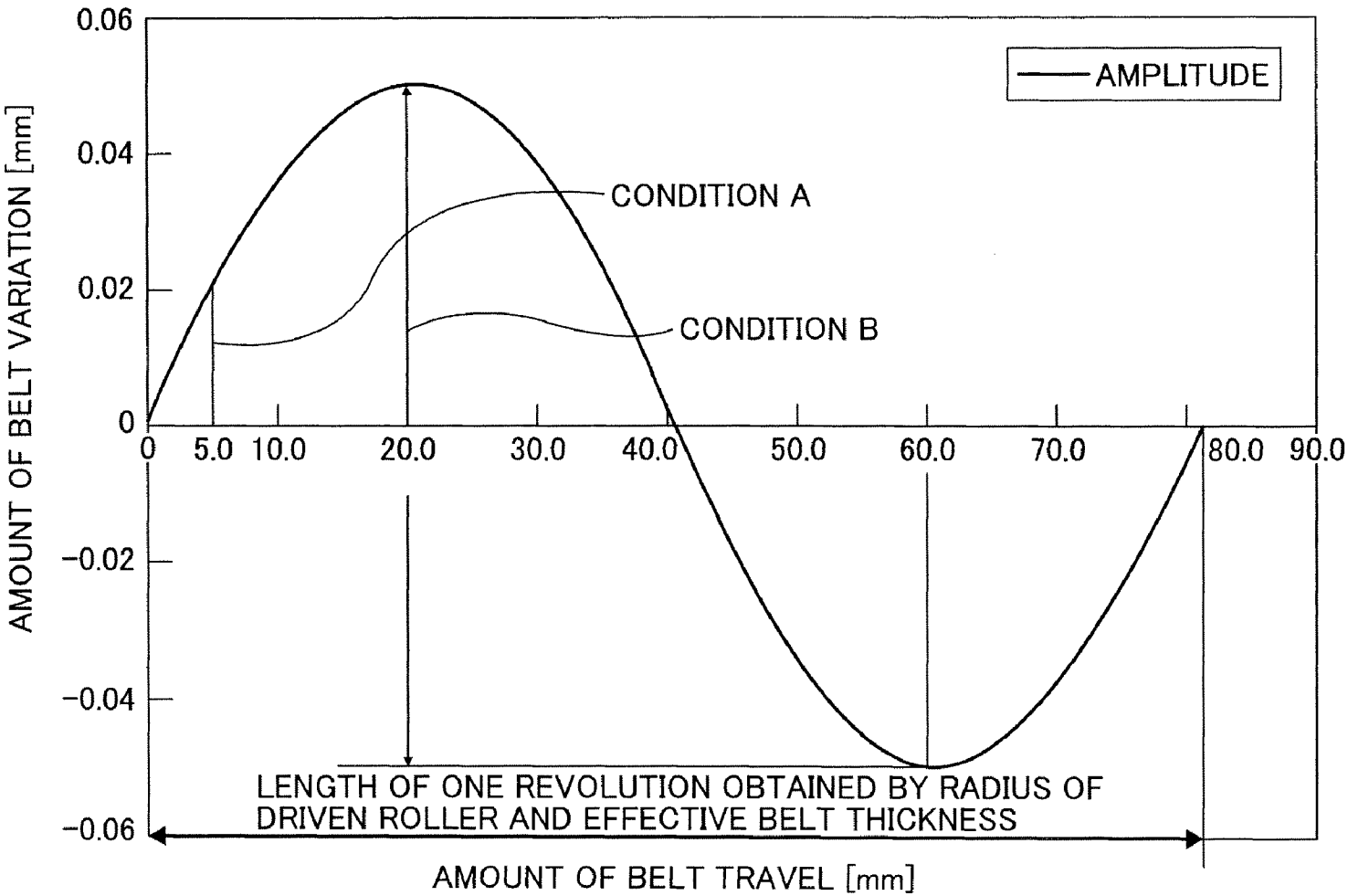
FIG. 30 is a schematic configuration of the image forming system with optical sensors at one exemplary positions.

Next, in reference to FIG. 30, a description is given of an example in which the allowable range of errors in the misregistration amount is set to 20 μm. A sine wave shown in a graph of FIG. 30 is obtained under the conditions that the distance L0 of travel of the transfer belt 10 during one revolution of the driven roller 13*b* is 81.9 mm and an amplitude of a belt speed variation due to the eccentricity of the driven roller 13*b* or the encoder 15 is 50 μm. "Condition A" indicates that when a difference between a distance from the transfer position to the image detection position and a circumferential length or length of one revolution obtained by the radius "r" of the driven roller 13*b* and the effective belt thickness "t" is approximately 5 mm, the misregistration amount is approximately 20 μm. This misregistration amount is one fifth of the least best value. "Condition B" indicates that when the difference between a distance from the transfer position to the image detection position and a circumferential length of the drive roller 9 is approximately 40.5 mm, which is the least best value, the misregistration amount is approximately 100 μm, which is double the length of the amplitude.

As shown the graph in FIG. 30, when the distance from the transfer position to the optical sensors 20*f*, 20*c*, and 20*r* is accurately an integer multiple of the distance L0, the error amount of the detection of the misregistration is 0 μm.

When the distance from the transfer position to the optical sensors 20*f*, 20*c*, and 20*r* falls 5 mm different from a value being an integer multiple of the distance L0, the error amount of the detection of the misregistration is 20 μm, as shown in the graph of FIG. 30. That is, even when the distance is 5 mm different from the value being an integer multiple of the distance L0, the value may stay in the allowable range of the error amount of the detection of the misregistration. In addition, when the distance is ±5 mm different from the distance being an integer multiple of the distance L0, the misregistration, inclination, magnification, and so forth of the scanning line can effectively be adjusted according to the detection results of the test patterns detected by the optical sensors 20*f*, 20*c*, and 20*r*.

Since actual products or apparatuses have tolerance in each part provided thereto, it is difficult to attach the part to an accurate position being an integer multiple of a given distance even through the target position was set to a value being an integer multiple of the given distance. In addition, a deviation from the tolerance in each part may be smaller than 5 mm. However, even when the tolerance varies by approximately 5 mm, the error amount thereof can stay within the allowable range.

As described above, the present invention can apply an accurate or approximate value "obtained by multiplying a distance from a transfer position of each image carrier to a mark detector with an integer multiple of a distance of travel of a transfer belt during one revolution of a driven roller while the rotation thereof is being detected by a rotation detector." That is, even an approximate value obtained as above can sufficiently achieve the purpose of the present invention.

Figure 31:
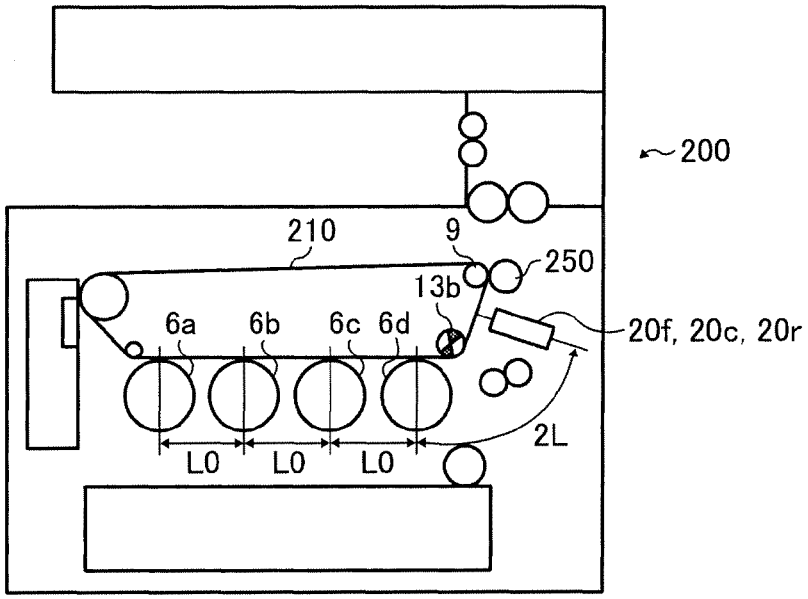
FIG. 31 is a schematic configuration of the image forming system with the optical sensors at another exemplary positions.

One exemplary embodiment of the present invention employs the image forming system 100 with the printer 101 having a direct transfer method in which the transfer belt 10 carries and conveys a transfer sheet and sequentially receives four single color toner images formed on the photoconductor drums 6*a*, 6*b*, 6*c*, and 6*d* on the transfer sheet directly. However, an image forming system available for the present invention is not limited thereto. For example, the present invention can apply to an image forming system 200 as shown in FIG. 31. The image forming system 200 employs an indirect or intermediate transfer method in which an intermediate transfer belt 210 sequentially receives four single color toner images from the photoconductor drums 6*a*, 6*b*, 6*c*, and 6*d* on a surface thereof to form a full-color toner image, and transfers the full-color image onto a transfer sheet conveyed by a sheet feeding mechanism.

For the image forming system 200 with the intermediate transfer method, it is preferable that the optical sensors 20*f*, 20*c*, and 20*r* serving as image detectors are disposed upstream from a secondary transfer roller 250 in a travel direction of the intermediate transfer belt 210. This arrangement of the optical sensors 20*f*, 20*c*, and 20*r* may reduce a distance from a position at which the test patterns are transferred onto a transfer sheet, i.e., a transfer position, to a position at which the optical sensors 20*f*, 20*c*, and 20*r* detect the test pattern, i.e., a detection position. As a result, a time required for the misregistration adjustment control can be reduced. Further, it is possible to eliminate a separation and contact mechanism that performs an operation of separating the secondary transfer roller 250 from the intermediate transfer belt 210 when the test patterns pass the portion. As a result, the cost reduction effect and reliability can be increased.

In the image forming system 200 shown in FIG. 31, a distance between any two adjacent photoconductor drums of the photoconductor drums 6*a*, 6*b*, 6*c*, and 6*d* is set to the distance L0 of travel of the intermediate transfer belt 210 during one revolution of the driven roller 13*b*, and a distance from a transfer position of the photoconductor drum 6*d*, which is a closest photoconductor drum to the optical sensors 20*f*, 20*c*, and 20*r*, to the detection position of the optical sensors 20*f*, 20*c*, and 20*r* is set to a distance 2L. However, the distance from the photoconductor drum 6*d* to the detection position of the optical sensors 20*f*, 20*c*, and 20*r* is not limited to the distance 2L, which is a distance two times greater than the distance L0, and the present invention can apply any other distance therebetween.

Figure 32:
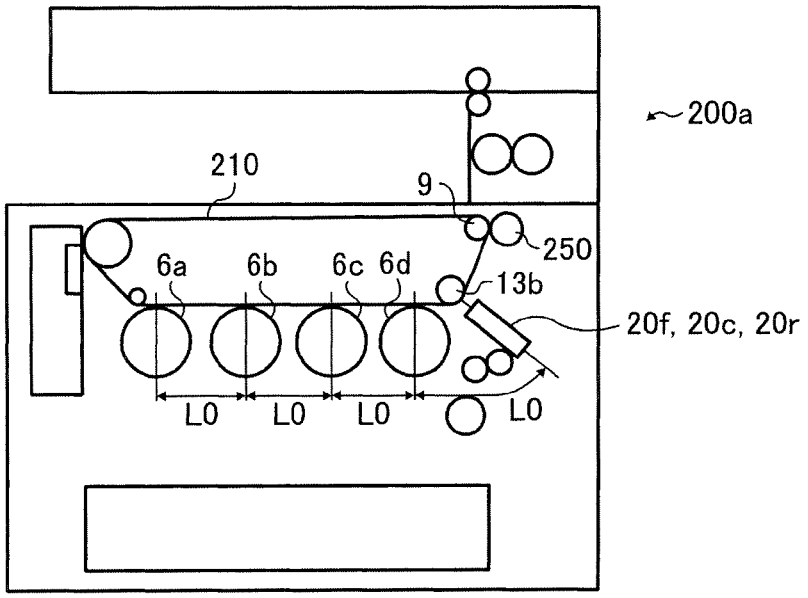
FIG. 32 is a drawing of a different example of a formation of mark patterns.

For example, as shown in an image forming system 200*a* of FIG. 32, a travel distance of a surface of the intermediate transfer belt 210 from the transfer position of the photoconductor drum 6*d* that is located at a most closest position to the optical sensors 20*f*, 20*c*, and 20*r* to the detection position of the optical sensors 20*f*, 20*c*, and 20*r* can be set to the distance L0 of travel of the intermediate transfer belt 210 during one revolution of the driven roller 13*b*. In other words, the optical sensors 20*f*, 20*c*, and 20*r* may be separated from the transfer position of the photoconductor drum 6*d* by a same distance as the distance L0 of travel of the intermediate transfer belt 210 during one revolution of the driven roller 13*b*.

As described above, while the image forming system 200 of FIG. 31 employs the distance 2L from the transfer position of the photoconductor drum 6*d* to the detection position of the optical sensors 20*f*, 20*c*, and 20*r*, the image forming system 200*a* sets the travel distance of a surface of the intermediate transfer belt 210 to a shortest distance capable of canceling or eliminating a factor of eccentricity of the driven roller 13*b*. Accordingly, the distance from the position of transferring the test patterns to the position of detecting the test patterns can be shorter.

Figure 33:
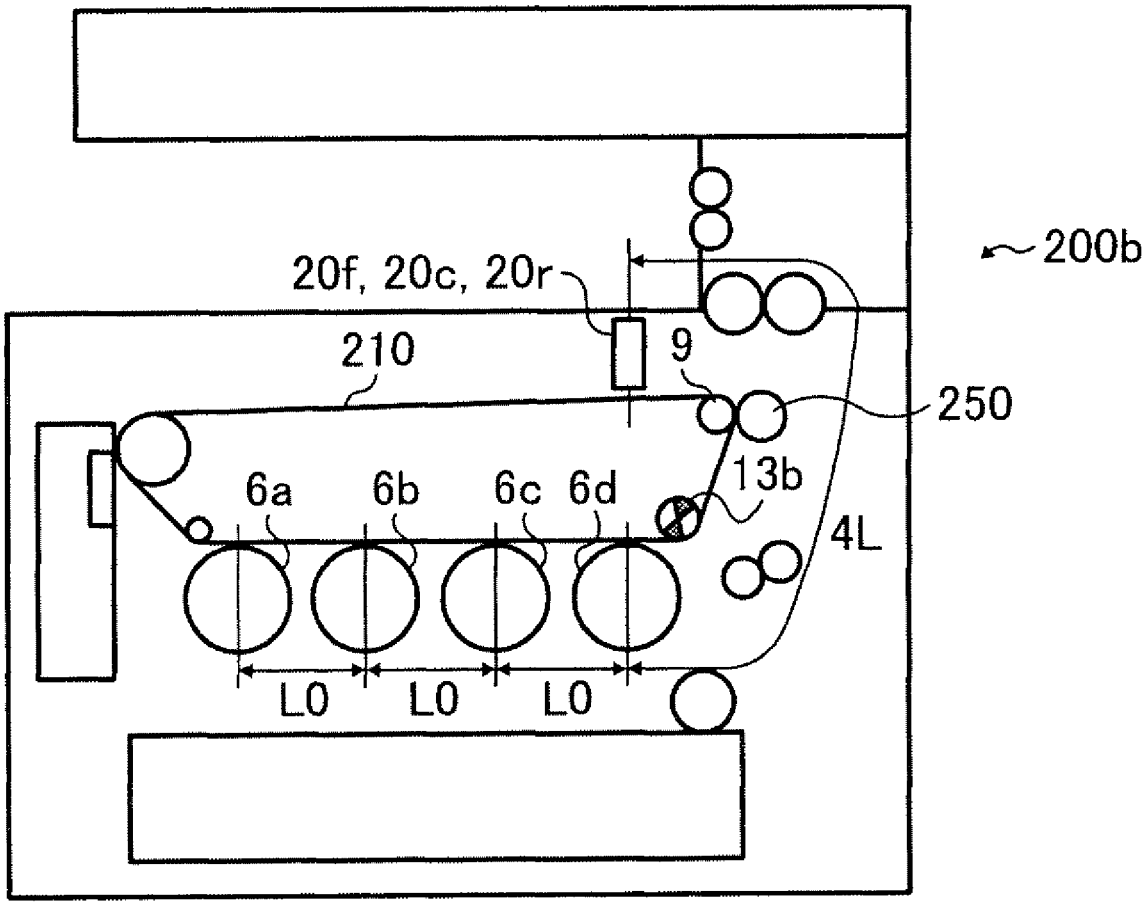
FIG. 33 is a schematic configuration of the image forming system with the optical sensors at another exemplary positions.

Further, for example, as shown in an image forming system 200*b* of FIG. 33, the optical sensors 20*f*, 20*c*, and 20*r* may be disposed at a position facing an upper surface of the intermediate transfer belt 210 opposite to a lower surface, onto which a primary transfer is conducted in a closed loop of the intermediate transfer belt 210. In other words, the optical sensors 20*f*, 20*c*, and 20*r* may be disposed downstream from the secondary transfer roller 250 in the surface travel direction of the intermediate transfer belt 210. With the above-described arrangement of the optical sensors 20*f*, 20*c*, and 20*r*, a travel distance of a surface of the intermediate transfer belt 210 from the transfer position of the photoconductor drum 6*d*, which is a closest photoconductor drum to the optical sensors 20*f*, 20*c*, and 20*r*, to the detection position of the optical sensors 20*f*, 20*c*, and 20*r* can be set to a distance 4L, which is four times greater than the distance L0 of travel of the intermediate transfer belt 210 during one revolution of the driven roller 13*b*. With the above-described configuration, contamination on the optical sensors 20*f*, 20*c*, and 20*r* caused by toner scattering from the photoconductor drums 6*a*, 6*b*, 6*c*, and 6*d* and the developing units, not shown in FIG. 33, can be reduced or prevented, if possible.

Further, after the intermediate transfer belt 210 passes the secondary transfer position at which the secondary transfer roller 250 is disposed, toner remaining on the surface of the intermediate transfer belt 210 after the primary transfer position is mostly removed therefrom. Therefore, the arrangement of the optical sensors 20*f*, 20*c*, and 20*r* as shown in FIG. 33 can further reduce or prevent, if possible, the contamination on the optical sensors 20*f*, 20*c*, and 20*r* caused by toner scattering from the intermediate transfer belt 210.

Further, the distance between two adjacent photoconductor drums of the photoconductor drums 6*a*, 6*b*, 6*c*, and 6*d* can be set to a distance two times greater as the distance L0 of travel of the intermediate transfer belt 210 during one revolution of the driven roller 13*b*, and the distance from the transfer position of the photoconductor drum 6*d* closest to the optical sensors 20*f*, 20*c*, and 20*r* to the detection position of the optical sensors 20*f*, 20*c*, and 20*r* can be set to a distance same as the above-described distance L0.

As described above, according to any one of the image forming systems 100, 200, 200*a*, and 200*b*, by detecting the rotation of the driven roller 13*b*, feeding back the detection results, and controlling the control unit 9*b*, the factors causing the eccentricities of the drive roller 9 and the tension roller 13*a*, the slight slippage between the drive roller 9 and the transfer belt 10, the shocks or impacts given to a transfer sheet when fed and/or discharged, the variations in speed of the transfer belt 10 by applying various biases such as a transfer bias, and so forth can be eliminated, thereby stably conveying the transfer belt 10 or the intermediate transfer belt 210. Accordingly, the misregistration of color images caused by the variations in speed of the transfer belt 10 or the intermediate transfer belt 210 can be reduced, thereby producing images in high quality. Hereinafter, the "transfer belt 10" can be interpreted as the transfer belt 10 or the intermediate transfer belt 210.

Further, the travel distance of the surface of the transfer belt 10 from the transfer position of the photoconductor drums 6*a*, 6*b*, 6*c*, and 6*d* to the detection position of the optical sensors 20*f*, 20*c*, and 20*r* serving as image detectors is set to a value being an integer multiple of the distance L of travel of the transfer belt 10 during one revolution of the driven roller 13*b* with the encoder 15 mounted thereon. Therefore, the factor of the eccentricities of the encoder 15 and the driven roller 13*b* with the encoder 15 mounted thereon can be eliminated. Therefore, the relative amount of the misregistration of the scanning line between adjacent photoconductor drums can be detected accurately, based on the detection data detected by the optical sensors 20*f*, 20*c*, and 20*r*. Accordingly, the relative amount of the misregistration of the scanning line between the adjacent photoconductor drums can be effectively adjusted.

Further, the distance L0 of travel of the transfer belt 10 during one revolution one revolution of the driven roller 13*b* with the encoder 15 mounted thereon is calculated based on the outer diameter of the driven roller 13*b* ($2\pi r$) and the effective belt thickness "t", which is determined by the thickness "T" of the transfer belt 10 and the spanning angle "θ" of the transfer belt 10 with respect to the driven roller 13*b*. By accounting for the effective belt thickness "t" for determining the distance L0 of travel of the transfer belt 10 during one revolution of the driven roller 13*b* with the encoder 15 mounted thereon, the distance L0 can be determined with higher accuracy. Accordingly, the respective positions of the optical sensors 20*f*, 20*c*, and 20*r* can be determined with higher accuracy to the distance being an integer multiple of the driven roller 13*b*, thereby increasing accuracy in detection of the relative amount of the misregistration of the scanning line between adjacent photoconductor drums of the photoconductor drums 6*a*, 6*b*, 6*c*, and 6*d*.

Further, the transfer belt 10 carries the test patterns including the perpendicular marks and the diagonal marks obliquely disposed with respect to the perpendicular marks. By calculating the amount of misregistration between the perpendicular mark and the diagonal mark with respect to the reference interval, the amount of misregistration of the test pattern in the horizontal or main scanning direction. In addition, by calculating the amount of misregistration between the perpendicular marks or between the diagonal marks with respect to the reference interval, the amount of misregistration of the test pattern in the vertical scanning direction.

Further, by forming the multiple mark sets including the multiple toner marks arranged at given intervals along the travel direction of the transfer belt 10, the deviated amount calculated by each mark set can be averaged. When the deviated amount is averaged, factors such as noise can be eliminated, thereby detecting, accurately, the relative amount of misregistration of the scanning line between the adjacent photoconductor drums of the photoconductor drums 6*a*, 6*b*, 6*c*, and 6*d*.

Further, by forming multiple mark sets at different positions in a direction perpendicular to the surface travel direction of the transfer belt 10, the relative amount of misregistration of the scanning line between the adjacent photoconductor drums of the photoconductor drums 6*a*, 6*b*, 6*c*, and 6*d* can be detected accurately in the entire image forming area. The inclination of the scanning line can also be detected. In addition, when the mark set is formed at three or more positions in a direction perpendicular to the surface travel direction of the transfer belt 10, the curve of the scanning line can be detected.

Accordingly, preferable images can be produced by adjusting at least one of the misregistration in the horizontal or main scanning direction, the magnification in the horizontal or main scanning direction, the misregistration in the vertical scanning or sub-scanning direction, the inclination, and the curve based on the detection data obtained by the optical sensors 20*f*, 20*c*, and 20*r*.

Further, the optical sensors 20*f*, 20*c*, and 20*r* are disposed at respective positions opposite to the upper surface of the intermediate transfer belt 210 facing the lower surface of the intermediate transfer belt 210, contacting the photoconductor drums 6*a*, 6*b*, 6*c*, and 6*d* to perform the primary transfer operation in a closed loop of the intermediate transfer belt 210 or downstream from the secondary transfer roller 250 in the surface travel direction of the intermediate transfer belt 210. When compared with the optical sensors 20*f*, 20*c*, and 20*r* disposed in the vicinity of the surface on which the primary transfer operation is conducted, the above-described arrangement can prevent the optical sensors 20*f*, 20*c*, and 20*r* from contamination caused by toner scattering from the photoconductor drums 6*a*, 6*b*, 6*c*, and 6*d* and the developing units.

In the image forming systems 200, 200*a*, and 200*b* employing the method using the intermediate transfer belt 210, the optical sensors 20*f*, 20*c*, and 20*r* may be disposed downstream from the secondary transfer roller 250 in the surface travel direction of the intermediate transfer belt 210. With this configuration, when compared with optical sensors disposed upstream from the secondary transfer roller 250 in the travel direction of the intermediate transfer belt 210, contamination on the optical sensors 20*f*, 20*c*, and 20*r* due to toner scattering from the intermediate transfer belt 210 can be reduced.

Further, in the image forming apparatus with the intermediate transfer method, the optical sensors 20*f*, 20*c*, and 20*r* may be disposed upstream from the secondary transfer roller 250 in the surface travel direction of the intermediate transfer belt 210. With this configuration, when compared with the optical sensors 20*f*, 20*c*, and 20*r* disposed downstream from the secondary transfer roller 250 in the surface travel direction of the intermediate transfer belt 210, the time period from the formation of the toner marks to the detection of the toner marks by the optical sensors 20*f*, 20*c*, and 20*r* can be reduced. Therefore, the time period required for the adjustment control of the misregistration can be reduced.

Further, it is possible to eliminate a separation and contact mechanism that performs an operation of separating the secondary transfer roller 250 from the intermediate transfer belt 210 when the test patterns pass the portion. Accordingly, a removal of the separation and contact mechanism can contribute to an increase of the cost reduction and reliability.

Further, the optical sensors 20*f*, 20*c*, and 20*r* are separated by the distance L0 of travel of the transfer belt 210 for one rotation of the driven roller 13*b* with the encoder 15 mounted thereon from the transfer position of the photoconductor drum 6*d* at the extreme downstream side in the surface travel direction of the intermediate transfer belt 210. With the above-described configuration, the time period from the formation of the toner marks to the detection of the toner marks by the optical sensors 20*f*, 20*c*, and 20*r* can be reduced. Therefore, the time period required for the adjustment control of the misregistration can be reduced.

Further, the distance from the transfer position of at least one photoconductor drum of the photoconductor drums 6*a*, 6*b*, 6*c*, and 6*d* is set to a value being an integer multiple of the distance L0 of travel of the transfer belt 10 during one revolution of the driven roller 13*b* while the rotations of the driven roller 13*b* is being detected. With the above-described setting, a relative amount of misregistration of the scanning line between the photoconductor drums adjacent to each other can effectively be detected.

The above-described example embodiments are illustrative, and numerous additional modifications and variations are possible in light of the above teachings. For example, elements and/or features of different illustrative and exemplary embodiments herein may be combined with each other and/or substituted for each other within the scope of this disclosure. It is therefore to be understood that, the disclosure of this patent specification may be practiced otherwise than as specifically described herein.

Obviously, numerous modifications and variations of the present invention are possible in light of the above teachings. It is therefore to be understood that, the invention may be practiced otherwise than as specifically described herein.

What is claimed is:

1. An image forming system, comprising:

multiple image carriers;

an optical writing unit configured to optically write images on respective surfaces of the multiple image carriers;

a transfer member in a form of a closed loop extended by a drive roller and at least one driven roller and configured to receive the images formed on the multiple image carriers on one of a surface thereof and a recording medium carried thereby;

a rotation detector configured to detect a rotation condition of the at least one driven roller;

a roller driving unit configured to drive the drive roller;

a belt controller configured to transmit detection results obtained by the rotation detector to the roller driving unit;

an image detector configured to detect the images formed on the surface of the transfer member at given intervals along a travel direction of the transfer member and obtain detection data; and a controller configured to calculate an amount of misregistration with respect to a reference interval of the images based on the detection data obtained by the image detector and correct relative misregistration of a scanning line between adjacent image carriers, a distance from a first transfer position of each of the multiple image carriers to a detection position of the image detector being an integer multiple of a travel distance of the transfer member during one revolution of the at least one driven roller, the at least one driven roller being a different size than the drive roller and including the rotation detector, the rotation detector detecting the rotation condition.

2. The image forming system according to claim 1, wherein the travel distance of the transfer member during one revolution of the at least one driven roller is determined based on an outer diameter of the at least one driven roller, a thickness of the transfer member, and an angle of the transfer member to the at least one driven roller.

3. The image forming system according to claim 1, wherein the images arranged at the given intervals on the transfer member along the travel direction of the transfer member include a first image and a second image diagonally formed with respect to the first image.

4. The image forming system according to claim 1, wherein the images arranged at the given intervals on the transfer member along the travel direction of the transfer member are formed as a mark set, multiple mark sets being formed on the surface of the transfer member.

5. The image forming system according to claim 4, wherein the multiple mark sets are formed at different positions on the surface of the transfer member in a direction perpendicular to a surface travel direction of the transfer member.

6. The image forming system according to claim 1, wherein the controller adjusts at least one of a misregistration in a main scanning direction, a magnification in the main scanning direction, a positional deviation in a sub-scanning direction, a magnification in a sub-scanning direction, an inclination, and a curve based on the detection data obtained by the image detector.

7. The image forming system according to claim 1, wherein the image detector is positioned opposite a first surface of the transfer member and facing a second surface of the transfer member, the second surface contacting the image carrier.

8. The image forming system according to claim 1, wherein the image detector is positioned separated from the first transfer position of an image carrier disposed at an extreme downstream side in the travel direction of the transfer member by the transfer distance of the transfer member during one revolution of the at least one driven roller.

9. The image forming system according to claim 1, wherein:

the transfer member sequentially receives the images as an overlaid image on the surface thereof at the first transfer position and transfers the overlaid image onto the recording medium at a second transfer position, and the image detector is disposed upstream from the second transfer position in the travel direction of the transfer member.

10. The image forming system according to claim 1, wherein:

the transfer member sequentially receives the images as an overlaid image on the surface thereof at the first transfer position and transfers the overlaid image onto the recording medium at a second position, and the image detector is disposed downstream from the second transfer position in the travel direction of the transfer member.

11. A method of detecting a misregistration of a color image, comprising:

obtaining a rotation condition of a driven roller extending a transfer member therearound;

transmitting an obtained value of an output power of a rotation detector to a belt controller;

comparing the obtained value of the output power of the rotation detector and a target value;

feeding back a result of a comparison of the obtained value and the target value to a roller driving unit;

arranging images at given intervals on the transfer member along a travel direction of the transfer member;

detecting the images formed on the transfer member by an image detector; and calculating an amount of misregistration with respect to a reference interval of the images based on a result of the detecting, a distance from a first transfer position of at least one image carrier to a detection position of the image detector being an integer multiple of a travel distance of the transfer member during one revolution of the driven roller, the driven roller being a different size than a drive roller and including the rotation detector, the rotation detector detecting the rotation condition.

12. The method according to claim 11, wherein the travel distance of the transfer member during one revolution of the driven roller is determined based on an outer diameter of the driven roller, a thickness of the transfer member, and an angle of the transfer member to the driven roller.

13. The method according to claim 11, wherein the images arranged at the given intervals on the transfer member along the travel direction of the transfer member include a first image and a second image diagonally formed with respect to the first image.

14. The method according to claim 11, wherein the images arranged at the given intervals on the transfer member along the travel direction of the transfer member are formed as a mark set, multiple mark sets being formed on the surface of the transfer member.

15. The method according to claim 14, wherein the multiple mark sets are formed at different positions on the surface of the transfer member in a direction perpendicular to a surface travel direction of the transfer member.

16. The method according to claim 11, wherein the controlling includes adjusting at least one of a misregistration in a main scanning direction, a magnification in the main scanning direction, a positional deviation in a sub-scanning direction, a magnification in a sub-scanning direction, an inclination, and a curve based on the detection data obtained by the image detector.

* * * * *